US006975829B2

(12) United States Patent
Aruga

(10) Patent No.: US 6,975,829 B2
(45) Date of Patent: Dec. 13, 2005

(54) DEVICE FOR FIXING AN IMAGE ON A SHEET MEDIUM

(75) Inventor: Tomoe Aruga, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 46 days.

(21) Appl. No.: 10/449,720

(22) Filed: Jun. 2, 2003

(65) Prior Publication Data

US 2004/0033092 A1 Feb. 19, 2004

(30) Foreign Application Priority Data

| | | |
|---|---|---|
| May 31, 2002 | (JP) | 2002-158920 |
| Jun. 6, 2002 | (JP) | 2002-165109 |
| Jun. 11, 2002 | (JP) | 2002-169699 |
| Aug. 6, 2002 | (JP) | 2002-228612 |

(51) Int. Cl.[7] ..... G03G 15/20
(52) U.S. Cl. ..... 399/329; 219/216
(58) Field of Search ..... 399/45, 328, 329; 219/216; 432/60

(56) References Cited

U.S. PATENT DOCUMENTS 5,359,401 A * 10/1994 Uehara et al. ..... 219/216
6,088,549 A * 7/2000 Kagawa et al. ..... 399/67
6,148,169 A * 11/2000 Tsukamoto ..... 399/328

FOREIGN PATENT DOCUMENTS

| | | |
|---|---|---|
| JP | 6-40235 B2 | 5/1994 |
| JP | 3084692 B2 | 7/2000 |

* cited by examiner

*Primary Examiner*—William J. Royer
(74) *Attorney, Agent, or Firm*—Sughrue Mion, PLLC

(57) ABSTRACT

A fixing device includes a fuser roller having a built-in heat source therein and an elastic member layered on the outer surface thereof; a pressure roller to be pressed against the fuser roller; a heat-resistant belt which is wound around the outer periphery of the pressure roller and is sandwiched between the pressure roller and the fuser roller so as to travel; and a belt tensioning member for tensioning the heat-resistant belt. The belt tensioning member is arranged on the upstream side in the traveling direction of the heat-resistant belt relative to the pressed portion of the fuser roller and the pressure roller and near the fuser roller beyond the tangent to the pressed portion to wrap the heat-resistant belt around the outer periphery of the fuser roller to form a nip.

50 Claims, 35 Drawing Sheets

FIG. 28(A)
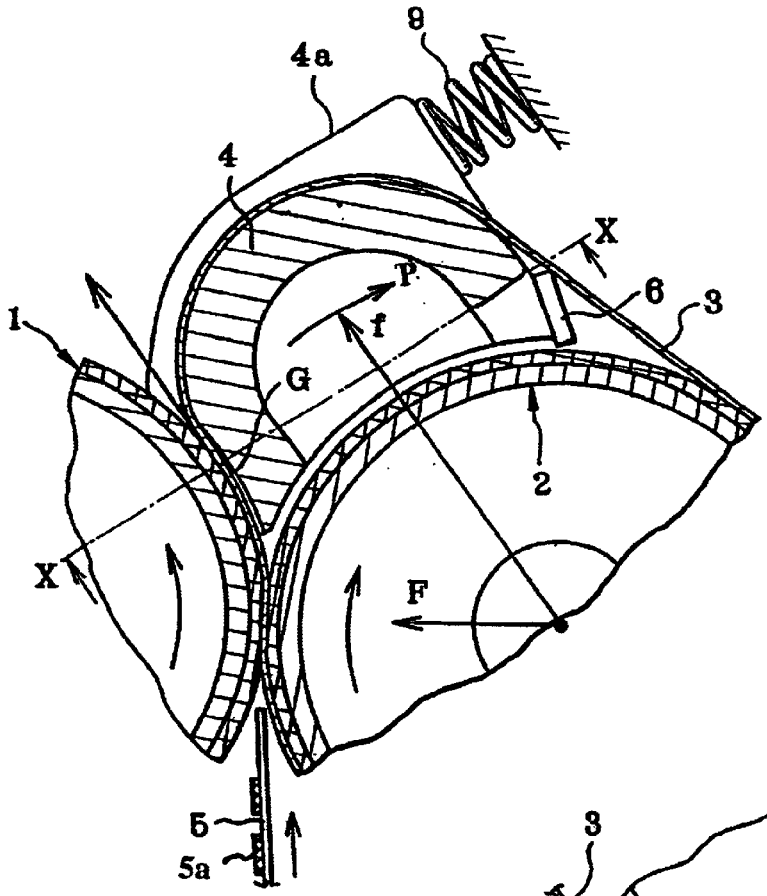
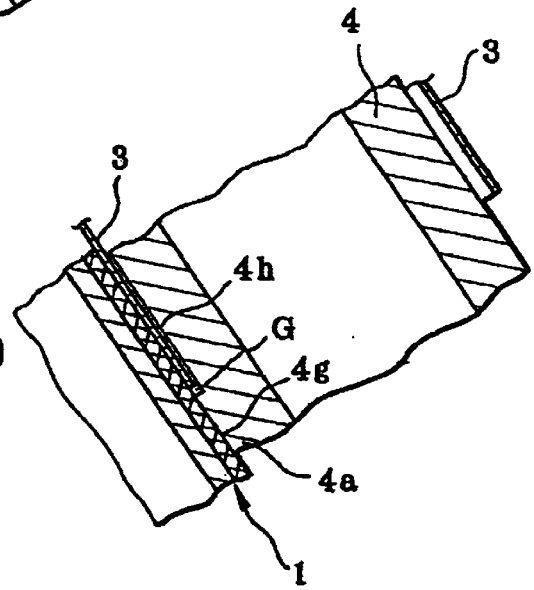
FIG. 28(B)

FIG. 29(A)
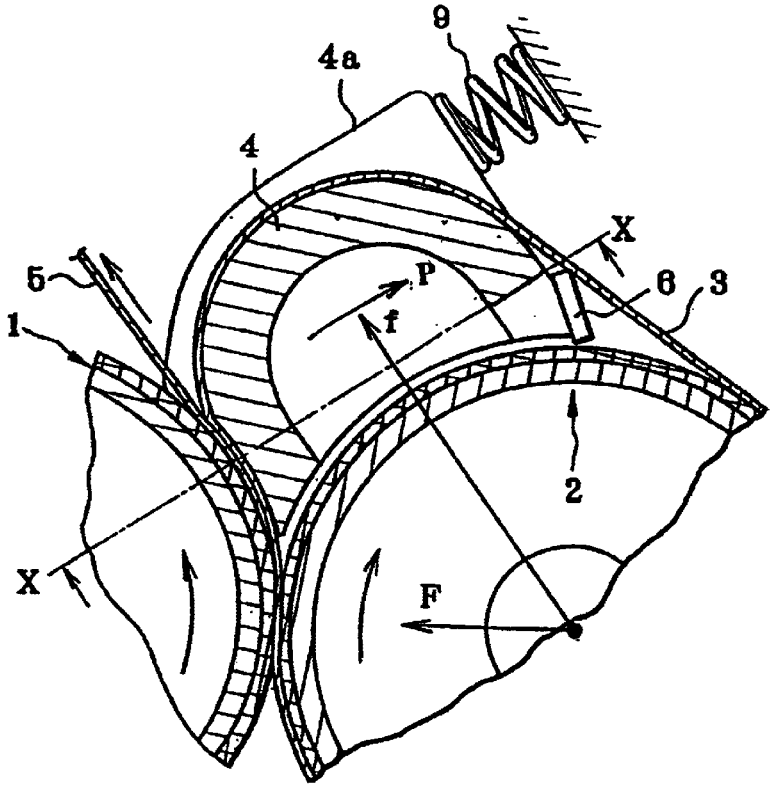
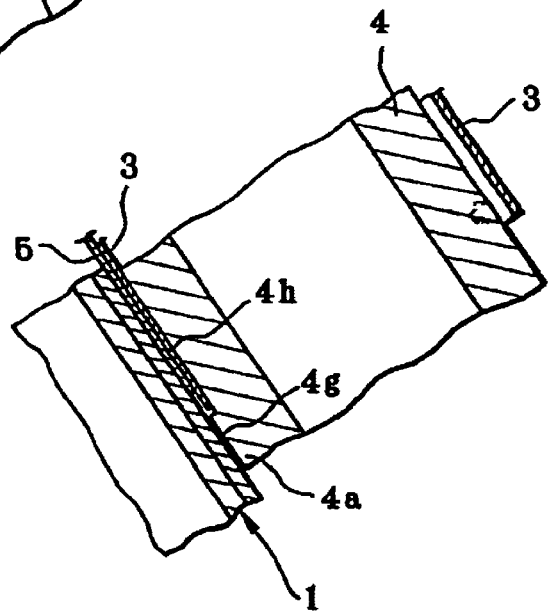
FIG. 29(B)

DEVICE FOR FIXING AN IMAGE ON A SHEET MEDIUM

BACKGROUND OF THE INVENTION

The present invention relates to a fixing device, for fixing an unfixed toner image formed on a sheet medium, comprising a fuser roller having an outer surface coated with an elastic member and a built-in heat source, a pressure roller to be pressed against the fuser roller, a heat-resistant belt which Is wound around the periphery of the pressure roller and is sandwiched between the pressure roller and the fuser roller so as to travel, and a belt tensioning member for tensioning the heat-resistant belt. Further, the present invention relates to an image forming apparatus.

In an image forming apparatus such as a copying machine, a printer, and a facsimile machine, a fixing device of fuser roller type in which an unfixed toner image on a receiving medium is fused by contact beating has been proposed (Japanese Patent No. 3084692) which comprises a rotatable fuser roller having an outer surface coated with an elastic member and a built-in heat source, a heat-resistant belt which is tensioned by a plurality of supporting rollers, and pressurizing means which brings the heat-resistant belt to be wrapped around the fuser roller partially for a predetermined angle to have a nip area and applies pressure locally such that the pressure on an outlet of the nip area is larger than the pressure on the other portion to create a deflection in the elastic member for facilitating the ejection of a sheet medium from the nip portion.

In this conventional fixing device, the fuser roller has a deflection beforehand in the surface thereof because of the existence of the pressurizing means. At the outlet of the nip area, the deflection is instantaneously cancelled from a state that toner is in contact with the surface of the fuser roller. Therefore, when ejecting the sheet medium from the nip portion, the adherence between the toner and the fuser roller is reduced to prevent the sheet medium from adhering to the fuser roller, whereby even a weak recording medium can be easily peeled off at the outlet of the belt nip portion. Therefore, this device achieves the elimination of a peeling pawl which has been used in a prior technique.

Further, a fixing device has been proposed (Japanese Patent Publication No. H06-40235) in which rollers have a preset pressure therebetween to deform the roller(s) to form a nip and a sheet medium having an unfixed toner image thereon passes the nip, thereby fixing the toner image. Depending on the characteristics of the sheet medium, the driving speed of the rollers can be selected from a first speed and a second speed.

Furthermore, a fixing device has been proposed (Japanese Patent Unexamined Publication No. H08-262903) comprising an endless belt which is tensioned in such a manner as to travel while being in contact with a rotating fuser roller which has an outer surface coated with an elastic member and a built-in heat source and a pressure pad which is non-rotatably arranged inside of the endless belt to press the endless belt to the fuser roller to form a nip and to deform the elastic member as the outer layer of the fuser roller, wherein a sheet medium having an unfixed toner image thereon passes between the fuser roller and the endless belt, thereby fixing the toner on the sheet medium. This device has an advantage that as the pressure pad is arranged as a non-rotatable member, the heat transmitted from the fuser roller is hardly emanated so that the heat drawn from the fuser roller can be minimized.

However, in the structure of the aforementioned fixing device of Japanese Patent No. 3084692, the heat-resistant belt which is tensioned and supported by the supporting rollers in such a manner as to allow its traveling is wrapped around the fuser roller only partially for such an angle enabling the nip formation by pressurizing means and is driven while applying a large pressure locally at the outlet of the nip area, thus requiring plural supporting rollers and their bearings. Further, a long peripheral length of the heat-resistant belt is required. Accordingly, the fixing device becomes not only complex and large but also expensive. The complexity, large size, and expensiveness of the fixing device inevitably lead to the complexity, large size, and expensiveness of an image forming apparatus in which the fixing device is mounted.

There is another disadvantage. That is, the heat-resistant belt is heated at the nip relative to the rotatable fuser roller with the built-in heat source. During this, the heat energy is drawn by the plural supporting rollers since the heat-resistant belt has the long peripheral length because the belt is supported by the plural supporting rollers. In addition, the natural heat release is increased according to the peripheral length. Accordingly, a long time is necessary to reach a predetermined temperature, thus unfortunately requiring a long warm-up time from a time point at which the power is ON to a time point at which fixing is enabled.

Though the structure, in which the heat-resistant belt is wrapped around the fuser roller only partially for such an angle enabling the nip formation and a pressure is locally applied such that the pressure on the outlet of the nip area is larger than the pressure on the other portion to create a deflection in the elastic member, is preferable to prevent a sheet medium from adhering to the fuser roller, but curls the sheet medium because it is ejected along the deflection of the elastic member or wrinkles because of the local high pressure.

The device of Japanese Patent Publication No. H06-40235, in which the driving speed of the roller can be selected from the first speed and the second speed depending on the characteristics of a sheet medium, is not preferable because the beat capacity of the roller is so large as to require a long warm-up time. In addition, the sheet medium which passes the long nip formed by deforming the roller with pressure may be deformed similarly to the former device, that is, curled or wrinkled due to large stress by the pressure.

In the device of Japanese Patent Unexamined Publication No. H08-262903, the heat transmitted from the fuser roller is hardly emanated by the arrangement of the pressure pad not allowing its rotation. However, there is a problem that heat is transmitted from the fuser roller to the pressure pad through the endless belt during the warm-up time, thus requiring a long warm-up time. In addition, three rollers or more are required to move the belt, thus making the device larger.

SUMMARY OF THE INVENTION

It is an object of the present invention to simplify the structure, reduce the size, and reduce the cost of a fixing device of fuser roller type and also to shorten the warm-up time of the device. It is another object of the present invention to prevent ejected sheet media from being curled or wrinkled by reducing the stress on the sheet media.

For achieving the aforementioned object, the present invention provides a fixing device comprising: a fuser roller, and a pressure roller to be pressed against the fuser roller via a heat-resistant belt, wherein said beat-resistant belt is laid around a slidable belt tensioning member and said pressure roller with certain tension, and said belt tensioning member is disposed at such a position that said heat-resistant belt is wrapped around said fuser roller beyond the tangent to the pressed portion between said fuser roller and said pressure roller.

The present invention also provides a fixing device, for fixing an unfixed toner image formed on a sheet medium, comprising: a fuser roller having a built-in heat source therein; a pressure roller to be pressed against the fuser roller; a heat-resistant belt which is wound around the outer periphery of said pressure roller and is sandwiched between said pressure roller and said fuser roller so as to travel; and a belt tensioning member for tensioning said heat-resistant belt, wherein said belt tensioning member is arranged on the upstream side in the traveling direction of said heat-resistant belt relative to the pressed portion between said fuser roller and said pressure roller and is disposed at such a position that said heat-resistant belt is wrapped around said fuser roller beyond the tangent to the pressed portion between said fuser roller and said pressure roller to form a nip.

Further, the present invention provides a fixing device, for fixing an unfixed toner image formed on a sheet medium, comprising: a fuser roller having a built-in heat source therein; a pressure roller to be pressed against the fuser roller; a heat-resistant belt which is wound around the outer periphery of said pressure roller and is sandwiched between said pressure roller and said fuser roller so as to travel; and a belt tensioning member for tensioning said heat-resistant belt, wherein said belt tensioning member is arranged on the upstream side in the traveling direction of said heat-resistant belt relative to the pressed portion between said fuser roller and said pressure roller and said belt tensioning member is supported to be able to swing toward said fuser roller. The fixing device is characterized in that said belt tensioning member is supported to be able to swing about the rotary shaft of said pressure roller or is supported to be able to swing about a shaft different from the rotary shaft of said pressure roller.

The fixing device is characterized in that said belt tensioning member is disposed to be spaced apart from said fuser roller or is disposed to be pressed against said fuser roller, that the pressing force of said belt tensioning member against said fuser roller is set to be smaller than the pressing force of said pressure roller against said fuser roller, and that, in the contact pressure distribution between said fuser roller and said heat-resistant belt, the highest pressure is supplied at the pressed portion between said fuser roller and said pressure roller.

The fixing device is characterized in that said belt tensioning member is a sliding member, a semilunar member, a roller member, or a secondary transfer roller, that said belt tensioning member has a convexity(-ies) which is disposed at one end or both ends of said belt tensioning member to limit the lateral shift of said heat-resistant belt by that said heat-resistant belt collides with said convexity, that said fuser roller is driven via said heat-resistant belt by driving said pressure roller, and that said pressure roller has a surface harder than an elastic member layered on the outer surface of said fuser roller.

The fixing device is characterized in that the coefficient of friction between said pressure roller and said heat-resistant belt is set to be larger than the coefficient of friction between said belt tensioning member and said heat-resistant belt, that the wrapping angle between said pressure roller and said heat-resistant belt is set to be larger than the wrapping angle between said belt tensioning member and said heat-resistant belt, and that the diameter of said pressure roller is set to be lager than the diameter of said belt tensioning member.

The fixing device is characterized in that a means for driving said fuser roller and said pressure roller is designed to provide a plurality of rotational speeds and to select the driving speed from the rotational speeds, depending on sheet medium characteristics, that the means for driving said fuser roller and said pressure roller is designed to provide a first rotational speed and a second rotational speed slower than said first rotational speed and to select the driving speed from said rotational speeds, depending on sheet medium characteristics. The fixing device is characterized by further comprising a detecting means for detecting said sheet medium characteristics, wherein the sheet medium characteristics of said sheet medium having the unfixed toner image thereon is detected on the way of proceeding of the sheet medium, and said driving speed is selected from said rotational speeds depending on said sheet medium characteristics, and by further comprising a setting means for setting the selection information depending on said sheet medium characteristics, wherein the setting depending on the sheet medium characteristics is made during the process of making a fixing command for said sheet medium having the unfixed toner image thereon, and said driving speed is selected from said rotational speeds on the basis of the setting.

The fixing device is characterized by further comprising a cleaning member which is arranged between said pressure roller and said belt tensioning member and slides along the inner periphery of said heat-resistant belt, wherein said fuser roller is formed by using a pipe having an outer diameter of 60 mm or less and a thickness of 2 mm or less and coating the outer periphery of the pipe with the elastic member of a thickness of 2 mm or less and said pressure roller is formed by using a pipe having an outer diameter of 60 mm or less and a thickness of 2 mm or less.

The present invention provides a fixing device, for fixing an unfixed toner image formed on a sheet medium, comprising: a fuser roller having a built-in heat source therein; a pressure roller to be pressed against the fuser roller, a heat-resistant belt which is wound around the outer periphery of said pressure roller and is sandwiched between said pressure roller and said fuser roller so as to travel; and a belt tensioning member for tensioning said heat-resistant belt, wherein said belt tensioning member is arranged to be able to swing relative to said fuser roller so as to wrap the heat-resistant belt around said fuser roller to form a fixing nip and wherein a gap is created between said belt tensioning member and said fuser roller when no sheet medium passes and said belt tensioning member is pressed against said fuser roller via a sheet medium when the sheet medium passes. The fixing device is characterized in that said belt tensioning member is arranged on the upstream side or the downstream side in the traveling direction of said heat-resistant belt relative to the pressed portion between said fuser roller and said pressure roller.

The present invention provides a fixing device, for fixing an unfixed toner image formed on a sheet medium, comprising: a fuser roller having a built-in heat source therein; a pressure roller to be pressed against the fuser roller; a heat-resistant belt which is wound around the outer periphery of said pressure roller and is sandwiched between said pressure roller and said fuser roller so as to travel; and a belt tensioning member for tensioning said heat-resistant belt, wherein said belt tensioning member is arranged on the upstream side in the traveling direction of said heat-resistant belt relative to the pressed portion of said fuser roller and said pressure roller such that said belt tensioning member is able to swing so as to wrap the heat-resistant belt around said fuser roller to form a fixing nip and wherein, assuming that the pressing force at the start position of the nip is P1, the pressing force at the pressed portion where the pressure roller presses the fuser roller is P3, and the pressing force at a position between the start position of the nip and the pressed portion is P2, the relation P1 <P2<P3 is satisfied.

The present invention provides a fixing device, for fixing an unfixed toner image formed on a sheet medium, comprising: a fuser roller having a built-in heat source therein; a pressure roller to be pressed against the fuser roller; a heat-resistant belt which is wound around the outer periphery of said pressure roller and is sandwiched between said pressure roller and said fuser roller so as to travel; and a belt tensioning member for tensioning said heat-resistant belt, wherein said belt tensioning member is arranged on the downstream side in the traveling direction of said heat-resistant belt relative to the pressed portion of said fuser roller and said pressure roller such that said belt tensioning member is able to swing so as to wrap the heat-resistant belt around said fuser roller to form a fixing nip and wherein, assuming that the pressing force at the end position of the nip is P1', the pressing force at the pressed portion where the pressure roller presses the fuser roller is P3, and the pressing force at a position between the end position of the nip and the pressed portion is P2, the relation P1'<P2<P3 is satisfied.

The fixing device is characterized in that a gap is created between said belt tensioning member and said heat-resistant belt when no sheet medium passes and said belt tensioning member is pressed against said fuser roller via a sheet medium when the sheet medium passes, that said belt tensioning member is biased to swing toward said fuser roller by a biasing means, that said belt tensioning member is slid upon said fuser roller at position(s) outside of said heat-resistant belt in the width direction. The fixing device is characterized in that said belt tensioning member is supported to be able to swing about the rotary shaft of said pressure roller or about a shaft different from the rotary shaft of said pressure roller.

BRIEF DESCRIPTION OF THE DRAWINGS

FIGS. 15(A), 15(B) show another embodiment of a fixing device according to the present invention, wherein FIG. 15(A) is a sectional view taken along a line X—X and seen in a direction of arrows of FIG. 15(B) and FIG. 15(B) is a sectional view taken along a line Y—Y and seen in a direction of arrows of FIG. 15(A);

FIGS. 16(A), 16(B) show another embodiment of a fixing device according to the present invention, wherein FIG. 16(A) is a sectional view taken along a line X—X and seen in a direction of arrows of FIG. 16(B) and FIG. 16(B) is a sectional view taken along a line Y—Y and seen in a direction of arrows of FIG. 16(A);

FIGS. 17(A), 17(B) show another embodiment of a fixing device according to the present invention, wherein FIG. 17(A) is a sectional view taken along a line X—X and seen in a direction of arrows of FIG. 17(B) and FIG. 17(B) is a sectional view taken along a line Y—Y and seen in a direction of arrows FIG. 17(A);

FIGS. 19(A), 19(B) show another embodiment of a fixing device according to the present invention, wherein FIG. 19(A) is a sectional view and FIG. 19(B) is a sectional view taken along a line Y—Y and seen in a direction of arrows of FIG. 19(A);

FIGS. 24(A)–24(D) are illustrations for explaining the features of the embodiment, wherein FIG. 24(A) is a sectional view, FIG. 24(B) is a graph showing variations in fixing pressure relative to a passing position in the nip, FIG.

24(C) is a graph showing variations in fixing pressure by the swinging force of a belt tensioning member without assist, and FIG. 24(D) is a graph showing fixing pressure by the swinging force with assist;

FIGS. 25(A), 25(B) show a variation example of the fixing device as shown in FIGS. 19(A), 19(B), wherein FIG. 25(A) is a sectional view and FIG. 25(B) is a sectional view taken along a line Y—Y and seen in a direction of arrows of FIG. 25(A);

FIGS. 27(A), 27(B) show another embodiment of the fixing device according to the present invention, wherein FIG. 27(A) is a sectional view and FIG. 27(B) is a sectional view taken along a line Y—Y and seen in a direction of arrows of FIG. 27(A);

FIGS. 28(A), 28(B) show the same structure of FIGS. 27(A), 27(B) in a state that no sheet medium passes, wherein FIG. 28(A) is a partially enlarged sectional view of FIG. 27(A) and FIG. 28(B) is a sectional view taken along a line X—X and seen in a direction of arrows of FIG. 28(A);

FIGS. 29(A), 29(B) show the same structure of FIGS. 27(A), 27(B) in a state that a sheet medium passes, wherein FIG. 29(A) is a partially enlarged sectional view of FIG. 27(A) and FIG. 29(B) is a sectional view taken along a line X—X and seen in a direction of arrows of FIG. 29(A);

FIGS. 30(A)–30(C) shows examples of fixing pressure which varies according to the passing position in the nip in FIGS. 29(A), 29(B), wherein FIG. 30(A) is a sectional view, FIG. 30(B) is a graph showing variations in fixing pressure relative to a passing position in the nip in a case that the swinging force of the belt tensioning member is assisted, and FIG. 30(C) is a graph showing fixing pressures by a sheet medium in a case that the swinging force of the belt tensioning member is assisted;

FIGS. 31(A), 31(B) show a variation example of the embodiment shown in FIGS. 27(A), 27(B), wherein FIG. 31(A) is a sectional view and FIG. 31(B) is a sectional view taken along a line Y—Y and seen in a direction of arrows of FIG. 31(A);

DESCRIPTION OF THE PREFERRED EMBODIMENTS

Figure 1:
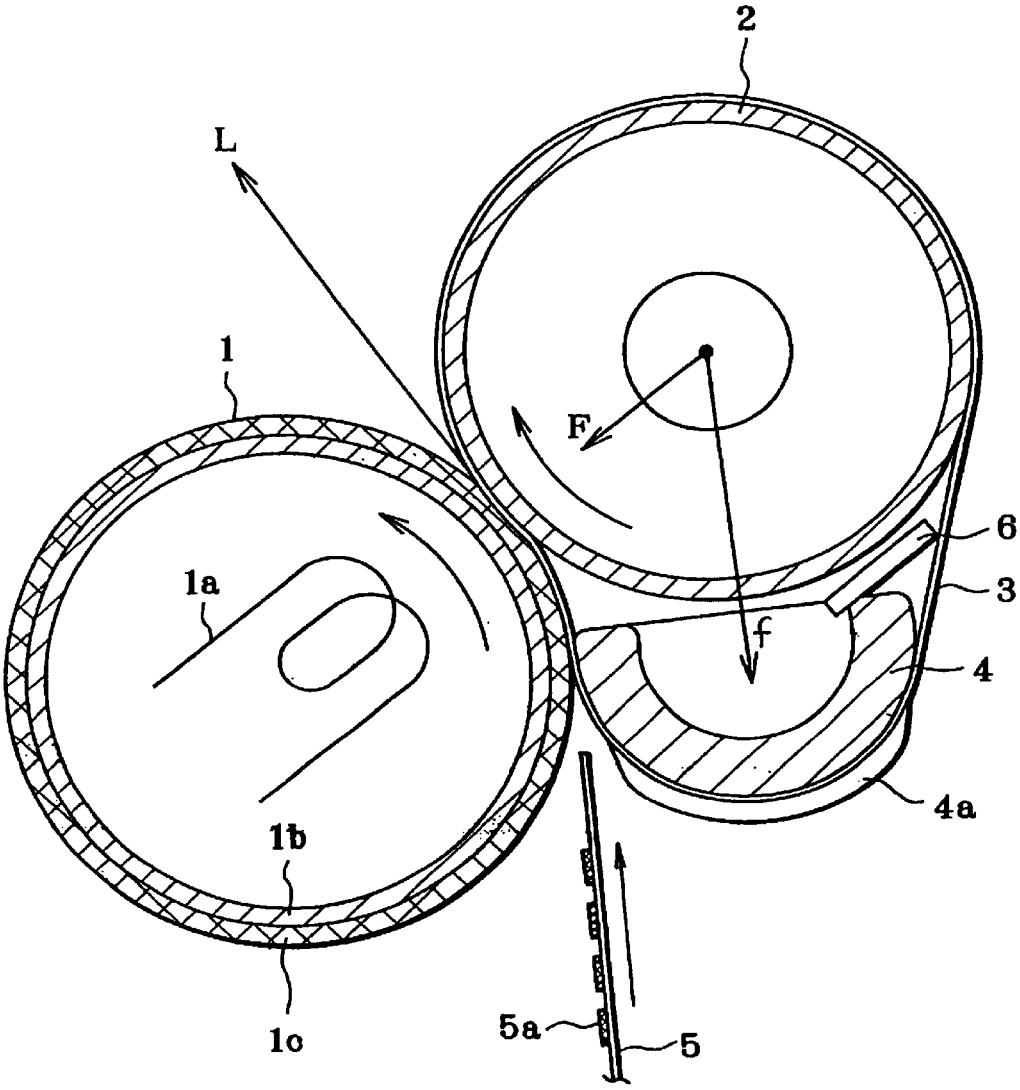
FIG. 1 is an illustration showing an embodiment of a fixing device according to the present invention.

Hereinafter, embodiments of the present invention will be described with reference to the attached drawings. FIG. 1 is an illustration showing an embodiment of a fixing device according to the present invention, in which numeral 1 designates a fuser roller, 1*a* designates a halogen lamp, 1*b* designates a roller substrate, 1*c* designates an elastic member, 2 designates a pressure roller, 3 designates a heat-resistant belt, 4 designates a belt tensioning member, 4*a* designates a convexity, 5 designates a sheet medium, 5*a* designates an unfixed toner image, 6 designates a cleaning member, and L designates a tangent to a pressed portion.

In FIG. 1, the fuser roller 1 is formed by using a pipe having an outer diameter of 60 mm or less and a thickness of 2 mm or less as the roller substrate 1*b* and coating the outer periphery of the pipe with the elastic member 1*c* of 2 mm or less. The fuser roller 1 has the built-in halogen lamp 1*a* inside the roller substrate 1*b* as a heat source and is designed to be rotatable. The pressure roller 2 is formed by using a pipe having an outer diameter of 60 mm or less and a thickness of 2 mm or less. The pressure roller 2 is arranged to face the fuser roller 1 such that the pressure roller 2 is in contact with the fuser roller 1 with a predetermined pressure and is designed to be rotatable.

The heat-resistant belt 3 is an endless belt which is sandwiched between the fuser roller 1 and the pressure roller 2 and is wound around the outer periphery of the pressure roller 2 so that the heat-resistant belt 3 can travel, and is composed of a metal tube such as a stainless steel tube or a nickel electroforming tube, or a resin tube made of a heat-resistant resin such as polyimide or silicone having a thickness of 0.03 mm or more.

The belt tensioning member 4 is a semilunar heat-resistant belt sliding member which is arranged inside the heat-resistant belt 3 to cooperate with the pressure roller 2 to tension the heat-resistant belt 3 and is arranged at such a position as to wrap the heat-resistant belt 3 around the fuser roller 1 partially for forming a nip. The belt tensioning member 4 is arranged at such a position that the heat-resistant belt 3 is wrapped around the fuser roller 1 beyond the tangent L to the pressed portion between the fuser roller 1 and the pressure roller 2 to form the nip. Accordingly, the belt tensioning member 4 is lightly pressed against the fuser roller 1 at the start position of the nip. The convexity(-ies) 4*a* is disposed at one end or both ends of the belt tensioning member 4 such that the heat-resistant belt 3 when shifting sideward collides with the convexity, thereby limiting the lateral shift of the heat-resistant belt 3.

For stably driving the heat-resistant belt 3 by the pressure roller 2 while the heat-resistant belt 3 is tensioned by the pressure roller 2 and the belt tensioning member 4, it is preferable to set the coefficient of friction between the pressure roller 2 and the heat-resistant belt 3 to be larger than the coefficient of friction between the belt tensioning member 4 and the heat-resistant belt 3. However, the coefficient of friction may be unstable due to foreign matter and abrasion. Therefore, it is preferable to set the wrapping angle between the belt tensioning member 4 and the heat-resistant belt 3 to be smaller than the wrapping angle between the pressure roller 2 and the heat-resistant belt 3 and to set the diameter of the belt tensioning member 4 to be smaller than the diameter of the pressure roller 2. According to this setting, the length in which the heat-resistant belt 3 slides along the periphery of the belt tensioning member 4 becomes short, thereby avoiding factors contributing to unsteadiness due to changes with time and disturbance and thus achieving the stable driving of the heat-resistant belt 3 by the pressure roller 2.

The cleaning member 6 is arranged between the pressure roller 2 and the belt tensioning member 4 and slides along the inner periphery of the heat-resistant belt 3 to clean foreign matter and abrasion powder on the inner periphery of the heat-resistant belt 3. By cleaning the foreign matter and abrasion powder, the heat-resistant belt 3 is refreshed, thereby avoiding factors contributing to unsteadiness. A concave portion formed in the belt tensioning member 4 is suitable for collecting removed foreign matter and abrasion powder.

The sheet medium 5 passes between the heat-resistant belt 3 and the fuser roller 1 from the start position of the nip at which the belt tensioning member 4 is pressed lightly on the fuser roller 1, whereby an unfixed toner image 5*a* on the sheet medium 5 is fixed. After that, the sheet medium 5 is ejected in the tangential direction L of the pressed portion from the end position of the nip at which the pressure roller 2 is pressed against the fuser roller 1. The nip has the start position and the end position formed according to the tangential state of a fuser roller 1.

Figure 2:
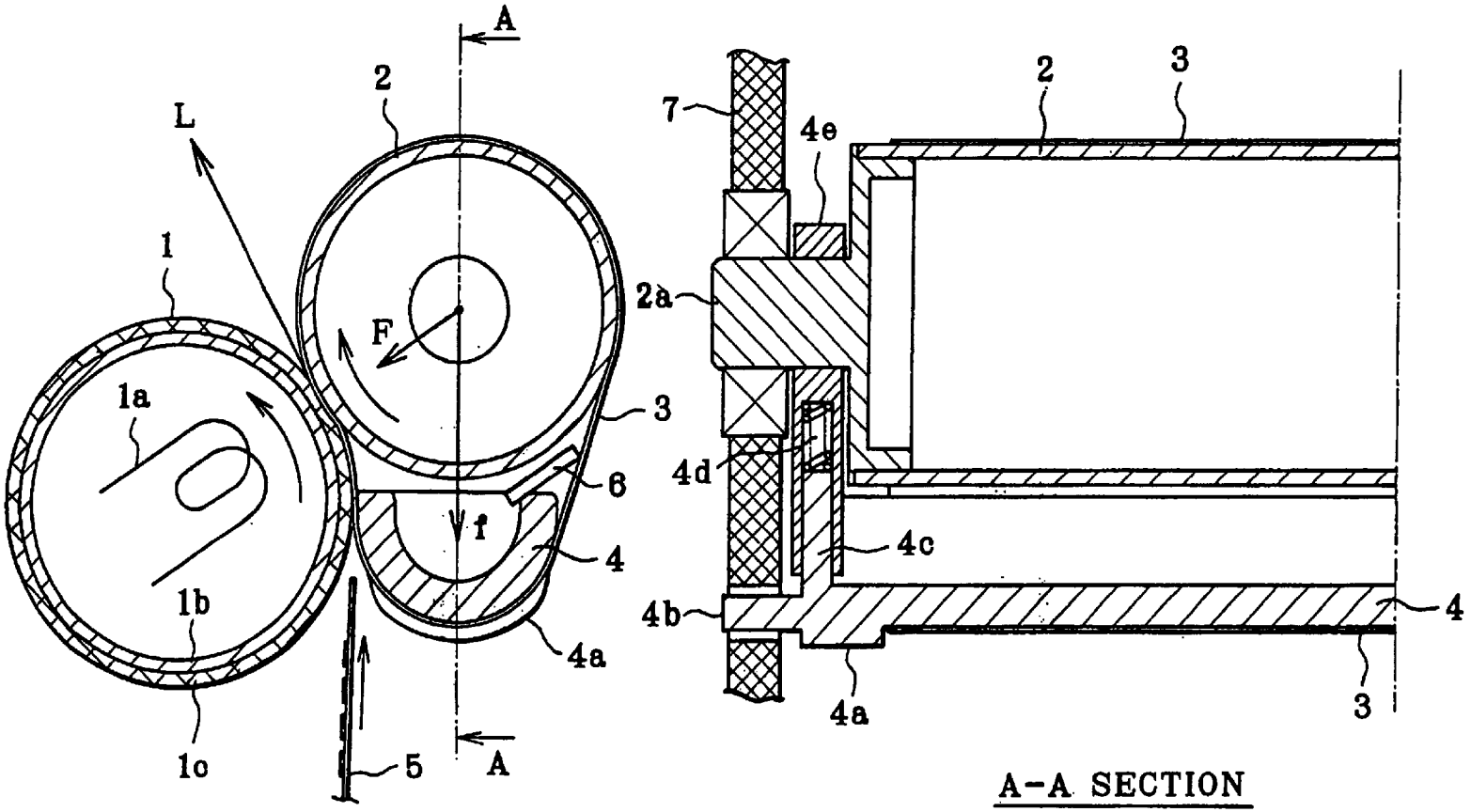
FIG. 2 is an illustration showing the supporting mechanism for a belt tensioning member for applying tension on a heat-resistant belt.

FIG. 2 is an illustration showing the supporting mechanism for the belt tensioning member 4 for applying tension on a heat-resistant bell As shown in FIG. 2, the supporting mechanism for the belt tensioning member 4 comprises a projection 4*b* extending in parallel with the axial direction of the pressure roller 2 from the end of the belt tensioning member 4, a projection 4*c* extending toward the rotary shaft 2*a* of the pressure roller 2, and a supporting member 4*e* which is rotatably supported by the rotary shaft 2*a* of the pressure roller 2. The projection 4*b* is inserted into an engaging hole of a mounting fame 7 and the projection 4*c* is inserted into a groove of the supporting member 4*e* and is biased by a spring 4*d* to apply tension. The engagement between the projection 4*b* and the engaging hole of the mounting frame 7 is designed to allow the movement in the tensioning direction "f" in which the spring 4*d* applies tension and not to allow the movement in a direction of getting closer to and away from the fuser roller 1. The tensioning direction "f" may be set to incline relative to a line A—A, shown in FIG. 2, connecting the axes of the pressure roller 2 and the belt tensioning member 4 by the groove in a direction getting closer to or away from the fuser roller 1.

Since a heat-resistant belt sliding member is used as the belt tensioning member 4, bearings are not required because the heat-resistant belt sliding member is not a rotatable member. Therefore, the supporting structure can be simple. Since the belt tensioning member 4 is formed into a semilunar shape, the belt tensioning member 4 is disposed such that the subtense of the semilunar shape faces the pressure roller 2, thereby enabling such an arrangement that the belt tensioning member 4 is positioned close to the pressure roller 2 to the utmost limit. This also enables the reduction in peripheral length of the heat-resistant belt 3. Therefore, the fixing device of fuser roller type can be manufactured to have simple structure and small size at low cost.

Since the heat-resistant belt 3 travels the minimum path, the heat-resistant belt 3 is heated at the nip by the rotatable fuser roller 1 having the built-in heat source and the heat energy drawn during the traveling along a predetermined path can be minimized. In addition, since the peripheral length is short, the temperature drop due to natural heat release can be reduced, thereby shortening the required warm-up time from a time point at which the power is ON to a time point at which fixing is enabled.

Figure 3:
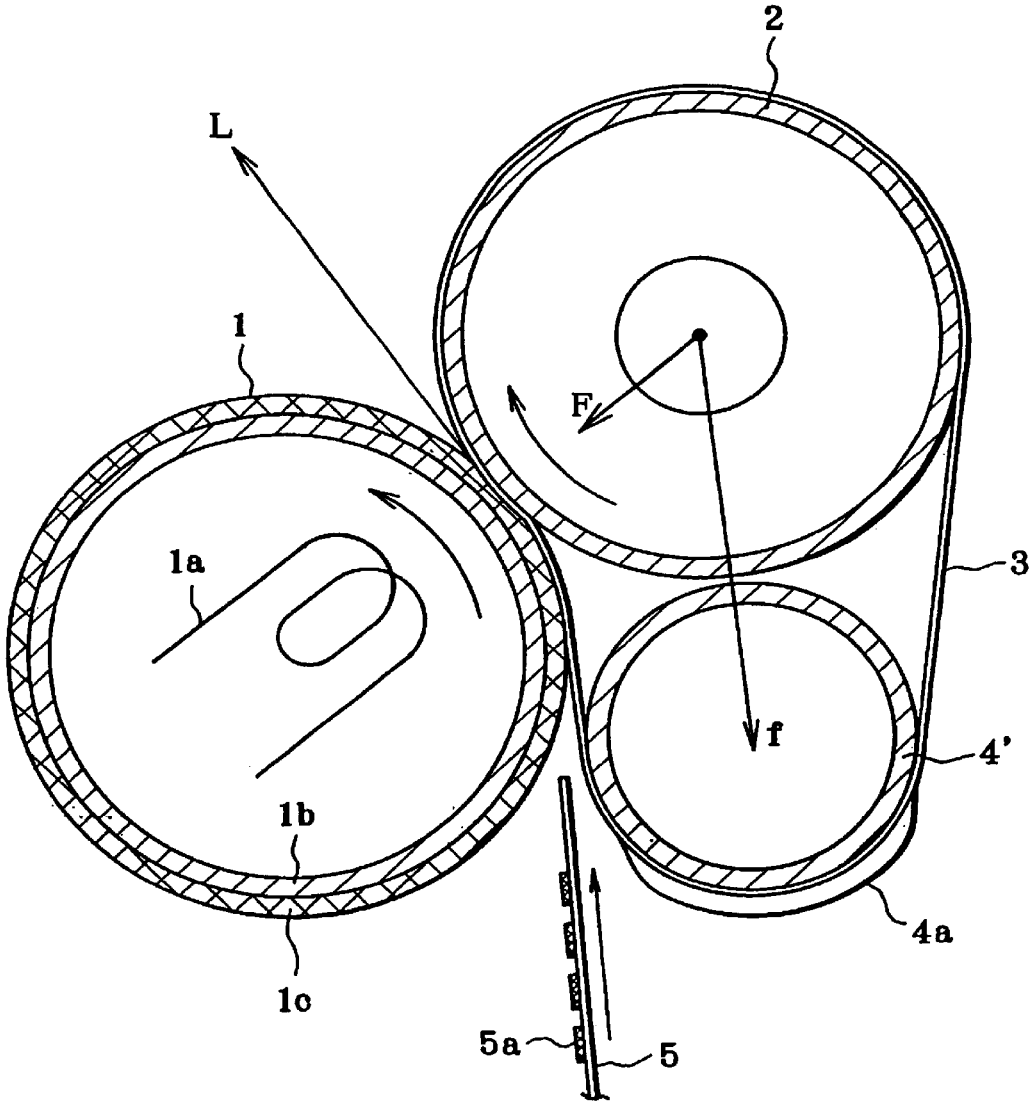
FIG. 3 is an illustration showing another embodiment of a fixing device according to the present invention.
Figure 4A:
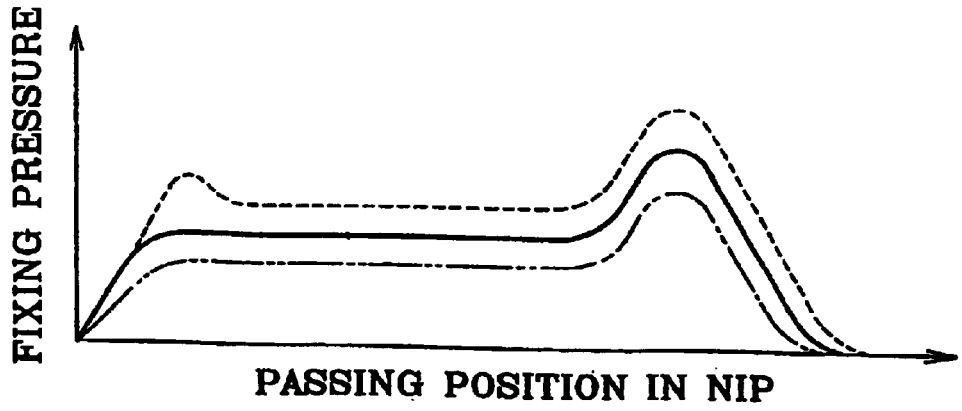
FIGS. 4(*a*)–4(*c*) are graphs showing examples of fixing pressure which varies according to the passing position in a nip.
Figure 4B:
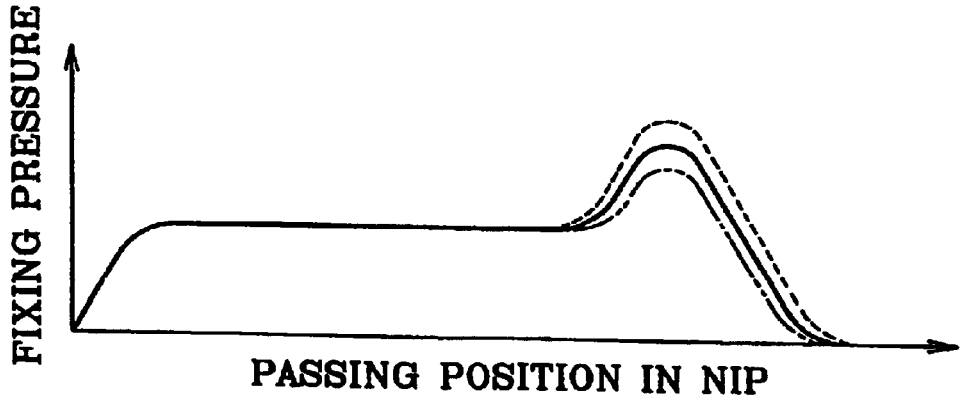
Figure 4C:
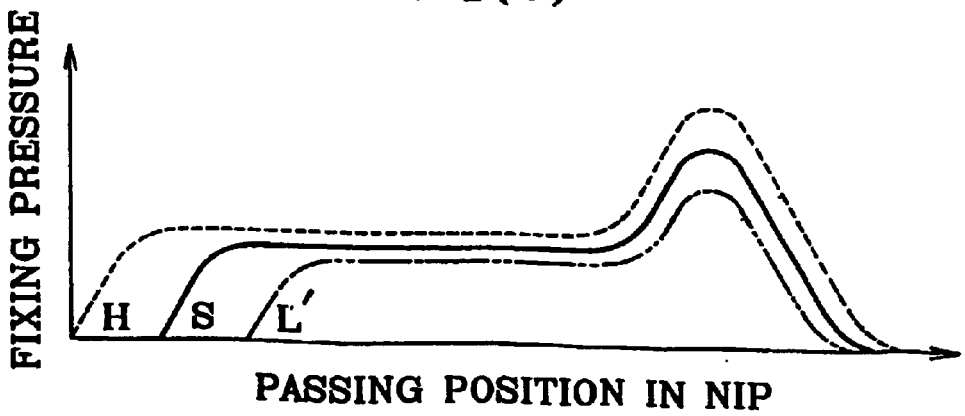

FIG. 3 is an illustration showing another embodiment of a fixing device according to the present invention. FIGS. 4(*a*)–4(*c*) are graphs showing examples of fixing pressure which varies according to the passing position in the nip. Though the semilunar heat-resistant belt sliding member is used as the belt tensioning member 4 in the embodiment shown in FIG. 1 and FIG. 2, a roller member may be used as the belt tensioning member 4' as shown in FIG. 3. Since the belt tensioning member 4' is a roller member, the belt tensioning member 4' may be not only a sliding member but also a rotatable member. As the belt tensioning member 4' is rotatably supported, the coefficient of friction between the pressure roller 2 and the heat-resistant belt 3 is set to be larger than the coefficient of friction between the belt tensioning member 4' and the heat-resistant belt 3 so that the heat-resistant belt 3 can be stably driven by the pressure roller 2 white being tensioned by the pressure roller 2 and the belt tensioning member 4.

In the embodiment shown in FIG. 3, the belt tensioning member 4' is not lightly pressed against the fuser roller 1, but is spaced apart from the fuser roller 1. That is, the belt tensioning member 4' is positioned at the upstream side in the traveling direction of the beat-resistant belt 3 relative to the start position of the nip. Therefore, in this case, the nip length can be lengthened by shifting the position of the belt tensioning member 4' toward the fuser roller 1 to shift the start position of the nip to the upstream side. On the other hand, the nip length can be shortened by shifting the position of the belt tensioning member 4' away from the fuser roller 1.

It should be understood that, also in the embodiment shown in FIG. 1, FIG. 2, the belt tensioning member 4 may be arranged to be spaced apart from the fuser roller 1 and that, in the embodiment shown in FIG. 3, the belt tensioning member 4' may be arranged to be lightly pressed against the fuser roller 1. In case that the belt tensioning member 4' is arranged to be spaced apart from the fuser roller 1, the fixing pressure is constant from the start position of the nip and is increased by the pressure roller 2 at the end position of the nip.

In case that the belt tensioning member 4, 4' is slid upon the heat-resistant belt 3 by the rotation of the pressure roller 2, the belt tensioning member 4, 4' may be supported to freely swing in a direction getting closer to or away from the fuser roller 1. As the belt tensioning member 4, 4' is designed to freely swing, the heat-resistant belt 3 and the belt tensioning member 4, 4' are positioned in a state that swinging force created by a frictional force between the heat-resistant belt 3 and the belt tensioning member 4, 4' by the rotation of the pressure roller 2 and pressing force of the heat-resistant belt 3 against the fuser roller 1 are balanced.

That is, regardless of when a sheet medium 5 with an unfixed toner image 5*a* passes between the fuser roller 1 and the heat-resistant belt 3 and when no sheet medium 5 passes between the fuser roller 1 and the heat-resistant belt 3 and regardless of thickness of the sheet medium 5, the pressing force between the heat-resistant belt 3 and the fuser roller 1 is constant so that the stress on the passing sheet medium 5 can be constant. Accordingly, the sheet medium 5 ejected after the unfixed toner image 5*a* is fixed has no deformation such as wrinkles. By setting the frictional force between the heat-resistant belt 3 and the belt tensioning member 4, 4', suitable pressing force can be obtained between the heat-resistant belt 3 and the fuser roller 1.

Profiles of variations in fixing pressure relative to the passing position in the nip corresponding to the aforementioned structure are shown in FIGS. 4(*a*)–4(*c*). FIG. 4(*a*) shows profiles of variations in fixing pressure for a sheet medium having a larger thickness (dotted line), for a sheet medium having a standard thickness (solid line), and for a sheet medium having a smaller thickness (chain double-dashed line) when the belt tensioning member 4, 4' is fixed. In this case, the fixing pressure is increased at the start position of the nip in case of the sheet medium having a larger thickness. On the whole, the fixing pressure differs depending on the thickness of the sheet medium. FIG. 4(*b*) shows variations in fixing pressure for a sheet medium having a larger thickness (dotted line), for a sheet medium having a standard thickness (solid line), and for a sheet medium having a smaller thickness (chain double-dashed line) when the belt tensioning member 4, 4' is designed to freely swing. In this case, the fixing pressures are the same regardless of the thickness of the sheet medium. FIG. 4(*c*) shows variations in fixing pressure for a sheet medium having a larger thickness (dotted line), for a sheet medium having a standard thickness (solid line), and for a sheet medium having a smaller thickness (chain double-dashed line) when the position of the belt tensioning member 4, 4' is designed such that its position can be changed. In this case, the start position of the nip can be changed. Though there are differences in fixing pressure, the differences are therefore so small. As described above, according to the kind of sheet media, there are differences in fixing pressure. By changing the position of the belt tensioning member 4, 4' to change the nip length, the fixing pressure can be adjusted.

The surface of the elastic member 1*c* of the fuser roller 1 and the surface of the heat-resistant belt 3 move at the same peripheral velocity to fix the unfixed toner image 5*a* formed on the sheet medium 5. If the surface of the heat-resistant belt 3 or a tip portion of the sheet medium 5 is waved, the start of fixing may be unstable. For this, by designing the heat-resistant belt 3 to be lightly pressed against the fuser roller 1 at the start position of the nip, the point where the sheet medium 5 meets the heat-resistant belt 3 is stabilized, thereby enabling excellent stable fixing of the unfixed toner image. The heat-resistant belt 3 is tensioned by the cooperation between the pressure roller 2 and the belt tensioning member 4, 4' and is wrapped around the fuser roller 1 to form the nip, thereby easily achieving the structure having a longer nip length, simplifying the structure, and reducing the size and the cost.

Figure 5:
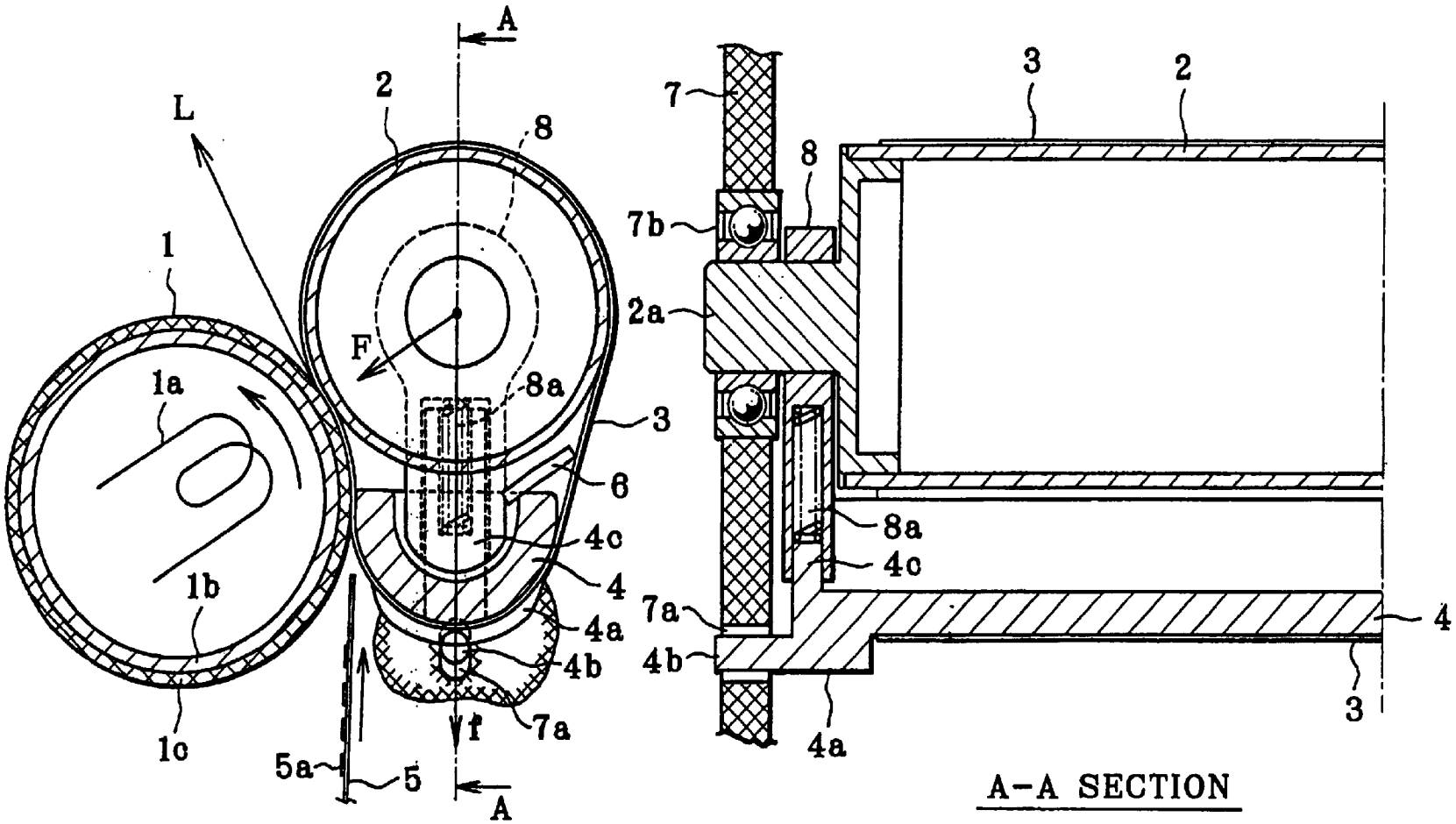
FIG. 5 is an illustration showing an embodiment of a fixing device according to the present invention.
Figure 6:
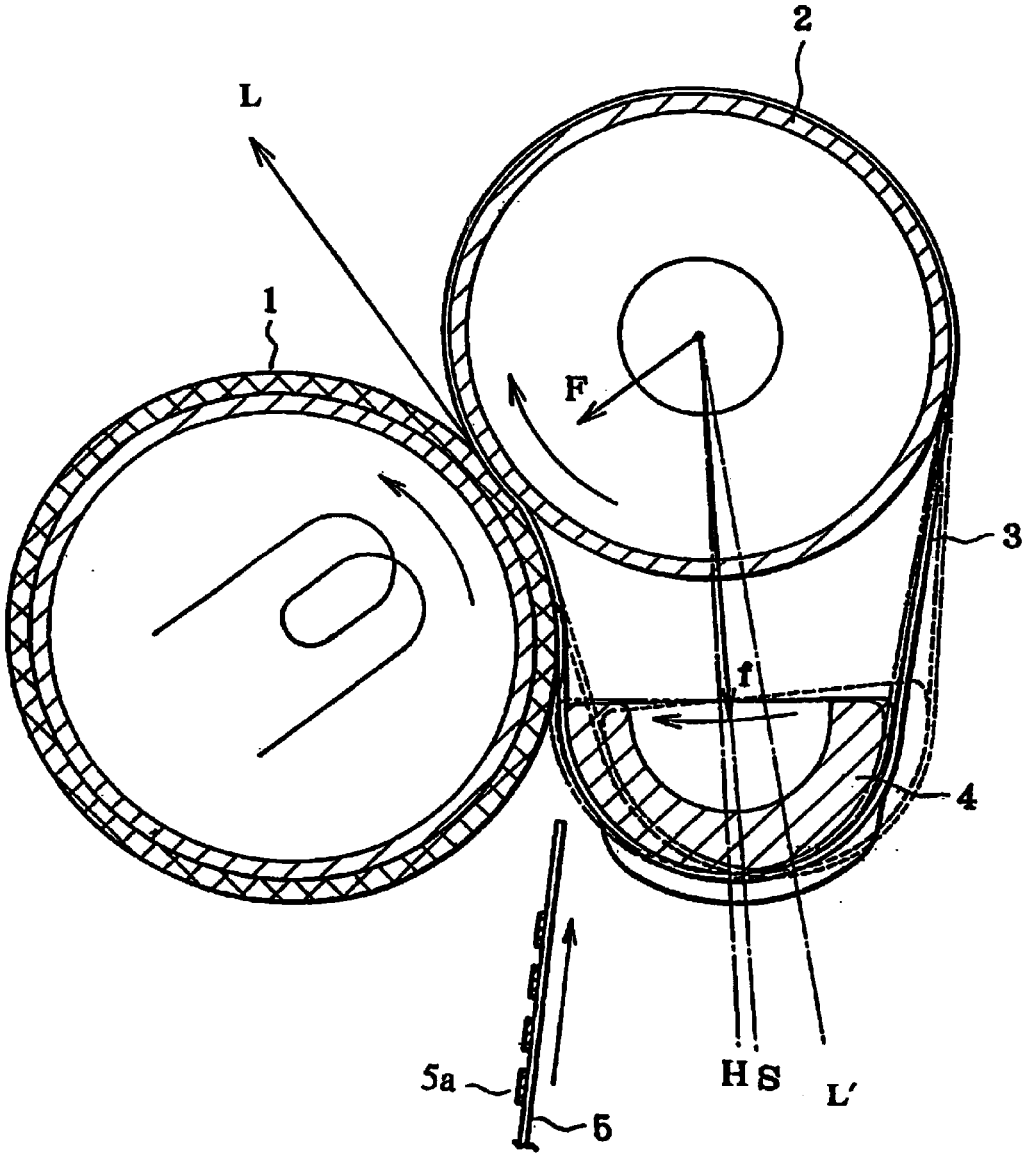
FIG. 6 is an illustration for explaining the relation between the position of a tensioning member and a nip area.
Figure 7A:
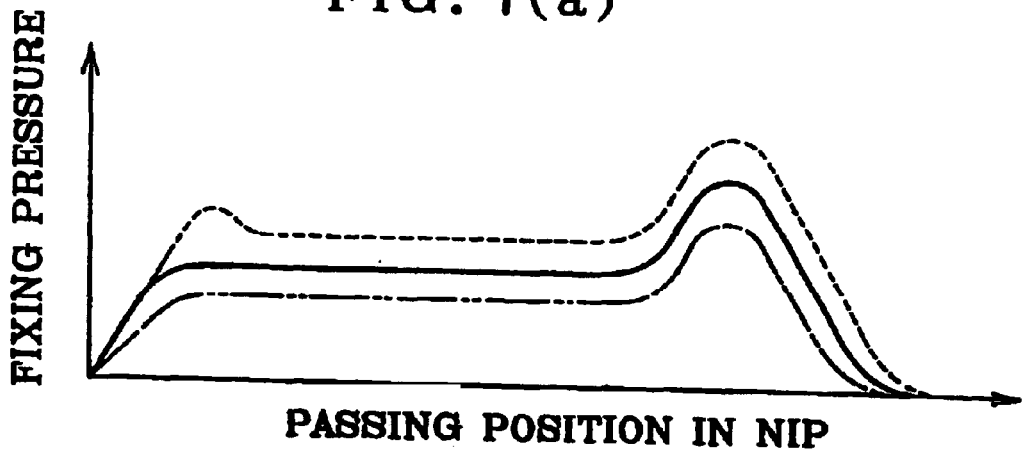
FIGS. 7(*a*)–7(*c*) are graphs showing the passing position in the nip and variations in fixing pressure.
Figure 7B:
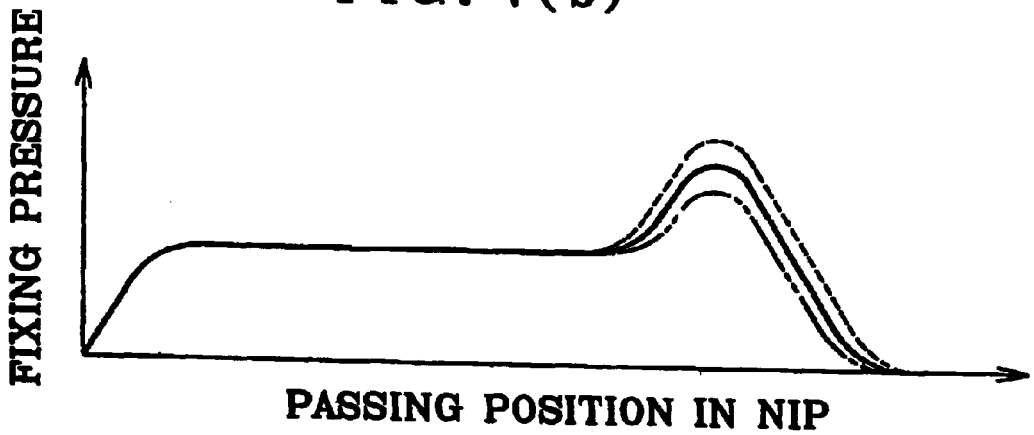
Figure 7C:
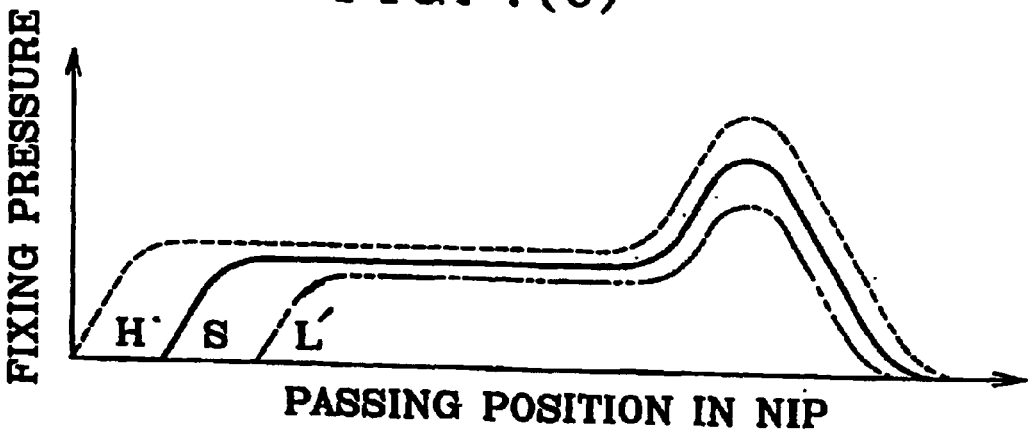

FIG. 5 is an illustration showing another embodiment of a fixing device according to the present invention, FIG. 6 is an illustration for explaining the relation between the position of a belt tensioning member 4 and a nip area, FIGS. 7(*a*)–7(*c*) are graphs showing the passing position in the nip and variations in fixing pressure. In the drawings, numeral 7 designates a frame, 7*a* designates a guide hole, 7*b* is a bearing, 8 designates a tension supporting member, 8*a* designates a tensioning spring, and L designates a tangent to pressed portion.

In FIG. 5, the fuser roller 1 is formed by using a pipe having an outer diameter of 60 mm or less and a thickness of 2 mm or less as a roller substrate 1*b* and coating the outer periphery of the pipe with an elastic member 1*c* of a thickness of 2 mm or less. The fuser roller 1 has a built-in halogen lamp 1*a* inside the roller substrate 1*b* as a heat source and is designed to be rotatable. The pressure roller 2 is formed by using a pipe having an outer diameter of 60 mm or less and a thickness of 2 mm or less. The pressure roller 2 is arranged to face the fuser roller 1 such that a rotary shaft 2*a* thereof is supported rotatably by bearings 7*b* to a frame 7 and the pressure roller 2 is in contact with the fuser roller 1 with a predetermined pressure F through the heat-resistant-belt 3.

The heat-resistant belt 3 is an endless belt which is composed of a metal tube such as a stainless steel tube or a nickel electroforming tube or a resin tube made of a heat-resistant resin such as polyimide or silicone having a thickness of 0.03 mm or more. The heat-resistant belt 3 is wound around the outer periphery of the pressure roller 2 and is laid between the pressure roller 2 and the belt tensioning member 4 with certain tension. The heat-resistant belt 3 is sandwiched between the fuser roller 1 and the pressure roller 2 to form a nip between the heat-resistant belt 3 and the fuser roller 1.

A belt tensioning member 4 is, for example, a semilunar belt sliding member which is arranged inside the heat-resistant belt 3 to cooperate with the pressure roller 2 to apply tension "f" to the heat-resistant belt 3 and is arranged at such a position as to wrap the heat-resistant belt 3 around the fuser roller 1 partially for forming a nip. That is, the belt tensioning member 4 is arranged at such a position that the heat-resistant belt 3 is wrapped around the fuser roller 1 beyond the tangent L to the pressed portion between the fuser roller and the pressure roller 2. A convexity(-ies) 4*a* is disposed at one end or both ends of the belt tensioning member 4 such that the heat-resistant belt 3 when shifting sideward collides with the convexity 4*a*, thereby limiting the lateral shift of the heat-resistant belt 3. The belt tensioning member 4 is provided at both ends thereof with guide portions 4*b* and tensioning portions 4*c* to tension the heat-resistant belt 3 from the inside of the heat-resistant belt 3. For example, each guide portion 4*b* projects like a pin to extend in parallel with the rotary shaft 2*a* and is inserted in a guide hole 7*a* of the frame 7 so that the guide portion 4*b* is fitted to the guide hole 7*a* slidably. Each tensioning portion 4*c* extends toward the inside of the heat-resistant belt 3, i.e. toward the pressure roller 2 and is biased by a tensioning spring in a direction of getting away from the pressure roller 2.

The frame 7 is a member having the bearings 7*b* and the guide holes 7*a* for mounting and supporting the fixing device. By the bearings 7*b*, the rotary shaft 2*a* of the pressure roller 2 is rotatably supported. By the guide holes 7*a*, the belt tensioning member 4 is guided. The tension supporting member 8 is supported to the rotary shaft 2*a* of the pressure roller 2 so that the rotary shaft 2*a* penetrates the tension supporting member 8 in such a manner that the tension supporting member 8 is slidable and rotatable. The tension supporting member 8 is provided with a hole in which the tensioning spring 8*a* is accommodated. While the belt tensioning member 4 is located within the inner periphery of the heat-resistant belt 3, each guide portion 4*b* is guided by the guide hole 7*a* of the frame 7 and each tensioning portion 4*c* is inserted into the hole of the tension supporting member 8 and is biased by the tensioning spring 8*a* in a direction getting away from the rotary shaft 2*a* of the pressure roller 2 so that the tension "f" is applied.

A cleaning member 6 is arranged between the pressure roller 2 and the belt tensioning member 4 and slides along the inner periphery of the heat-resistant belt 3 to clean foreign matter and abrasion powder on the inner periphery of the heat-resistant belt 3. By cleaning the foreign matter and abrasion powder, the heat-resistant belt 3 is refreshed, thereby avoiding factors contributing to unsteadiness. A concave portion may be formed in the semilunar belt tensioning member 4 as shown in FIG. 5 for collecting removed foreign matter and abrasion powder therein.

A sheet medium 5 passes between the heat-resistant belt 3 and the fuser roller 1, whereby an unfixed toner image 5*a* on the sheet medium 5 is fixed. After that, the sheet medium 5 is ejected in the tangential direction L of the pressed portion from the end position of the nip at which the pressure roller 2 is pressed against the fuser roller 1. The nip has the start position and the end position formed according to the tangential state of the fuser roller 1. In addition, since the belt tensioning member 4 is arranged at such a position that the heat-resistant belt 3 is wrapped around the fuser roller 1 beyond the tangent L to the pressed portion between the fuser roller 1 and the pressure roller 2 so as to have a longer nip length, enough nip should be obtained so that the unfixed toner image 5*a* can be sufficiently heated and fused even without large pressure.

As shown in FIG. 5, in the fixing device according to the present invention, the belt tensioning member 4 for tensioning the heat-resistant belt 3 is arranged at such a position, relative to the pressure roller 2 pressing the fuser roller 1 with pressure F, that the heat-resistant belt 3 is wrapped around the fuser roller 1 beyond the tangent L to the pressed portion between the fuser roller 1 and the pressure roller 2. The position is determined by the guide holes 7*a* of the frame 7. Each guide hole 7*a* is formed in an flat oval shape elongated in the outward direction from the bearing 7*b* supporting the rotary shaft 2*a* of the pressure roller 2, thereby preventing the movement in a direction of getting closer to and away from the fuser roller 1. On the other hand, the tensioning portion 4*c* is inserted into the groove of the tension supporting member 8 and is biased by the tensioning spring 8*a* accommodated in the groove in the radial direction from the rotary shaft 2*a* of the pressure roller 2 as the center. The direction of applying tension "f" is defined according to the orientation of the flat oval to extend on a line A—A, shown in FIG. 5, connecting the axes of the pressure roller 2 and the belt tensioning member 4. The direction of applying tension "f' may be set to incline relative to the line A—A in a direction getting closer to or away from the fuser roller 1.

For stably driving the heat-resistant belt 3 by the pressure roller 2 while the heat-resistant belt 3 is tensioned by the pressure roller 2 and the belt tensioning member 4, it is preferable to set the coefficient of friction between the pressure roller 2 and the heat-resistant belt 3 to be larger than the coefficient of friction between the belt tensioning member 4 and the heat-resistant belt 3. However, the coefficient of friction may be unstable due to foreign matter and abrasion. Therefore, it is preferable to set the wrapping angle between the belt tensioning member 4 and the heat-resistant belt 3 to be smaller than the wrapping angle between the pressure roller 2 and the heat-resistant belt 3 and to set the diameter of the belt tensioning member 4 to be smaller than the diameter of the pressure roller 2. According to this setting, the length in which the beat-resistant belt 3 slides along the periphery of the belt tensioning member 4 becomes short, thereby avoiding factors contributing to unsteadiness due to changes with time and disturbance and thus achieving the stable driving of the heat-resistant belt 3 by the pressure roller 2.

In the fixing device according to the present invention, since the heat-resistant belt 3 is wrapped around the fuser roller 1 beyond the tangent L to the pressed portion between the fuser roller 1 and the pressure roller 2 by setting the position of the belt tensioning member 4 for tensioning the heat-resistant belt 3, the nip length can be freely changed by changing the position of the belt tensioning member 4 as shown in FIG. 6. For example, as the belt tensioning member 4 is moved from the position shown by solid lines in FIG. 6 in a direction apart from the fuser roller 1 so that the belt tensioning member 4 is arranged at the position shown by dotted lines along a line L', the angle of wrapping the heat-resistant belt 3 around the fuser roller 1 becomes smaller, thus shortening the nip length. On the other hand, as the belt tensioning member 4 is moved in a direction toward the fuser roller 1 so that the belt tensioning member 4 is arranged at the position shown by chain double-dashed lines along a line H that the belt tensioning member 4 is lightly pressed against the fuser roller 1, the angle of wrapping the heat-resistant belt 3 around the fuser roller 1 becomes larger, thus lengthening the nip length.

The sheet medium 5 passes between the heat-resistant belt 3 and the fuser roller 1 from the start position of tile nip at which the belt tensioning member 4 is pressed lightly on the fuser roller 1, whereby an unfixed toner image 5*a* on the sheet medium 5 is fixed. After that, the sheet medium 5 is ejected in the tangential direction L of the pressed portion from the end position of the nip at which the pressure roller 2 is pressed against the fuser roller 1. The nip has the start position and the end position formed according to the tangential state of the fuser roller 1. As the desired nip length can be obtained, the fixing is stared from the start position of the nip with a constant fixing pressure and enough nip should be obtained without losing process speed, thereby lengthening the time of fusing the toner. At the end position of the nip, a desired pressure is applied relative to the fuser roller 1 by the pressure roller 2 via the heat-resistant belt 3, thereby making the toner surface flat and smooth. Therefore, improved fixing can be achieved while eliminating the deformation of the sheet medium 5.

In case that the belt tensioning member 4 is slid upon the heat-resistant belt 3 by the rotation of the pressure roller 2, the belt tensioning member 4 may be supported to freely swing in a direction getting closer to or away from the fuser roller 1. As the belt tensioning member 4 is designed to freely swing, the heat-resistant belt 3 and the belt tensioning member 4 are positioned in a state that swinging force created by a frictional force between the heat-resistant belt 3 and the belt tensioning member 4 by the rotation of the pressure roller 2 and pressing force of the heat-resistant belt 3 against the fuser roller 1 are balanced.

That is, regardless of when a sheet medium 5 with an unfixed toner image 5*a* passes between the fuser roller 1 and the heat-resistant belt 3 and when no sheet medium 5 passes between the fuser roller 1 and the heat-resistant belt 3 and regardless of thickness of the sheet medium 5, the pressing force between the heat-resistant belt 3 and the fuser roller 1 is constant so that the stress on the passing sheet medium 5 can be constant Accordingly, the sheet medium 5 ejected after the unfixed toner image 5*a* is fixed has no deformation such as wrinkles. Further, since the heat-resistant belt 3 is wrapped around the fuser roller 1 according to the position of the belt tensioning member 4, the pressing force is changed according to the frictional force between the heat-resistant belt 3 and the belt tensioning member 4 so that suitable pressing force can be obtained between the heat-resistant belt 3 and the fuser roller 1 by setting the frictional force.

According to the kind of sheet media, there are differences in fixing pressure. By changing the position of the belt tensioning member 4 to change the nip length, the fixing pressure can be adjusted. For example, in FIG. 6, as the position of the belt tensioning member 4 is set to a position apart from the fuser roller 1, i.e. non-contact position, the angle of wrapping the heat-resistant belt 3 around the fuser roller 1 becomes smaller and the length of the nip is shortened On the other hand, as the position of the belt tensioning member 4 is set to a position apart from the pressure roller 2 (downwardly in FIG. 6) and further closer to the fuser roller 1, the angle of wrapping the heat-resistant belt 3 around the fuser roller 1 becomes smaller and the length of the nip is shortened. In the state shown in FIG. 6, the belt tensioning member 4 is lightly pressed against the fuser roller 1.

Especially, in case of fixing color toner images on a sheet medium having a larger thickness such as an OHP sheet, if color toners are not sufficiently used and fixed, a projected color image of the image on the sheet medium is not reproduced with desired colors even when the sheet medium seems to have the desired colors when directly seen. To fix color images without such defect, it is required to increase the pressure during fixing or lengthen the time for heating and fusing toner. However, when the fixing pressure is too large, the sheet medium is easily deformed to have wrinkles or curl. As the fixing process speed is lowered for lengthening the time for heating and fusing toner, throughput for forming an image drops. This is because the fixing process is the final process. Therefore, as the fixing process is lowered, all processes before the fixing process must be lowered.

In this embodiment, anyway, the belt tensioning member 4 is arranged at such a position that the heat-resistant belt 3 is wrapped around the fuser roller 1. Therefore, according to this arrangement, a desired nip can be obtained without losing process speed and enough time for heating and fusing toner can be ensured, thereby achieving a fixing device with simple structure and smaller size. In addition, since the desired nip is ensured only by applying a suitable pressure required to make the toner surface on the sheet flat and smooth in the pressure roller 2 pressing the fuser roller 1, not by increasing the deformation at the pressed portion by a larger pressure like the conventional device, the deformation such as wrinkles in the fixing process can be prevented.

FIG. 7(*a*) shows profiles of variations in fixing pressure for a sheet medium having a larger thickness (dotted line), for a sheet medium having a standard thickness (solid line), and for a sheet medium having a smaller thickness (chain double-dashed line) when the belt tensioning member 4 is fixed. In this case, the fixing pressure is increased at the start position of the nip in case of the sheet medium having a larger thickness. On the whole, the fixing pressure differs depending on the thickness of the sheet medium. When the belt tensioning member 4 is arranged at a position where it is not in contact with the fuser roller 1, i.e. is spaced apart form the fuser roller 1, the fixing pressure is constant from the start position of the nip and is increased by the pressure roller 2 at the end position of the nip. FIG. 7(*b*) shows variations in fixing pressure for a sheet medium having a larger thickness (dotted line), for a sheet medium having a standard thickness (solid line), and for a sheet medium having a smaller thickness (chain double-dashed line) when the belt tensioning member 4 is designed to freely swing. In this case, the fixing pressures are the same regardless of the thickness of the sheet medium. FIG. 7(*c*) shows variations in fixing pressure for a sheet medium having a larger thickness (dotted line), for a sheet medium having a standard thickness (solid line), and for a sheet medium having a smaller thickness (chain double-dashed line) when the position of the belt tensioning member 4 is changed to change the angle of wrapping of the heat-resistant belt 3 around the fuser roller 1 (change the nip area). In this case, the start position of the nip can be changed. Though there are differences in fixing pressure, the differences are therefore so small.

Figure 8:
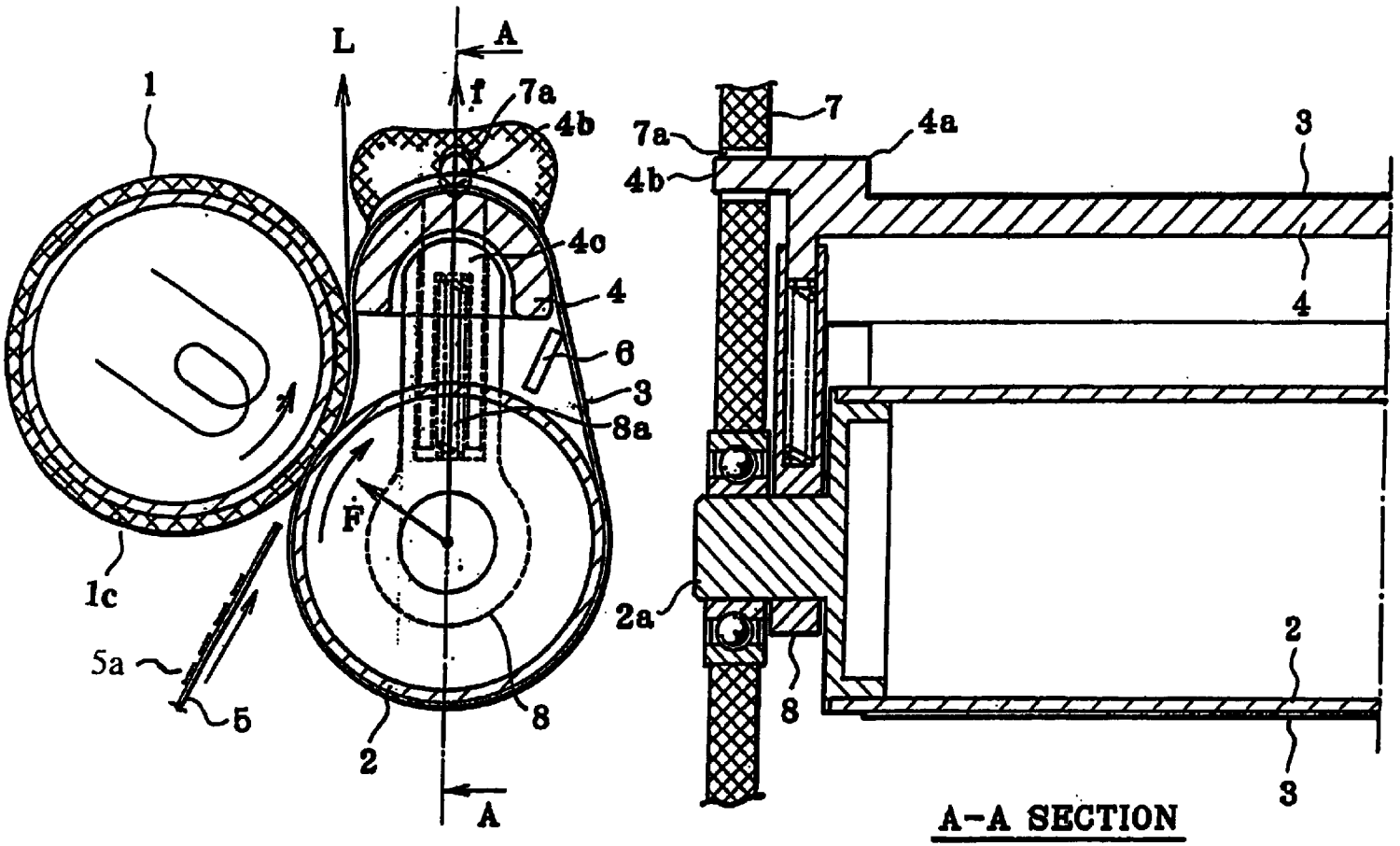
FIG. 8 is an illustration showing another embodiment of a fixing device according to the present invention in which a tensioning member is arranged on the downstream side in the traveling direction of a belt.
Figure 9A:
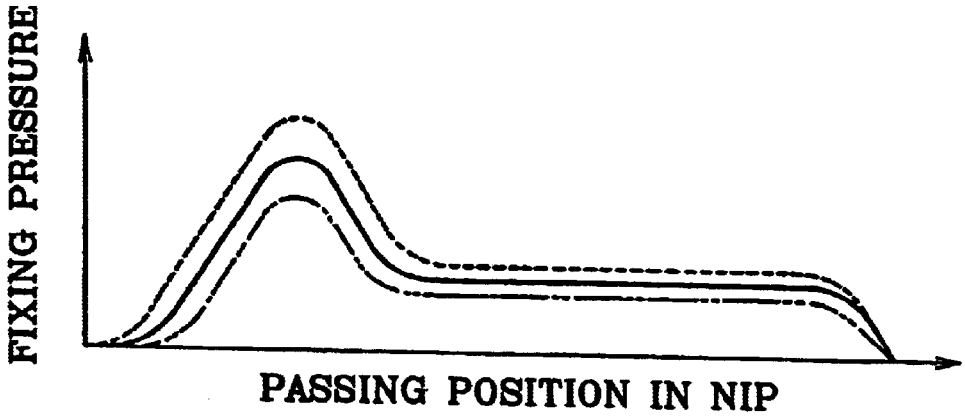
FIGS. 9(*a*), 9(*b*) are graphs showing the passing position in the nip and variations in fixing pressure of the fixing device in which the tensioning member is arranged on the downstream side in the traveling direction of the belt.
Figure 9B:
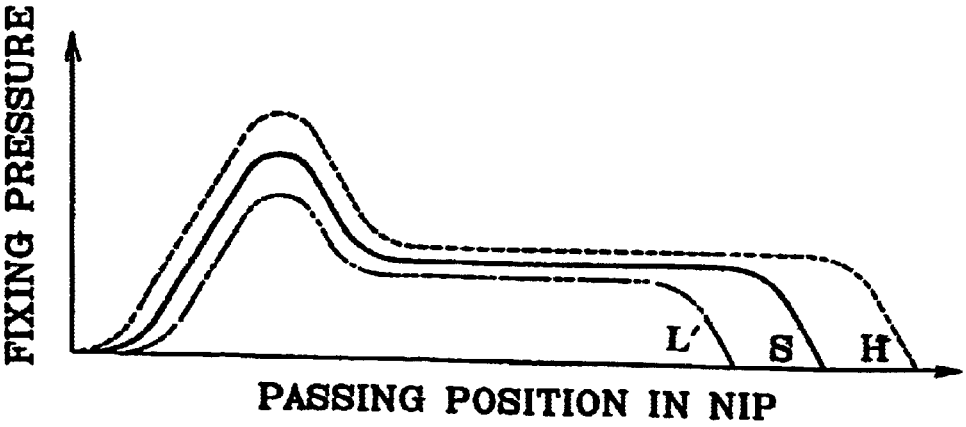
Figure 10:
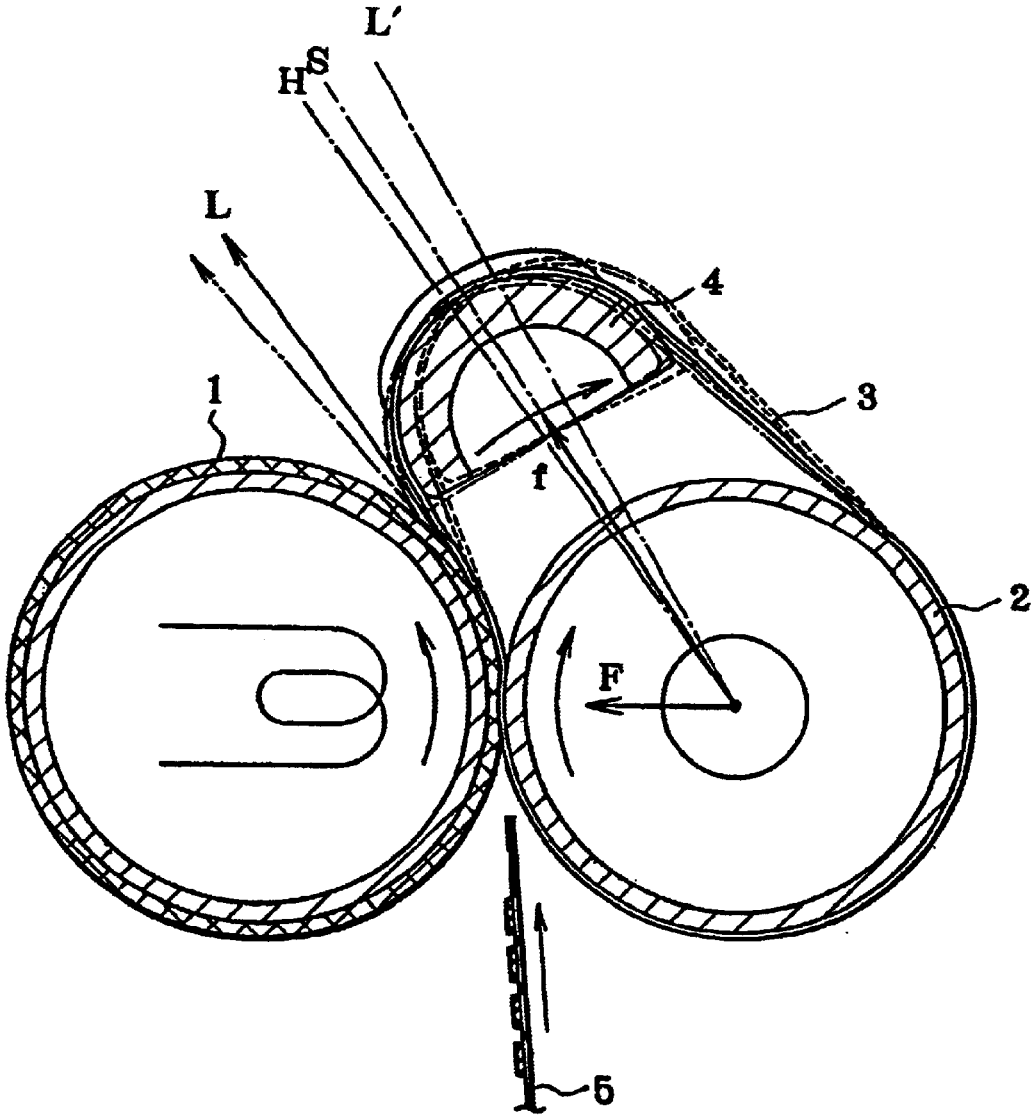
FIG. 10 is an illustration for explaining the relation between the downstream position of the tensioning member and the nip area.

FIG. 8 is an illustration showing another embodiment of a fixing device according to the present invention in which a belt tensioning member 4 is arranged on the downstream side in the traveling direction of a heat-resistant belt, FIGS. 9(*a*), 9(*b*) are graphs showing the passing position in the nip and variations in fixing pressure of the fixing device in which the belt 3 tensioning member 4 is arranged on the downstream side in the traveling direction of the heat-resistant belt 3, and FIG. 10 is an illustration for explaining the relation between the downstream position of the belt tensioning member 4 and the nip area.

Though the belt tensioning member 4 is arranged on the upstream side in the traveling direction of the heat-resistant belt 3 in the aforementioned embodiments, the belt tensioning member 4 is arranged on the downstream side in the traveling direction of the heat-resistant belt 3 in the embodiment of FIG. 8. The surface of an elastic member 1*c* of a fuser roller 1 and the surface of the heat-resistant belt 3 move at the same peripheral velocity to fix an unfixed toner image 5*a* formed on a sheet medium 5. If the surface of the heat-resistant belt 3 or a tip portion of the sheet medium 5 is waved, the start of fixing may be unstable. In this embodiment, a pressure roller 2 is designed to press against the fuser roller 1 via the heat-resistant belt 3 at the start position of the nip. Therefore, even when the surface of the heat-resistant belt 3 or the tip portion of the sheet medium 5 is waved, the point where the sheet medium 5 meets the heat-resistant belt 3 is stabilized, thereby enabling excellent stable fixing of the unfixed toner image 5*a*.

Profiles of variations in fixing pressure relative to the passing position in the nip corresponding to the aforementioned structure are shown in FIGS. 9(*a*), 9(*b*). FIG. 9(*a*) shows profiles of variations in fixing pressure for a shot medium having a larger thickness (dotted line), for a sheet medium having a standard thickness (solid line), and for a sheet medium having a smaller thickness (chain double-dashed line) when the belt tensioning member 4 is fixed. In this case, on the whole, the fixing pressure differs a little depending on the thickness of the sheet medium. When the belt tensioning member 4 is lightly pressed, the fixing pressure rises at the end position of the nip in case of the sheet medium having a larger thickness. However, when the belt tensioning member 4 is spaced apart from the fuser roller 1 to have a tangential nip, there is no rise at the end position of the nip as shown in FIG. 9(*a*). FIG. 9(*b*) shows variations in fixing pressure when the belt tensioning member 4 is designed such that its position can be changed, in which the position of the belt tensioning member 4 is changed as shown in FIG. 10 depending on the sheet medium, for example, a sheet medium having a larger thickness (dotted line), a sheet medium having a standard thickness (solid line), and a sheet medium having a smaller thickness (chain double-dashed line). In this case, the end position of the nip can be changed. Though there are differences in fixing pressure, the differences are therefore so small.

In the embodiments mentioned above, bearings are not required because the belt sliding member is used as the belt tensioning member 4 and is not a rotatable member. Therefore, the supporting structure can be simple. Since the belt tensioning member 4 is formed into a semilunar shape, the belt tensioning member 4' is disposed such that the subtense of the semilunar shape faces the pressure roller 2, thereby enabling such an arrangement that the belt tensioning member 4 is positioned close to the pressure roller 2 to the utmost limit. This also enables the reduction in peripheral length of the heat-resistant belt 3. Therefore, the fixing device of fuser roller type can be manufactured to have simple structure and small size at low cost.

Since the heat-resistant belt 3 travels the minimum path, the heat-resistant belt 3 is heated at the nip by the rotatable fuser roller 1 having the built-in heat source and the heat energy drawn during the traveling along a predetermined path can be minimized. In addition, since the peripheral length is short, the temperature drop due to natural heat release can be reduced, thereby shortening the required warm-up time from a time point at which the power is ON to a time point at which the fixing is enabled.

Figure 11:
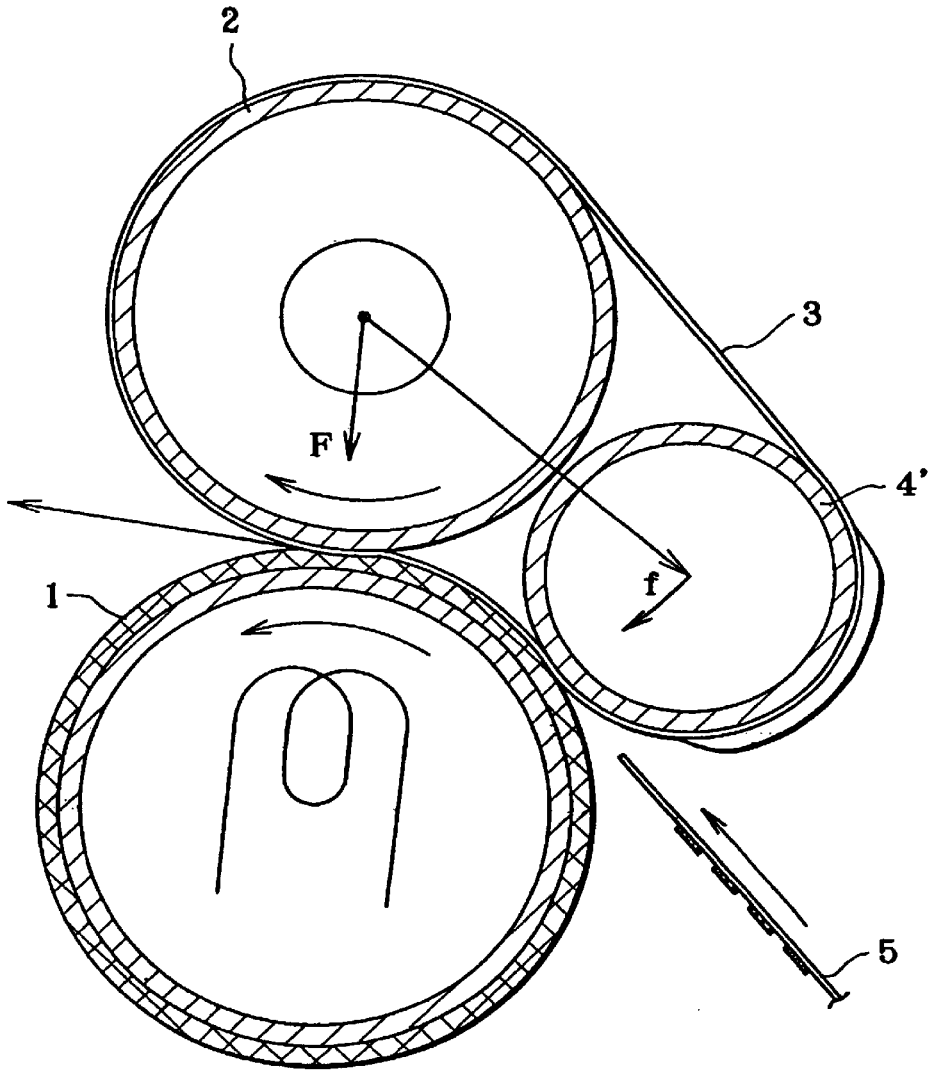
FIG. 11 is an illustration showing another embodiment of a fixing device according to the present invention in which a roller member is used as a tensioning member and is arranged on the upstream side in the traveling direction of a bell.
Figure 12:
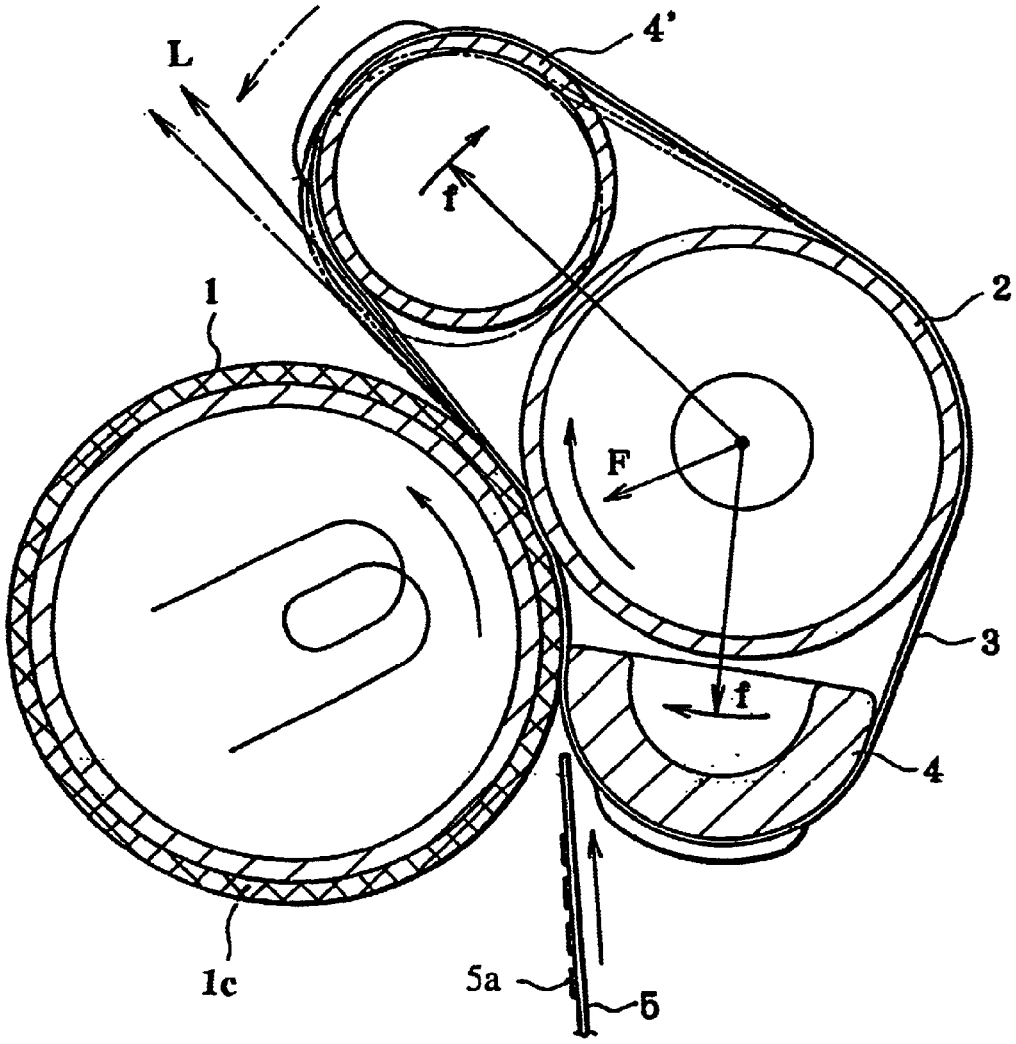
FIG. 12 is an illustration showing another embodiment of a fixing device according to the present invention in which a roller member is used as a tensioning member and is arranged on the downstream side in the traveling direction of a belt.

FIG. 11 is an illustration showing another embodiment of a fixing device according to the present invention in which a roller member is used as the belt tensioning member 4' and is arranged on the upstream side in the traveling direction of the heat-resistant belt 3 and FIG. 12 is an illustration showing another embodiment of a fixing device according to the present invention in which belt tensioning members 4, 4' are arranged on both sides of the pressure roller 2.

In FIG. 11, the belt tensioning member 4' is a roller member, not a semilunar belt tensioning member 4 like the aforementioned embodiments, and is arranged on the upstream side in the traveling direction of the heat-resistant belt 3. On the contrary, the belt tensioning member 4' composed of a roller member may be arranged on the downstream side in the traveling direction of the heat-resistant belt 3. The belt tensioning member 4' may be rotatably supported. As the belt tensioning member 4' is rotatably supported, than the coefficient of friction between the belt tensioning member 4' and the heat-resistant belt 3 can be set to be smaller than the coefficient of friction between the pressure roller 2 and the heat-resistant belt 3 so that the beat-resistant belt 3 can be stably driven by the pressure roller 2.

Though the belt tensioning member 4, 4' is arranged either of the upstream side or the downstream side in the traveling direction of the heat-resistant belt 3 relative to the pressure roller 2 in the aforementioned embodiments, belt tensioning members 4, 4' may be arranged on both an upstream side and a downstream side as shown in FIG. 12. According to this structure, by setting either or both the belt tensioning members 4, 4' to be lightly pressed to the fuser roller 1, suitable desired pressure can be applied to the fleer roller 1 by the pressure roller 2 while constant pressure can be applied at other portions of the nip area. When one of the belt tensioning members 4, 4' is lightly pressed to the fuser roller 1 and the other belt tensioning member 4, 4' is spaced apart form the fuser roller 1, i.e. in the non-contact state, the nip length can be changed by changing the distance between the belt tensioning member 4, 4' in the non-contact state and the finer roller 1 as shown by solid line and chain double-dashed line in FIG. 12.

For stably fixing an unfixed toner image 5*a* formed on a sheet medium 5, it is necessary to sufficiently heat and fuse the unfixed toner image 5*a*. For this, a predetermined temperature and predetermined fusing time are required. In this embodiment, however, the fixing device can be structured to have a longer nip length so that it is not required to largely deform the elastic member 1*c* layered on the outer surface of the fuser roller 1 in order to lengthen the nip length. Accordingly, the fixing device can be structured to have the elastic member ic having smaller thickness. Even without a large pressing force of the pressure roller 2 for deforming the elastic member 1*c*, enough nip can be obtained. Therefore, the stress on the sheet medium 5 when the sheet medium 5 passes between the fuser roller 1 and the heat-resistant belt 3 is small, thereby preventing the deformation, such as curl and wrinkles, of the sheet medium 5 ejected after the unfixed toner image 5*a* is fixed.

That is, it is not required to increase the mechanical rigidity of the fixing device of fuser roller type. In addition, the thickness of the fuser roller 1 can be reduced, thereby improving the speed for heating up the heat-resistant belt 3 by the heat source. The thickness of the pressure roller 2 can also be reduced so as to allow smaller heat capacity. Accordingly, the heat energy absorbed from the heat-resistant belt 3 is small, thereby shortening the warm-up time from a time point at which the power is ON to a time point at which fixing is enabled.

To shorten the peripheral length of the heat-resistant belt 3, minimize we heat energy drawn from the heat-resistant belt 3, and reduce the temperature drop due to natural heat release, the length that the heat-resistant belt 3 is wound around the belt tensioning member 4, 4' is set to be shorter than the length that the heat-resistant belt 3 is wound around the pressure roller 2. This is tantamount so that the winding angle of the heat-resistant belt 3 around the pressure roller 2 is set to smaller than the winding angle of the heat-resistant belt around the belt 3 tensioning member 4, 4' or that the diameter of the belt tensioning member 4, 4' is set to be smaller than the diameter of the pressure roller 2. As previously described, as the peripheral length of the heat-resistant belt 3 is shortened and the heat-resistant belt 3 is designed to travel the minimum path, many effects are expected as follows. The fixing device of fuser roller type can be manufactured to have simple structure and reduced size at low cost. Further, the heat energy drawn from the heat-resistant belt 3, which was heated at the nip with the fuser roller 1, during the traveling along a predetermined path can be minimized. In addition, since the peripheral length is short, the temperature drop due to natural heat release can be reduced, thereby shortening the required warm-up time from a time point at which the power is ON to a time point at which the fixing is enabled.

The driving means should provide a plurality of rotational speeds, at least two rotational speeds, for driving the fuser roller 1 and the pressure roller 2. Description will now be made as regard to the control of the fixing device for selecting the rotational speed from the first rotational speed and the second rotational speed, which is slower than the first rotational speed, for driving the fuser roller 1 and the pressure roller 2. A detecting means for detecting the sheet medium characteristics is provided and a setting means for setting selection information such as the rotational speed depending on the sheet medium characteristics is provided. As the sheet medium characteristics of a sheet medium 5 having an unfixed toner image 5*a* thereon is detected on the way of proceeding of the sheet medium 5, the setting depending on the sheet medium characteristics is made during the process of making a fixing command for the sheet medium 5 with the unfixed toner image 5*a* thereon. On the basis of the setting, the rotational speed is selected to drive the fuser roller 1 and the pressure roller 2. As the setting means, parts coupled to the fixing device of fuser roller type may be manually operated or the fixing device may be operated by remote control by means of electric signals, prior to the fixing command. Similarly, the position of the belt tensioning member 4 may be changed corresponding to the kind of sheet media as described with regard to FIG. 6 and FIG. 10.

The sheet medium 5 having the unfixed toner image 5*a* thereon may be media for various uses including a normal sheet medium such as paper, a thick sheet medium having larger heat capacity, and a transparent sheet medium (OHP sheet). Especially, for the thick sheet medium having larger beat capacity, a multi-layer sheet medium such as an envelope, and a transparent sheet medium (OHP sheet), a predetermined fusing time is required for sufficiently fusing and fixing the unfixed toner image 5*a* as compared to normal sheet media For this, by selecting the first rotational speed or the second rotational speed which is slower than the first rotational speed for driving the fuser roller 1 and the pressure roller 2 depending on the sheet medium characteristics, the unfixed toner image 5*a* is suitably fused, thereby achieving desired fixing.

Even though the driving with selecting the first rotational speed or the second rotational speed is conducted, the stress on a sheet medium 5 having an unfixed toner image 5*a* thereon while passing between the fuser roller 1 and the heat-resistant belt 3 does not vary and is small, thereby preventing the deformation, such as wrinkles, of the sheet medium 5 ejected after the unfixed toner image 5*a* is fixed. Therefore, it is not required to increase the mechanical rigidity of the fixing device of fuser roller type. In addition, the thickness of the fuser roller 1 can be reduced, thereby improving the speed for heating up the heat-resistant belt 3 by the heat source. The thickness of the pressure roller 2 can also be reduced so as to allow smaller beat capacity. Accordingly, the heat energy absorbed from the heat-resistant belt 3 is small, thereby shortening the warm-up time from a time point at which the power is ON to a time point at which fixing is enabled. As a means for driving while selectively changing the rotational speed, for example, a means for selectively changing the revolution speed of a driving motor is preferable.

In the embodiment, the warm-up time of 30 sec is achieved under conditions that the fuser roller 1 has an outer diameter of Φ25, a thickness of 0.7 mm, and an elastic member 1*c* of 0.5 mm in thickness, the pressure roller 2 has an outer diameter of Φ25 and a thickness of 0.7 mm, the fuser roller 1 and the pressure roller 2 are set to have a pressing force therebetween of 10 kg or less and have a nip length of 10 mm, and a columnar halogen lamp 1*a* of 1000 W is used as the heating source.

Though the outer diameter of the fuser roller 1 and the pressure roller 2 is set to be Φ25, i.e. small, a sheet medium 5 after the toner image is normally fixed is not wrapped around the fuser roller 1 or the heat-resistant belt 3, thereby eliminating the peeling means for forcedly peeling off the sheet medium 5. Since a color image is formed by superposing four color toner images, an unfixed toner image 5*a* for forming a photograph image must be thick so that a sheet medium 5 is easily wrapped around the fuser roller 1. In this embodiment, however, the sheet medium 5 is prevented from being wrapped around the fuser roller 1 because of the following behavior. That is, when the sheet medium 5 after the toner image is fixed tends to be wrapped around the fuser roller 1, a force attracting the heat-resistant belt 3 toward the fuser roller 1 via the sheet medium 5 acts. On the other hand, the heat-resistant belt 3 is tensioned in a direction getting away from the fuser roller 1 by the pressure roller 2 and the belt tensioning member 4 at the end position of the nip. By these opposed forces, the sheet medium 5 is prevented from being wrapped around the fuser roller 1.

In the fixing device having the aforementioned structure according to this embodiment, either one of the fuser roller 1 and the pressure roller 2 is the driving roller. In this case, to realize the stable driving, it is preferable that the harder roller is used as the driving roller and the softer roller is used as the driven roller. The pressure roller 2 around which the heat-resistant belt 3 is wound presses the heat-resistant belt 3 to the elastic member 1*c* layered on the outer surface of the fuser roller 1 and drives the heat-resistant belt 3 so that the fuser roller 1 is driven. Since the pressure roller 2 defines the feeding speed of the heat-resistant belt 3, that is, the sheet medium 5 having an unfixed toner image 5*a* thereon, the pressure roller 2 should be structured to have a rigid surface at least harder than the elastic member 1*c* layered on the outer surface of the fuser roller 1. Accordingly, the driving with stable feeding speed can be achieved without deformation.

The heat-resistant belt 3 tensioned and driven by the pressure roller 2 and the belt tensioning member 4 may snake due to errors in parallelism between the pressure roller 2 and the belt tensioning member 4 and errors in peripheral length in the axial direction of the heat-resistant belt 3. The convexity(-ics) 4*a* disposed at end(s) of the belt tensioning member 4 limits the lateral shift of the heat-resistant belt 3, by that the beat-resistant belt 3 collides with the convexity 4*a*. Accordingly, stress is caused on the edge(s) of the heat-resistant belt 3. For obtaining enough strength, the heat-resistant belt 3 is designed to have a thickness of 0.03 mm or more, when the heat-resistant belt 3 comprises a stainless steel tube or a nickel electroforming tube, or the heat-resistant belt 3 is designed to have a thickness of 0.05 mm or more when the heat-resistant belt 3 comprises a resin tube made of a heat-resistant resin such as polyimide or silicone.

When the convexity 4*a* is disposed on one end of the bell tensioning member 4, the pressure roller 2 and the belt tensioning member 4 may be designed to have such a relation that the heat-resistant belt 3 shifts only to one side or a means for assisting the heat-resistant belt 3 toward the one side may be provided at the other side of the heat-resistant belt 3. When the convexities 4*a* are disposed on both ends of the belt tensioning member 4, the heat-resistant belt 3 may snake between both convexities 4*a*. However, there is no practical problem by suitably setting the distance between the convexities 4*a* of both ends relative to the width of the heat-resistant belt 3.

Figure 13:
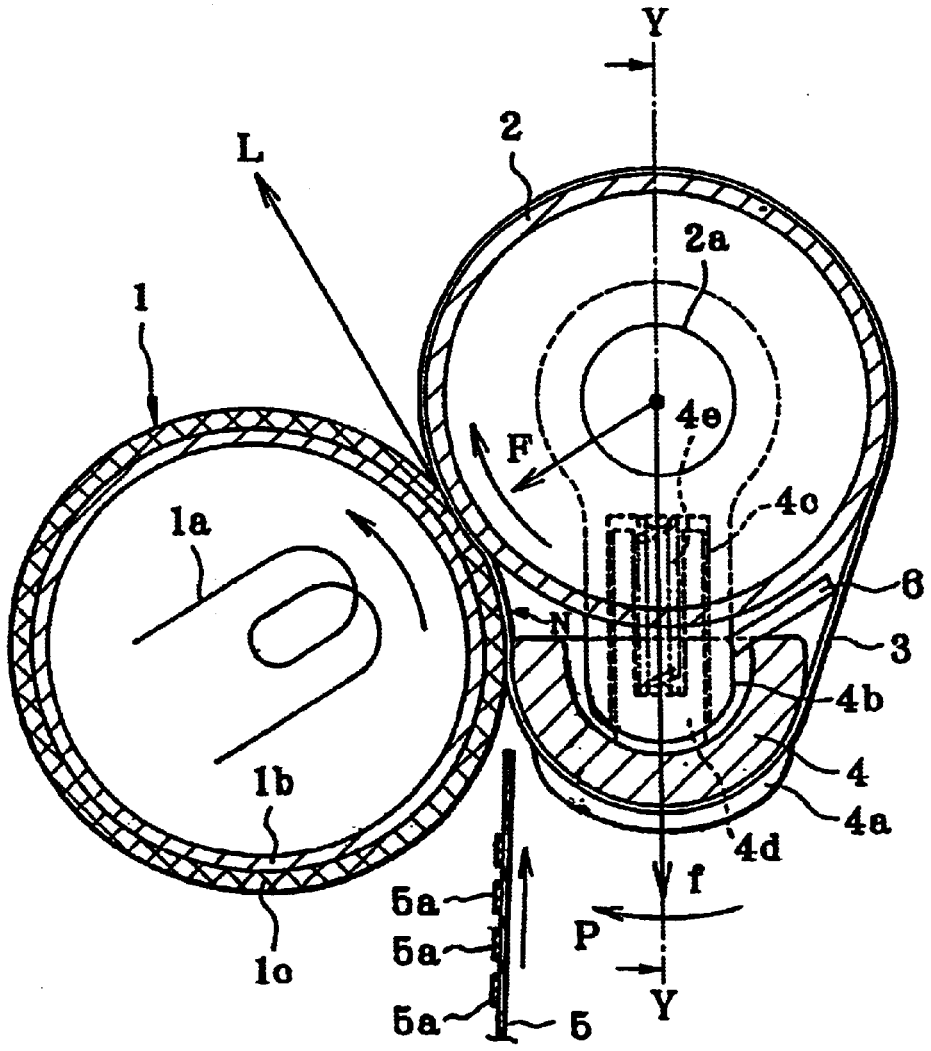
FIG. 13 shows another embodiment of a fixing device according to the present invention and is a sectional view taken along a line X—X and seen in a direction of arrows of FIG. 14.
Figure 14:
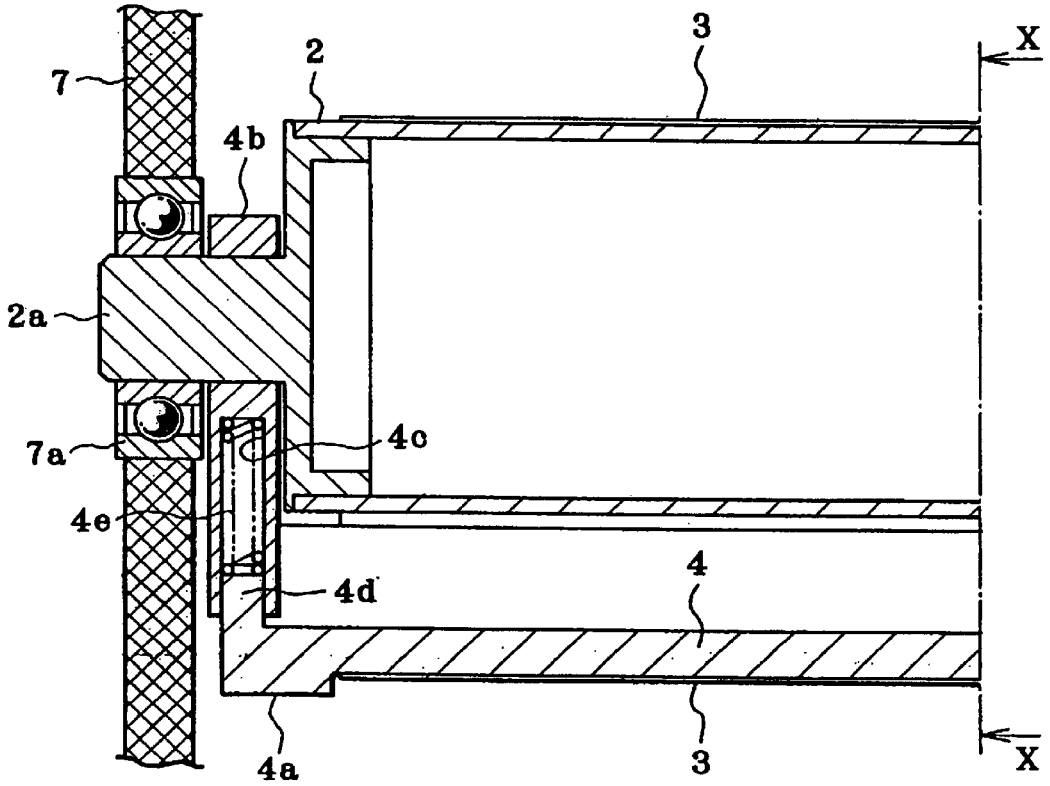
FIG. 14 is a sectional view taken along a line Y—Y and seen in a direction of arrows of FIG. 13.

FIG. 13 and FIG. 14 show another embodiment of a fixing device according to the present invention FIG. 13 is a sectional view taken along a line X—X and seen in a direction of arrows of FIG. 14 and FIG. 14 is a sectional view taken along a line Y—Y and seen in a direction of arrows of FIG. 13. The fixing device is symmetrical, so illustration of the right half from the line X—X is omitted and only the left half is illustrated in FIG. 14. With reference to FIG. 13 and FIG. 14, the structure for supporting a pressure roller 2 and a belt tensioning member 4 will be described.

A rotary shaft 2*a* projecting from both ends of the pressure roller 2 is rotatably supported via bearings 7*a* to left and right frames 7. On the both ends of the rotary shaft 2*a* of the pressure roller 2, swing arms 4*b* are rotatably fitted, respectively. Each swing arm 4*b* is provided at the belt tensioning member side with a guide groove 4*c*. On the other hand, the belt tensioning member 4 is provided at the both ends with guide portions 4*d* extending toward the pressure roller 2. The guide portions 4*d* are inserted into the guide grooves 4*c* of the swing arms 4*b* via springs 4*e*, respectively. Therefore, the belt tensioning member 4 is biased by the springs 4*e* in a direction getting away from the pressure roller 2 so that the tension "f" is applied to the heat-resistant belt 3.

In this embodiment, since the belt tensioning member 4 is structured such that the belt tensioning member 4 can swing for a predetermined angle about a shaft which is common to the rotary shaft 2*a* of the pressure roller 2, the beat-resistant belt 3 and the belt tensioning member 4 pivotally move toward the fuser roller 1 about the shaft, which is common to the rotary shaft 2*a* of the pressure roller 2, by frictional force between the heat-resistant belt 3 driven by the rotation of the pressure roller 2 and the belt tensioning member 4 so that the belt tensioning member 4 stops in the state that a rotational force P caused by the aforementioned frictional force and pressing force between the heat-resistant belt 3 and the fuser roller 1 are balanced. In FIG. 13, if the line Y—Y connecting the axis of the rotary shaft 2*a* of the pressure roller 2 and the center of the belt tensioning member 4 is inclined leftwards, torque corresponding to the own weight of the belt tensioning member 4 is added to the rotational force P. The pressing force between the heat-resistant belt 3 and the fuser roller 1 can be suitably set by setting the frictional force between the heat-resistant belt 3 and the belt tensioning member 4 and setting the inclination angle of the line Y—Y.

Therefore, regardless of when a sheet medium 5 with an unfixed toner image 5*a* passes between the fuser roller 1 and the heat-resistant belt 3 and when no sheet medium 5 passes between the fuser roller 1 and the heat-resistant belt 3 and regardless of thickness of the sheet medium 5, the pressing force between the heat-resistant belt 3 and the fuser roller 1 is constant so that the stress on the passing sheet medium 5 can be constant. Accordingly, the sheet medium 5 is ejected after the unfixed toner image 5*a* is fixed is prevented from being deformed such as having wrinkles.

In addition, when the belt tensioning member 4 is a member allowing the sliding of the heat-resistant belt 3 thereon, bearings are not required because the heat-resistant belt sliding member is not a rotatable member. Therefore, the supporting structure can be simple. When the belt tensioning member 4 is formed into a semilunar shape, the belt tensioning member 4 is disposed such that the subtense of the semilunar shape faces the pressure roller 2, thereby enabling such an arrangement that the belt tensioning member 4 is positioned close to the pressure roller 2 to the utmost limit This also enables the reduction in peripheral length of the heat-resistant belt 3. Therefore, the fixing device of fuser roller type can be manufactured to have simple structure and small size at low cost.

Further, since the heat-resistant belt 3 travels the minimum path, the heat-resistant belt 3 is heated at the nip by the rotatable fuser roller 1 having the built-in heat source and the heat energy drawn during the traveling along a predetermined path can be minimized. In addition, since the peripheral length is short, the temperature drop due to natural heat release can be reduced, thereby shortening the required warm-up time from a time point at which the power is ON to a time point at which the fixing is enabled.

Figure 15A:
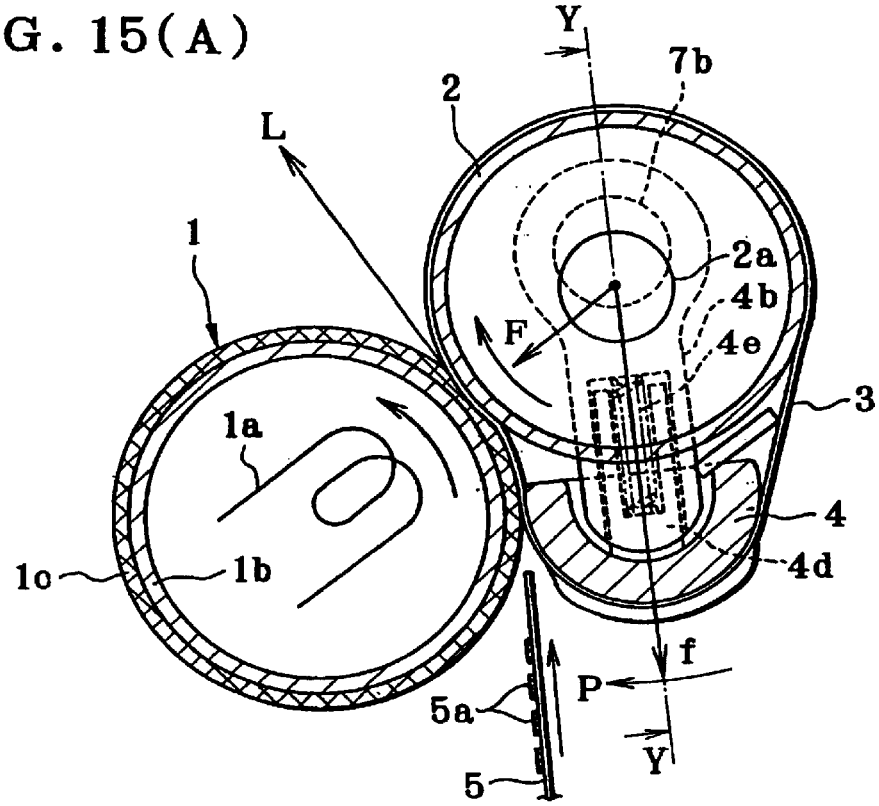
Figure 15B:
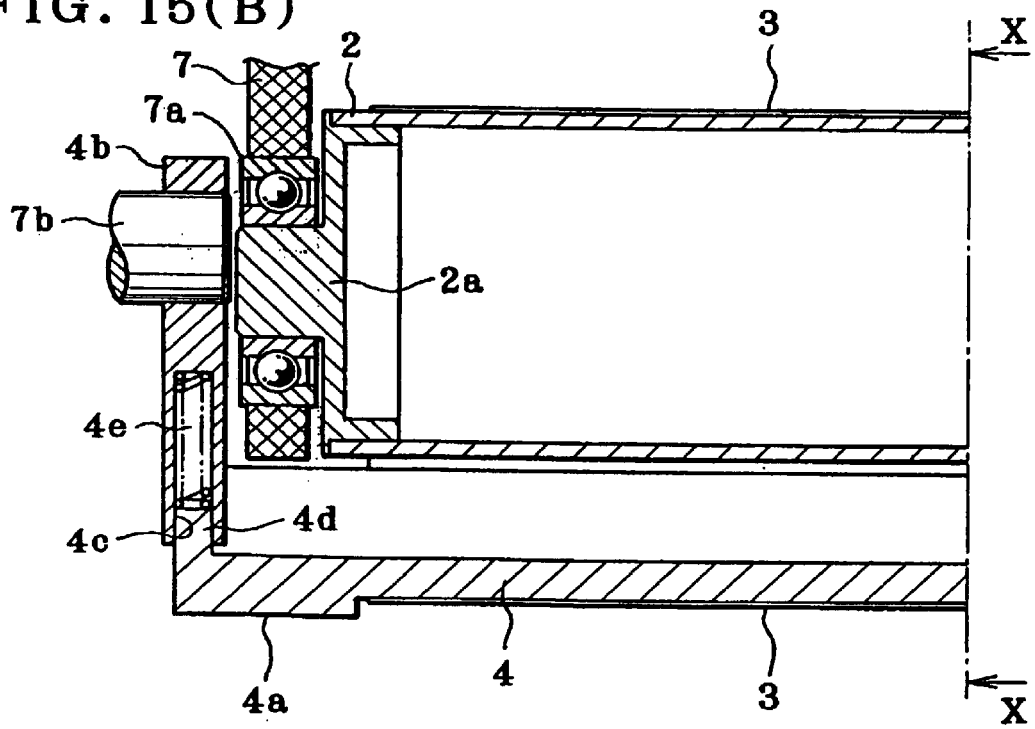

FIGS. 15(A), 15(B) show another embodiment of a fixing device according to the present invention, wherein FIG. 15(A) is a sectional view taken along a line X—X and seen in a direction of arrows of FIG. 15(B) and FIG. 15(B) is a sectional view taken along a line Y—Y and seen in a direction of arrows of FIG. 15(A). In the following description, the same elements as used in the aforementioned embodiments are identified with the same reference numerals and the description of such elements will be omitted.

A different point of this embodiment from the aforementioned embodiments will be explained. Though the belt tensioning member 4 is designed to be able to swing for a predetermined angle about a shaft which is common to the rotary shaft 2*a* of the pressure roller 2 in the aforementioned embodiment, the belt tensioning member 4 is designed to be able to swing for a predetermined angle about shaft 7*b* of which axis is different from the axis of the rotary shaft 2*a* of the pressure roller 2 in this embodiment.

That is, swing arms 4*b* are rotatably fitted around the shaft 7*b* of which axis is disposed at a position different from the axis of the rotary shaft 2*a*. Each swing arm 4 is provided at the belt tensioning member side with a guide groove 4*c*. On the other hand, the belt tensioning member 4 is provided at both ends with guide portions 4*d* extending toward the pressure roller 2. The guide portions 4*d* are inserted into the guide grooves 4*c* of the swing arms 4*b* via springs 4*e*, respectively. Therefore, the belt tensioning member 4 is biased by the springs 4*e* in a direction getting away from the pressure roller 2 so that the tension "f" is applied to the heat-resistant belt 3.

By this arrangement, the torque acting on the belt tensioning member 4 can be changed (the torque is increased in an example shown in FIGS. 15(A), 15(B)) so that the pressing force between the heat-resistant belt 3 and the fuser roller 1 can be controlled.

Though the belt tensioning member 4 is composed of a belt sliding member which is formed in a semilunar shape in the embodiments of FIGS. 13–15(B), the belt tensioning member 4 may be composed of a belt sliding member which is formed in a roll (cylindrical shape).

Figure 16A:
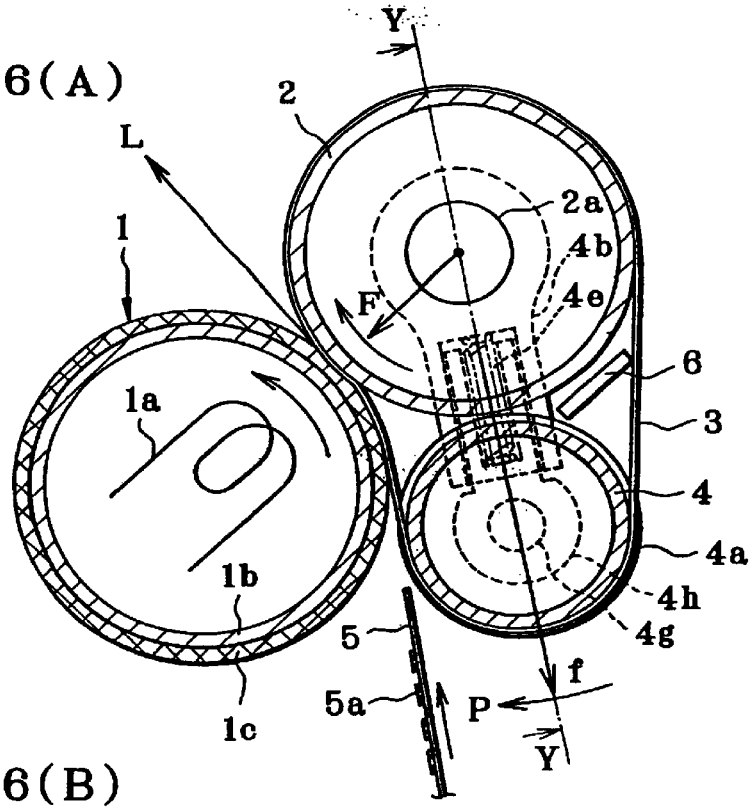
Figure 16B:
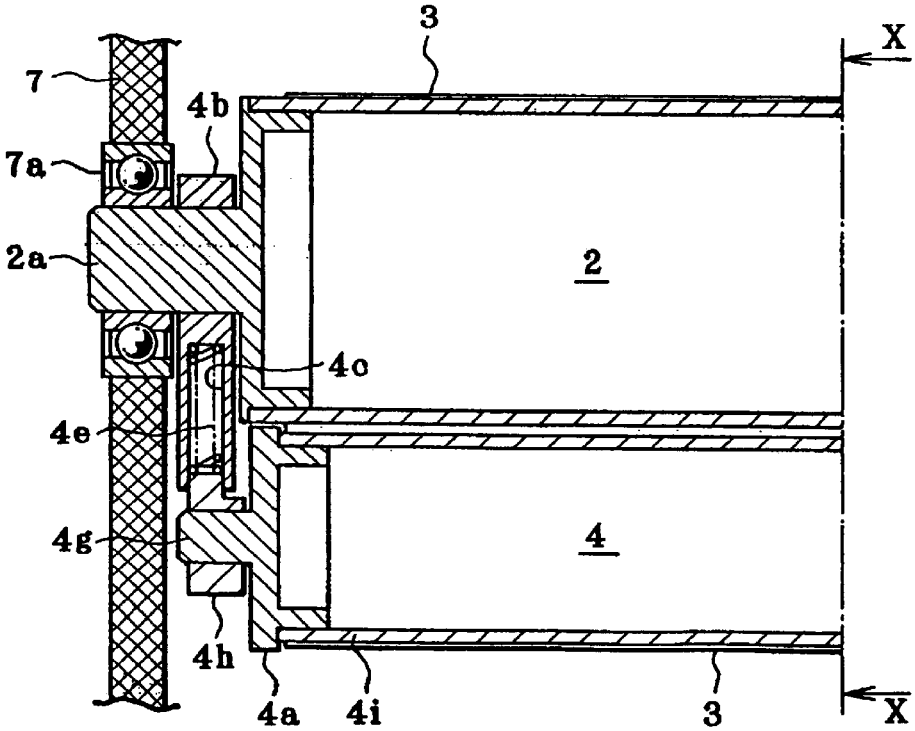

FIGS. 16(A), 16(B) show another embodiment of a fixing device according to the present invention, wherein FIG. 16(A) is a sectional view taken along a line X—X and seen in a direction of arrows of FIG. 16(B) and FIG. 16(B) is a sectional view taken along a line Y—Y and seen in a direction of arrows of FIG. 16(A). Though the belt sliding member is used as the belt tensioning member 4 in the embodiments of FIGS. 13–15(B), a rotational member which is formed into a roller is used as the belt tensioning member 4 in this embodiment.

That is, the belt tensioning member 4 comprises a roller component 4*i* which is provided a rotary shaft 4*g* projecting from the ends thereof. The rotary shaft 4*g* is rotatably supported by guide components 4*h*. The guide components 4*h* are inserted into guide groove 4*c* of the swing arms 4*b* via springs 4*e*, respectively. Therefore, the belt tensioning member 4 is biased by the springs 4*e* in a direction getting away from the pressure roller 2 so that the tension "f" is applied. As the belt tensioning member 4 is rotatably supported, the coefficient of friction between the pressure roller 2 and the beat-resistant belt 3 is set to be larger than the coefficient of friction between the belt tensioning member 4 and the heat-resistant belt 3 while the heat-resistant belt 3 is tensioned by the pressure roller 2 and the belt tensioning member 4, thereby stably driving the heat-resistant belt 3 by the pressure roller 2.

Figure 17A:
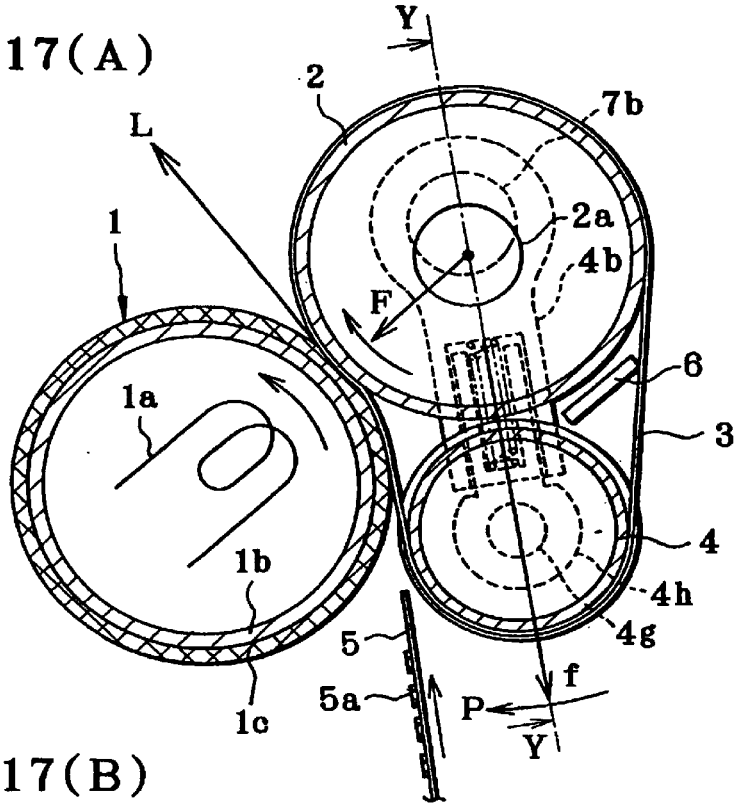
Figure 17B:
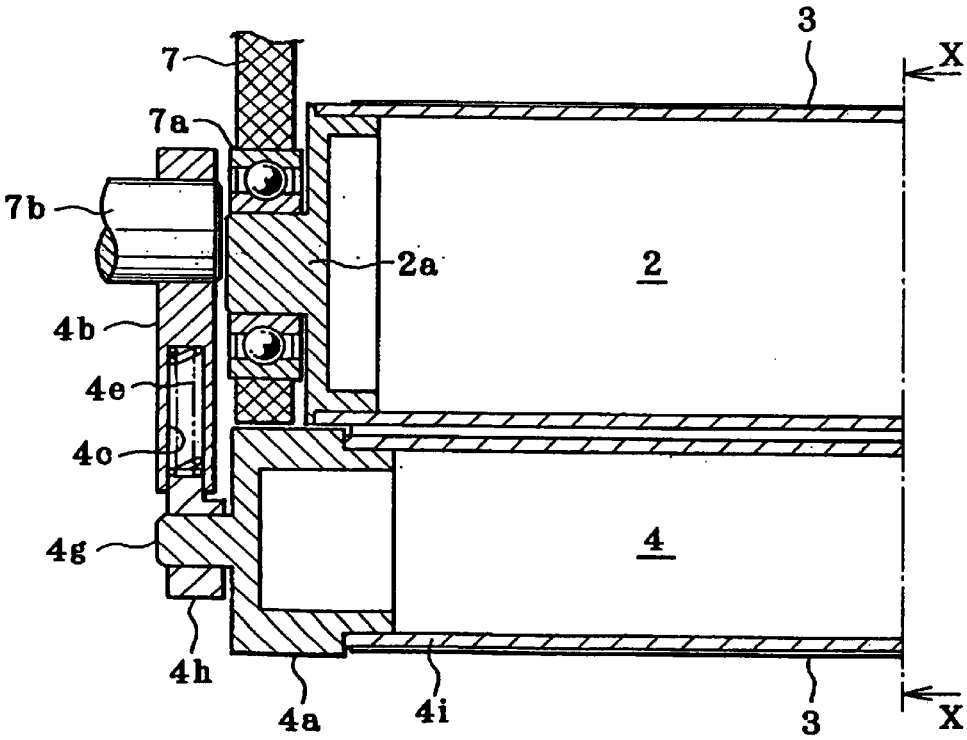

FIGS. 17(A), 17(B) show another embodiment of a fixing device according to the present invention, wherein FIG. 17(A) is a sectional view taken along a line X—X and seen in a direction of arrows of FIG. 17(B) and FIG. 17(13) is a sectional view taken along a line Y—Y and seen in a direction of arrows of FIG. 17(A).

This embodiment is a combination of the embodiment of FIGS. 16(A), 16(B) and the embodiment of FIGS. 15(A), 15(B), in which the belt tensioning member 4 is designed to be able to swing for a predetermined angle about shaft 7*b* which are different from the rotary shaft 2*a* of the pressure roller 2. That is, swing arms 4*b* are rotatably fitted around the shaft 7*b*of which axis is disposed at a position different from the axis of the rotary shaft 2*a*. Each swing arm 4*b* is provided at the belt tensioning member side with a guide groove 4*c*. On the other hand, the belt tensioning member 4 has a roller component 4*i* and is provided with a rotary shaft 4*g* projecting from both ends of the roller component 4*i*. The rotary shaft 4*g* is rotatably supported to guide components 4*h*. The guide components 4*h* are inserted into guide grooves 4*c* of swing arms 4*b* via springs 4*e*, respectively. Therefore, the belt tensioning member 4 is biased by the springs 4*e* in a direction getting away from the pressure roller 2 so that the tension "f" is applied to the heat-resistant belt 3.

In the embodiment of FIGS. 16(A), 16(B) and FIGS. 17(A), 17(B), the belt tensioning member 4 is spaced apart from the fuser roller 1, not being lightly pressed against the fuser roller 1. That is, the belt tensioning member 4 is located at the upstream side in the traveling direction of the heat-resistant belt 3 relative to the start position of the nip.

Therefore, in this case, the nip length can be lengthened by shifting the position of the belt tensioning member 4 toward the fuser roller 1 to shift the start position of the nip to the upstream side. On the other hand, the nip length can be shortened by shifting the position of the belt tensioning member 4 away from the fuser roller 1.

It should be understood that, also in the embodiments shown in FIGS. 13–15(B), the belt tensioning member 4 may be arranged to be spaced apart from the fuser roller 1 and that, in the embodiments shown in FIGS. 16(A), 16(B) and FIGS. 17(A), 17(B), the belt tensioning member 4 may be arranged to be lightly pressed against the fuser roller 1. In case that the belt tensioning member 4 is arranged to be spaced apart from the fuser roller 1, the fixing pressure is constant from the start position of the nip and is increased by the pressure roller 2 at the end position of the nip.

Figure 18:
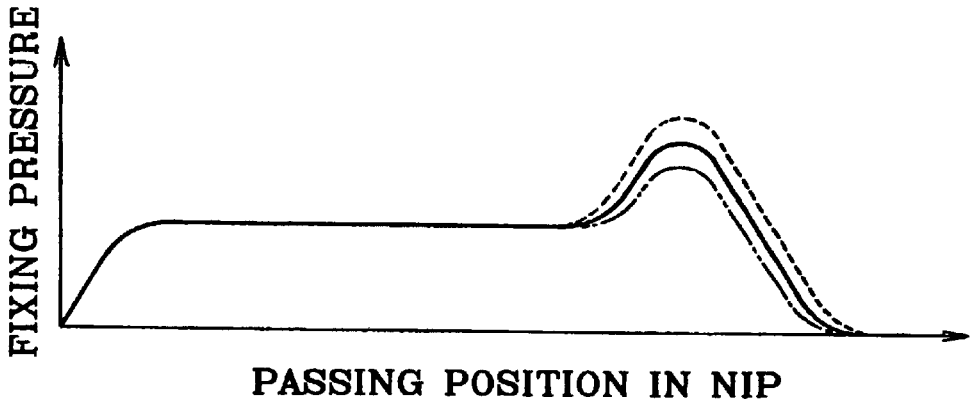
FIG. 18 is a graph showing an example of fixing pressure which varies according to the passing position in a nip.

FIG. 18 is a graph showing an example of fixing pressure which varies according to the passing position in a nip. FIG. 18 shows profiles of variations in fixing pressure for a sheet medium having a larger thickness (dotted line), for a sheet medium having a standard thickness (solid line), and for a sheet medium having a smaller thickness (chain double-dashed line) when the belt tensioning member 4 is arranged at the upstream side in the traveling direction of the heat-resistant belt 3 relative to the pressed portion between the fuser roller 1 and the pressure roller 2 and the belt tensioning member 4 is designed to be able to swing in one direction of the fuser roller 1. The fixing pressure (contact pressure distribution) between the fuser roller 1 and the heat-resistant belt 3 has the highest pressure at the pressed portion between the fuser roller 1 and the pressure roller 2. An unfixed toner image can be sufficiently fused, thus achieving stable fixing. For example, in case of a sheet medium which has a patterned indented surface or a sheet medium, such as an OHP sheet, which has an extremely flat surface and high airtightness so that toner image hardly penetrates the sheet medium, pressure higher than that for fusing step is applied to the toner at the final step where the sheet medium passes the nip, thereby making the surface of fused toner flat and facilitating the penetration of the toner into the sheet medium. Therefore, the fixed toner image can be further stabilized.

According to the present invention having the aforementioned structure, the surface of the elastic member 1*c* of the fuser roller 1 and the surface of the beat-resistant belt 3 move at the same peripheral velocity to fix the unfixed toner image 5*a* formed on the sheet medium 5. If the surface of the heat-resistant belt 3 or a tip portion of the sheet medium 5 is waved, the start of fixing may be unstable. For this, by designing the heat-resistant belt 3 to be lightly pressed against the fuser roller 1 at the start position of the nip, the point where the sheet medium 5 meets the heat-resistant belt 3 is stabilized, thereby enabling excellent stable fixing of the unfixed toner image. The heat-resistant belt 3 is tensioned by the cooperation between the pressure roller 2 and the belt tensioning member 4 and is wrapped around the fuser roller 1 to form the nip, thereby easily achieving the structure having longer nip length, simplifying the structure, and reducing the size and the cost.

Figure 19A:
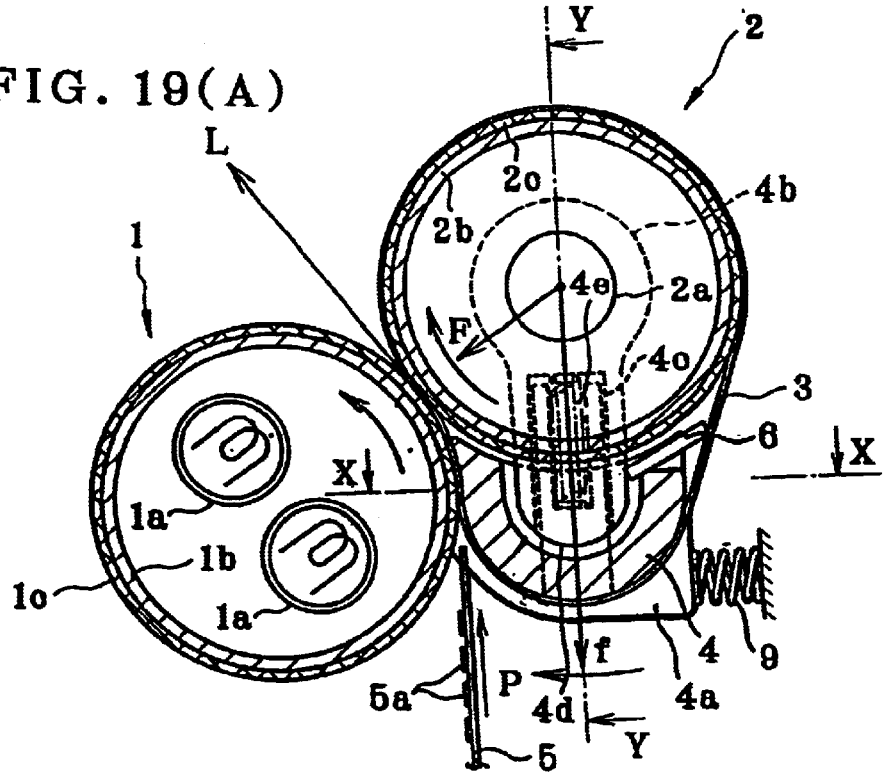
Figure 19B:
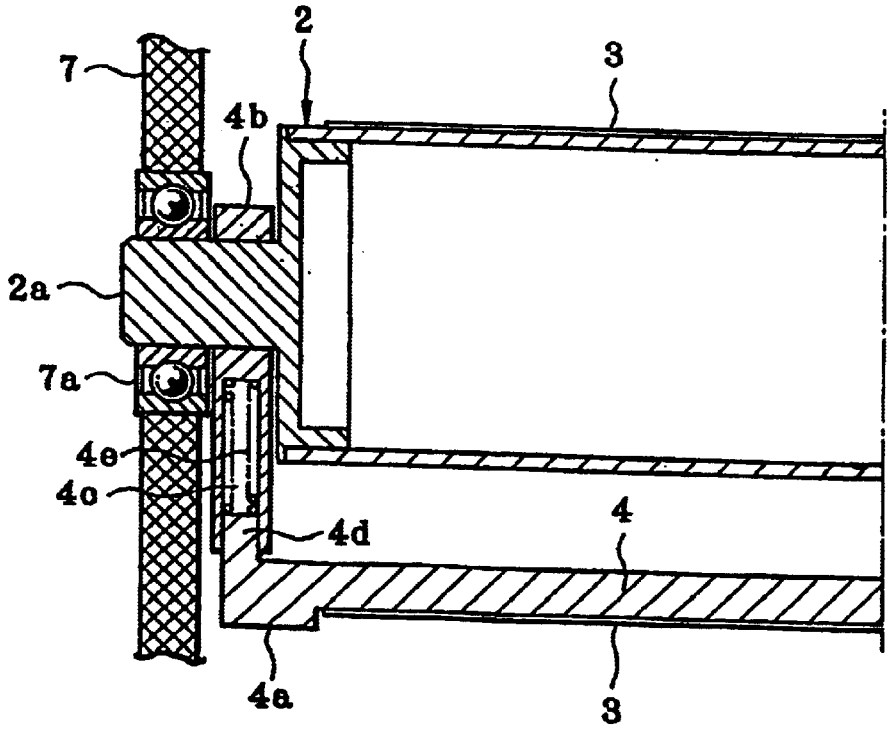

FIGS. 19(A), 19(B) show another embodiment of a fixing device according to the present invention, wherein FIG. 19(A) is a sectional view and FIG. 19(B) is a sectional view taken along a line Y—Y and seen in a direction of arrows of FIG. 19(A) in which illustration of the right half is omitted.

In FIGS. 19(A), 19(B), the fuser roller 1 is formed by using a pipe having an outer diameter of the order of 25 mm and a thickness of the order of 0.7 mm as the roller substrate 1*b* and coating the outer periphery of the pipe with an elastic member 1*c* of the order of 0.4 mm. The fuser roller 1 has two built-in halogen lamps 1*a* of 1050 W inside the roller substrate 1*b* as a heat source and is designed to be rotatable. The pressure roller 2 is formed by using a pipe having an outer diameter of the order of 25 mm and a thickness of the order of 0.7 mm as the roller substrate 2*b* and coating the outer periphery of the pipe with an elastic member 2*c* of the order of 0.2 mm. The fuser roller 1 and the pressure roller 2 are set to have a pressing force therebetween of 10 kg or less and to have a nip length of the order of 10 mm. The pressure roller 2 is arranged to face the fuser roller 1 and is designed to be rotatable in the direction of arrow in FIG. 19(A).

According to this embodiment, since the outer diameter of the fuser roller 1 and the pressure roller 2 is set to be 25 mm, i.e. small, a sheet medium 5 is not wrapped around the fuser roller 1 or the heat-resistant belt 3, thereby eliminating the peeling means for forcedly peeling off the sheet medium. When a PFA layer of the order of 30 $\mu$m is formed as an outer layer of the elastic member 1*c* of the fuser roller 1, the rigidity is improved. Though the thicknesses of the elastic members 1*c*, 2*c* are different from each other, the elastic members 1*c*, 2*c* are substantially uniformly elastically deformed to form a so-called horizontal nip so that extremely stable image fixing is achieved without causing differences in feeding speed of the heat-resistant belt 3 or the sheet medium 5.

In this embodiment, two heat sources 1*a* are arranged inside the fuser roller 1. When heating resistors of the halogen lamps 1*a* are arranged at different locations and are designed to be selectively t on, the temperature control can be easily conducted under different conditions for a fixing nip portion where the heat-resistant belt 3 is wrapped around the fuser roller 1 and a portion where the belt tensioning member 4 slides against the fuser roller 1 or under different conditions for a sheet medium having a large width and a sheet medium having a small width.

The heat-resistant belt 3 is an endless belt which is sandwiched between the fuser roller 1 and the pressure roller 2 and is wound around the outer periphery of the pressure roller 2 so that the beat-resistant belt 3 can travel, and is composed of a metal tube such as a stainless steel tube or a nickel electroforming tube, or a resin tube made of a heat-resistant resin such as polyimide or silicone having a thickness of 0.03 mm or more.

The belt tensioning member 4 is disposed on the upstream side in the feeding direction of the sheet medium 5 relative to the nip portion between the fuser roller 1 and the pressure roller 2 and is arranged to be able to swing about the rotary shaft 2*a* of the pressure roller 2 in a direction of arrow P. The belt tensioning member 4 tensions the heat-resistant belt 3 in the tangential direction of the fuser roller 1 when no sheet medium 5 passes the fixing nip. If the fixing pressure at the start position where the sheet medium 5 enters into the fixing nip is large, the sheet medium 5 hardly smoothly enters so that a tip portion of the sheet medium 5 may be folded. By designing the heat-resistant belt 3 to be tensioned in the tangential direction of the fuser roller 1, an introduction inlet for allowing smooth entrance of the sheet medium 5 is formed, thereby achieving the stable entrance of the sheet medium 5.

The belt tensioning member 4 is a semilunar heat-resistant belt sliding member (the heat-resistant belt 3 slides on the belt tensioning member) which is arranged inside the heat-resistant belt 3 to cooperate with the pressure roller 2 to apply tension "f" to the heat-resistant belt 3 and is arranged at such a position as to wrap the heat-resistant belt 3 around the fuser roller 1 partially for forming a nip. That is, the belt tensioning member 4 is arranged at such a position that the heat-resistant belt 3 is wrapped around the fuser roller 1 beyond the tangent L to the pressed portion between the fuser roller 1 and the pressure roller 2. The convexity or projecting wall(s) 4*a* is disposed at one end or both ends of the belt tensioning member 4 such that the heat-resistant belt 3 when shifting sideward collides with the convexity 4*a*, thereby limiting the lateral shift of the heat-resistant belt 3. A spring 9 is disposed between a side end of the projecting wall 4*a* on the other side of the fuser roller 1 and a frame so that the projecting wall 4*a* of the belt tensioning member 4 is lightly pressed against the fuser roller 1 and the belt tensioning member 4 is slidably positioned in contact with the fuser roller 1.

For stably driving the heat-resistant belt 3 by the pressure roller 2 while the heat-resistant belt 3 is tensioned by the pressure roller 2 and the belt tensioning member 4, it is preferable to set the coefficient of friction between the pressure roller 2 and the heat-resistant belt 3 to be larger than the coefficient of friction between the belt tensioning member 4 and the heat-resistant belt 3. However, the coefficient of friction may be unstable due to foreign matter and abrasion. Therefore, it is preferable to set the wrapping angle between the belt tensioning member 4 and the heat-resistant belt 3 to be smaller than the wrapping angle between the pressure roller 2 and the heat-resistant belt 3 and to set the diameter of the belt tensioning member 4 to be smaller than the diameter of the pressure roller 2. According to this setting, the length in which the beat-resistant belt 3 slides along the periphery of the belt tensioning member 4 becomes short, thereby avoiding factors contributing to unsteadiness due to changes with time and disturbance and thus achieving the stable driving of the heat-resistant belt 3 by the pressure roller 2.

A cleaning member 6is arranged between the pressure roller 2 and the belt tensioning member 4 and slides along the inner periphery of the heat-resistant belt 3 to clean foreign matter and abrasion powder on the inner periphery of the heat-resistant belt 3. By cleaning the foreign matter and abrasion powder, the heat-resistant belt 3 is refreshed, thereby avoiding factors contributing to unsteadiness. A concave portion 4*f* formed in the semilunar belt tensioning member 4 is suitable for collecting removed foreign matter and abrasion powder therein.

The sheet medium 5 passes between the heat-resistant belt 3 and the fuser roller 1 from the start position of the nip at which the belt tensioning member 4 is pressed lightly on the fuser roller 1, whereby an unfixed toner image 5*a* on the sheet medium 5 is fixed. After that, the sheet medium 5 is ejected in the tangential direction L of the pressed portion from the end position of the nip at which the pressure roller 2 is pressed against the fuser roller 1.

Hereinafter, the supporting structure between the pressure roller 2 and the belt tensioning member 4 will be described. A rotary shaft 2*a* projecting from both ends of the pressure roller 2 is rotatably supported by left and right frames via bearings 7*a*. On both ends of the rotary shaft 2*a* of the pressure roller 2, swing arms 4*b* are rotatably fitted, respectively. Each swing arm 4*b* is provided at the belt tensioning member 4 side with a guide groove 4*c*. On the other hand, the belt tensioning member 4 is provided at both ends with guide portions 4*d* extending toward the pressure roller 2. The guide portions 4*d* are inserted into the guide grooves 4*c* of the swing arms 4*b* via springs 4*e*, respectively. Therefore, the belt tensioning member 4 is biased by the springs 4*c* in a direction getting away from the pressure roller 2 so that the tension "f" is applied to the heat resistant belt 3.

In this embodiment, since the belt tensioning member 4 is a non-rotatable member on which the heat-resistant belt 3 slides, bearings are not required. Therefore, the supporting structure can be simple. Since the belt tensioning member 4 is formed into a semilunar shape, the belt tensioning member 4 is disposed such that the subtense of the semilunar shape faces the pressure roller 2, thereby enabling such an arrangement that the belt tensioning member 4 is positioned close to the pressure roller 2 to the utmost limit. This also enables the reduction in peripheral length of the heat-resistant belt 3. Therefore, the fixing device of fuser roller type can be manufactured to have simple structure and small size at low cost.

Further, since the heat-resistant belt 3 travels the minimum path, the heat-resistant belt 3 is heated at the nip by the rotatable fuser roller 1 having the built-in heat source(s) therein and the heat energy drawn during the traveling along a predetermined path can be minimized. In addition, since the peripheral length is short, the temperature drop due to natural heat release can be reduced, thereby shortening the required warm-up time from a time point at which the power is ON to a time point at which fixing is enabled.

In addition, the beat-resistant belt 3 is tensioned by the cooperation between the pressure roller 2 and the belt tensioning member 4 and is wrapped around the fuser roller 1 to form the nip, thereby easily achieving the structure having longer nip length, simplifying the structure, and reducing the size and the cost. Further, since the heat-resistant belt 3 travels the minimum path, the heat-resistant belt 3 is heated at the nip by the rotatable fuser roller 1 having the built-in heat source(s) therein and the heat energy drawn during the traveling along a predetermined path can be minimized. In addition, since the peripheral length is short, the temperature drop due to natural heat release can be reduced, thereby shortening the required warm-up time from a time point at which the power is ON to a time point at which fusing is enabled.

For stably fixing an unfixed toner image 5*a* formed on a sheet medium 5, it is necessary to sufficiently fuse and fix the unfixed toner image 5*a* so that predetermined temperature and fixing period of time are required. According to the structure of the present invention, it is not required to provide a means for largely deforming the elastic member 1*c* on the surface of the fuser roller 1 to lengthen the nip length, thus enabling the design of an elastic member 1*c* having a smaller thickness. In addition, it is not required to set the pressing force of the pressure roller 2 to be so large as to deform the elastic member 1*c*. Therefore, the stress on the sheet medium 5 when the sheet medium 5 having an unfixed toner image 5*a*thereon passes between the fuser roller 1 and the heat-resistant belt 3 is small, thereby preventing the deformation, such as curl and wrinkles, of the sheet medium 5 ejected after the unfixed toner image 5*a* is fixed.

That is, it is not required to increase the mechanical rigidity of the fixing device of fuser roller type. In addition, the thickness of the fuser roller 1 can be reduced, thereby improving the speed for heating up the heat-resistant belt 3 by the heat source 1*a*. The thickness of the pressure roller 2 can also be reduced so as to allow smaller heat capacity. Accordingly, the beat energy absorbed from the heat-resistant belt 3 is small, thereby shortening the warm-up time from a time point at which the power is ON to a time point at which fixing is enabled.

Figure 20:
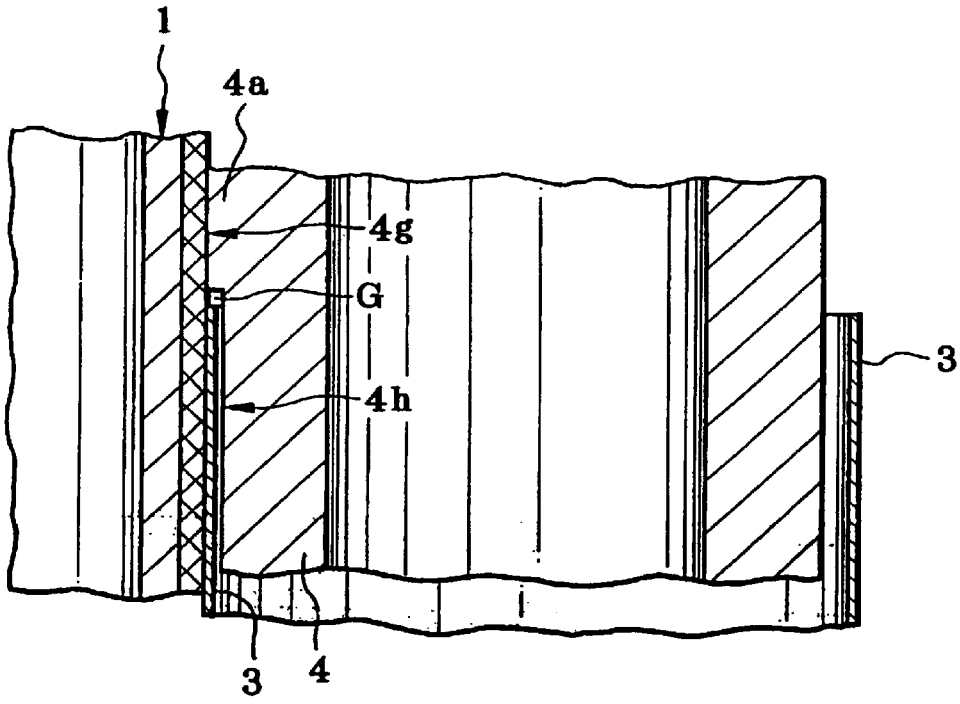
FIG. 20 shows detail of the structure shown in FIGS. 19(A), 19(B) and is a sectional view taken along a line X—X and seen in a direction of arrows of FIG. 19(A)
Figure 21:
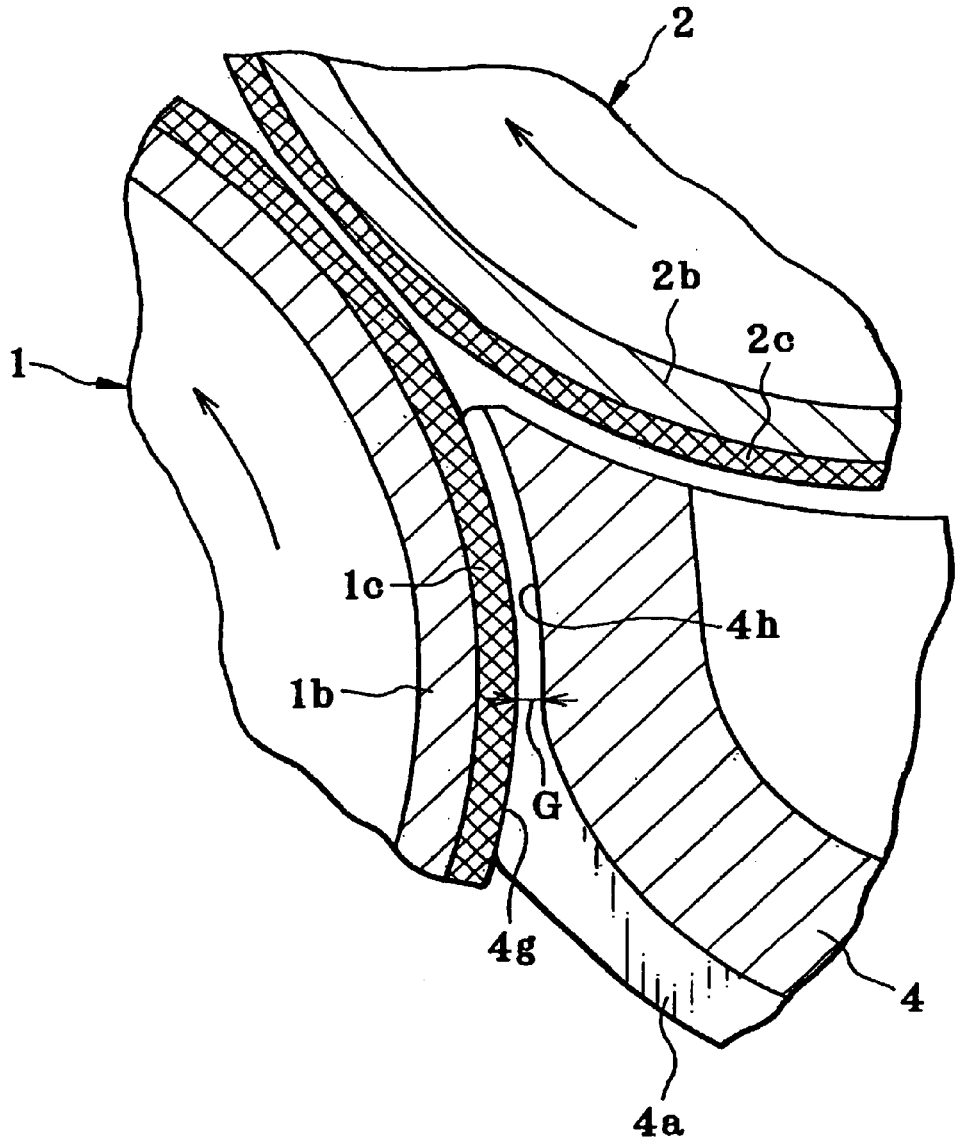
FIG. 21 is a partially enlarged sectional view showing a case that a heat-resistant belt is omitted from the structure of FIG. 19(A)
Figure 22:
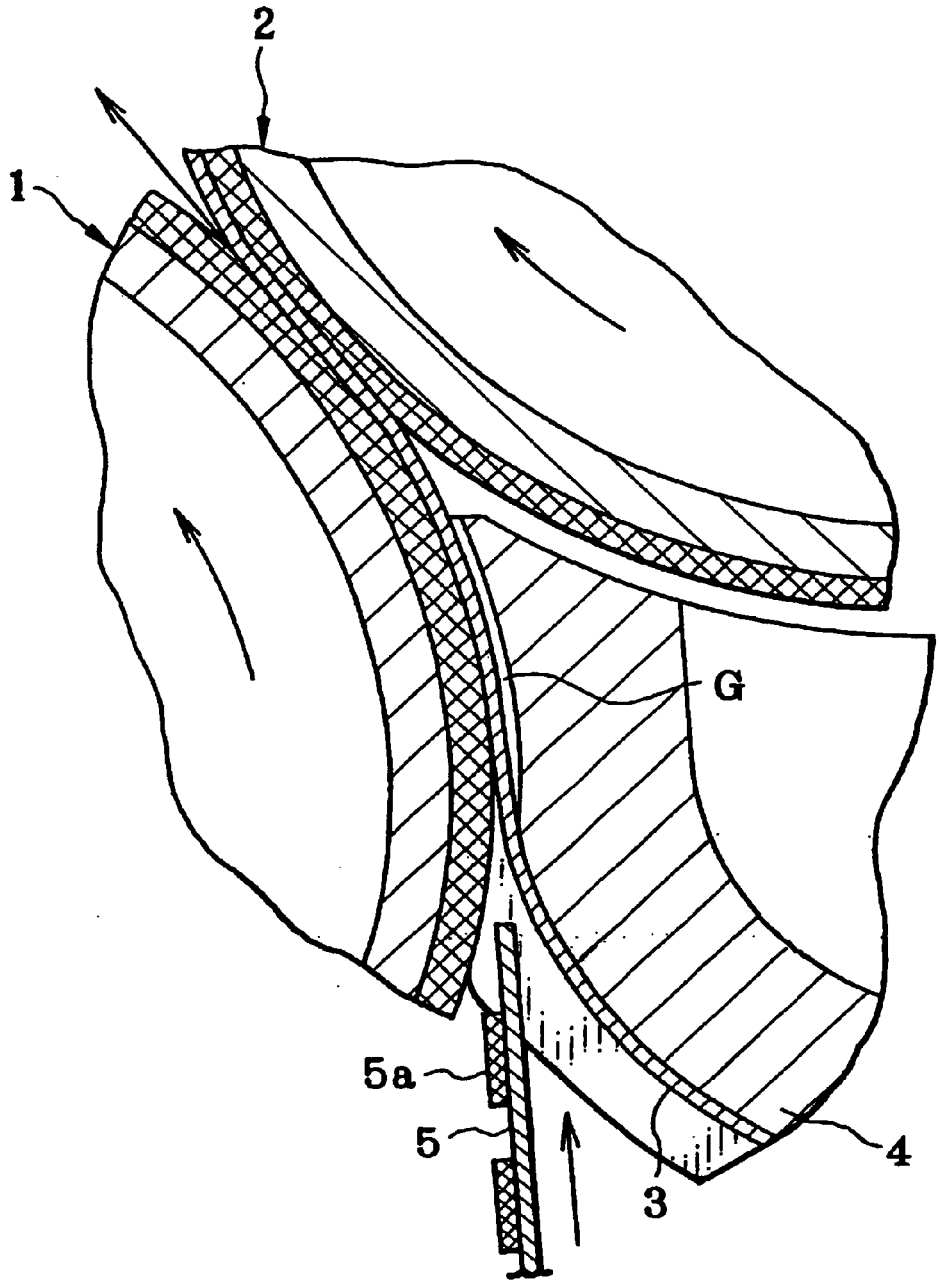
FIG. 22 is a partially enlarged sectional view showing a case that the beat-resistant belt is installed to the structure of FIG. 21.
Figure 23:
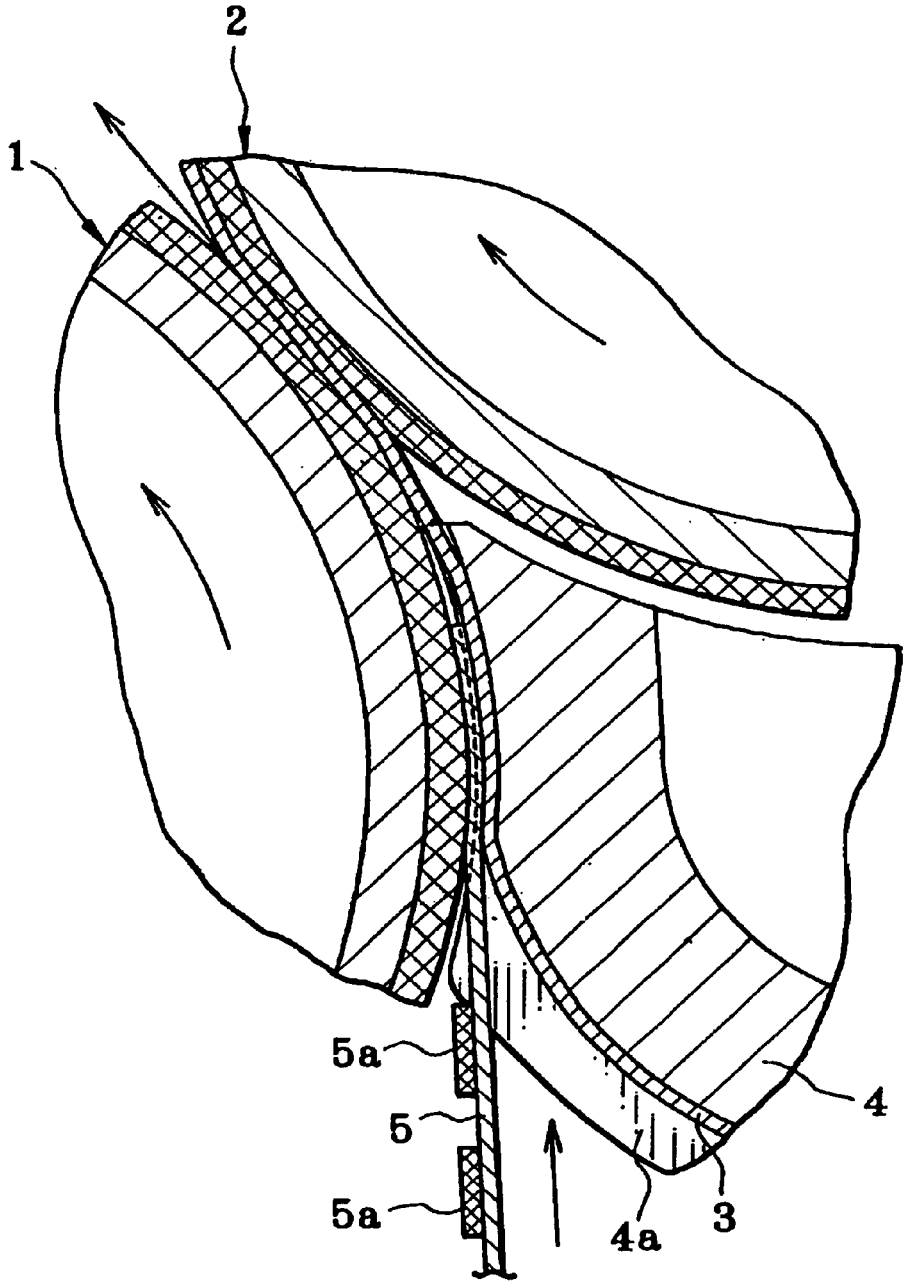
FIG. 23 is a partially enlarged sectional view showing the same structure of FIG. 22 in a state that a sheet medium passes.

FIG. 20 through FIG. 23 show details of the structure shown in FIGS. 19(A), 19(B). FIG. 20 is a sectional view taken along a line X—X and seen in a direction of arrows of FIG. 19(A), FIG. 21 is a partially enlarged sectional view showing a case that a heat-resistant belt 3 is omitted from the structure of FIG. 19(A). FIG. 22 is a partially enlarged sectional view showing a case that the beat-resistant belt 3 is installed to the structure of FIG. 21, and FIG. 23 is a partially enlarged sectional view showing the same structure of FIG. 22 in a state that a sheet medium passes.

In FIG. 20 and FIG. 21, the projecting wall 4*a* of the belt tensioning member 4 is positioned such that the projecting wall 4*a* is slidably in contact with the fuser roller 1 at a sliding surface 4*g*. Between the sliding surface 4*g* of the belt tensioning member 4 and a pressing surface 4*h* pressing the heat-resistant belt 3 to press the sheet medium 5 to the fuser roller 1, a gap (step) G which is larger than the thickness of the heat-resistant belt 3 is formed. The pressing surface 4*h* is formed concentrically with the fuser roller 1. Specifically, the gap is a step of the order of 110 $\mu$m and the heat-resistant belt 3 has a thickness of the order of 80 $\mu$m, thereby ensuring a space of the order of 30 $\mu$m and thus enabling stable fixing even with a sheet medium 5 having a thickness of the order of 60 $\mu$m.

FIG. 22 shows a state that the heat-resistant belt 3 is installed. The heat-resistant belt 3 is pressed by the nip portion between the fuser roller 1 and the pressure roller 2 and, on the upstream side relative to the nip, is wrapped around the fuser roller 1 so that the heat-resistant belt 3 is pressed against the fuser roller 1 at the start position of the nip.

The complete coincidence of the speed for the image forming process for forming an unfixed toner image 5*a* on a sheet medium 5 as the prior process of the fixing process and the speed for the fixing process is not realistic due to variation in dimensions of parts in view of mass production. The speeds for the prior and post process are balanced by setting the speed for the fixing process to be faster or slower as compared to the speed of the image forming process in consideration of the aforementioned variation. It is necessary to define the entering speed of the sheet medium 5 for securely griping the sheet medium 5 at the start position where the sheet medium enters into the fixing nip. This is achieved by the structure as mentioned above.

The surface of the elastic member 1*c* of the fuser roller 1 and the surface of the heat-resistant belt 3 move at the same peripheral velocity to fix the unfixed toner image 5*a*formed on the sheet medium 5. If the surface of the heat-resistant belt 3 is waved or a tip portion of the sheet medium 5 is waved, the start of fixing may be unstable. For this, by designing the heat-resistant belt 3 to be pressed against the fuser roller 1 at the start position of the nip, the point where the sheet medium 5 meets the heat-resistant belt 3 is stabilized, thereby enabling excellent stable fixing of the unfixed toner image 5*a*.

In this embodiment, there is the gap G between the heat-resistant belt 3 and the belt tensioning member 4 in the state that no sheet medium 5 passes. Therefore, during the warm-up time, the space of the gap G functions as a heat insulating layer to reduce the heat energy drawn from the fuser roller 1 via the heat-resistant belt 3, thereby reducing heat loss and thus shortening the warm-up time.

On the other hand, when the sheet medium 5 passes the fixing nip, as shown in FIG. 23, the projecting wall 4*a* of the belt tensioning member 4 is spaced apart from the fuser roller 1 and the gap G between the heat-resistant belt 3 and the belt tensioning member 4 disappears. The sheet medium 5 is pressed by the heat-resistant belt 3 at the fixing nip and pressed against the fuser roller 1. Accordingly, by adjusting the pressing force to a desired value by the spring 9 (FIG. 19(A)), suitable fixing can be achieved.

In addition, since the heat energy stored by the belt tensioning member 4, heated by the fuser roller 1, is small because of the gap G, the surface of the sheet medium 5 opposite to the surface on which the unfixed toner image 5*a* is formed cools the heat-resistant belt 3 having a small heat capacity when the sheet medium 5 enters into the fixing nip, while the heat energy heated by the belt tensioning member 4 is small. In case of double-sided fixing in which, after an unfixed toner image 5*a* on the first surface of the sheet medium 5 is fixed, another unfixed toner image 5*a* on the second surface opposite to the first surface is also fixed, there is therefore no risk of excessively heating the image on the first surface previously fixed and thus no risk of unsetting the image during the fixing for the second surface.

In this embodiment, as shown in FIG. 19(A), the spring 9 which functions as a swing assisting means is disposed on the upstream side in the traveling direction of the heat-resistant belt 3 relative to the pressed portion between the fuser roller 1 and the pressure roller 2 apart from the pivot of the belt tensioning member 4. As one of the fuser roller 1 and the pressure roller 2 is driven, the heat-resistant belt 3 is driven to travel. By the force of driving the heat-resistant belt 3 and the frictional force between the heat-resistant belt 3 and the belt tensioning member 4, the belt tensioning member 4 swings toward the fuser roller 1. However, only with this swinging force, the fixing pressure for fixing the unfixed toner image 5*a* formed on the sheet medium 5 may be insufficient. For this, the swinging force is assisted to obtain a desired fixing pressure, thereby enabling extremely stable fixing of the unfixed toner image 5*a*.

Figure 24C:
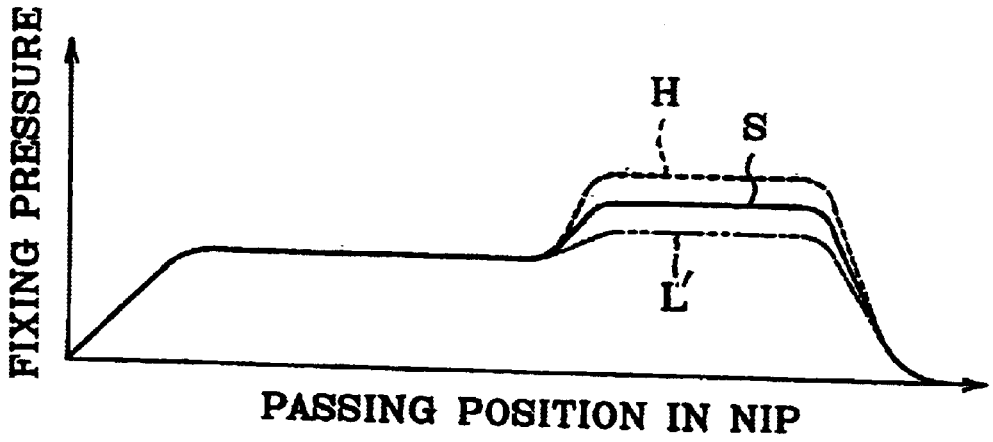
Figure 24D:
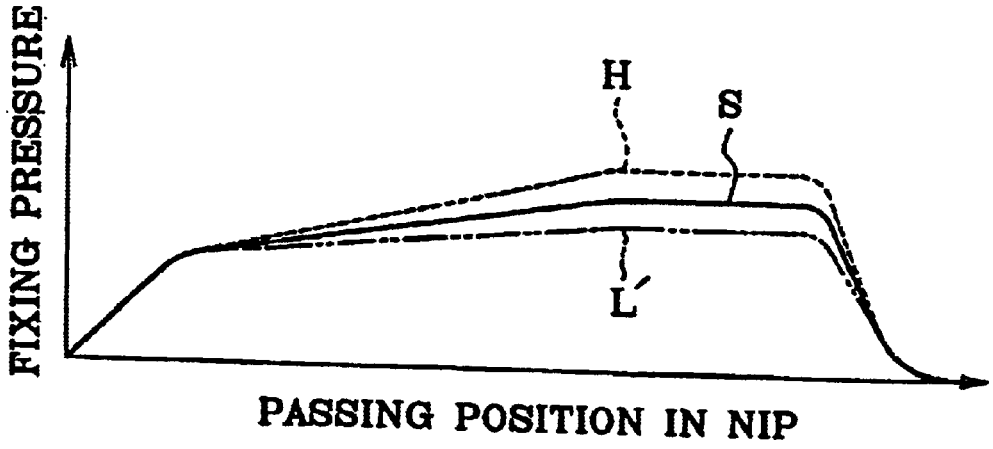

FIGS. 24(A)–24(D) are illustrations for explaining the features of this embodiment, wherein FIG. 24(A) is a sectional view, FIG. 24(B) is a graph showing variations in fixing pressure relative to passing position in the nip, FIG. 24(C) is a graph showing variations in fixing pressure by swinging force of a belt tensioning member 4 without assist, and FIG. 24(D) is a graph showing fixing pressure by swinging force with assist. In the graphs, H indicates a case of a thick sheet medium having larger heat capacity, a multi-layer sheet medium such as an envelope, or a transparent sheet medium (OHP sheet), S indicates a case of a standard sheet medium, and L indicates a case of a thin sheet medium or a sheet medium having poor heat resistance.

In this embodiment, since the spring 9 which functions as a swing assisting means is disposed on the upstream side in the traveling direction of the heat-resistant belt 3 relative to the pressed portion between the fuser roller 1 and the pressure roller 2 apart from the pivot of the belt tensioning member 4, the pressing force can be set to be increased successively from the start position of the nip toward the pressed portion between the fuser roller 1 and the pressure roller 2, because of the principle of leverage, so that there is no inflection point where different stress is applied to the sheet medium 5, thereby preventing the occurrence of unevenness of fixing to the fixed image. Therefore, the structure of this embodiment not only enables the extremely stable fixing of the unfixed toner image 5*a* but also prevents the deformation, such as curl and wrinkles, of the sheet medium 5 ejected after the unfixed toner image 5*a* is fixed.

Assuming that the pressing force at the start position of the nip is P1, the pressing force at the pressed portion where the pressure roller 2 presses the fuser roller 1 is P3, and the pressing force at a position between the start position of the nip and the pressed portions P2, the relation P1<P2<P3 is satisfied so that the pressing force P3 at the pressed portion where the pressure roller 2 presses the fuser roller 1 is the largest force. The fixing pressure (contact pressure distribution) between the fuser roller 1 and the heat-resistant belt 3 has the highest pressure at the pressed portion between the fuser roller 1 and the pressure roller 2. An unfixed toner image 5*a* can be sufficiently fused, thus achieving stable fixing. For example, in case of a sheet medium 5 which has a patterned indented surface or a sheet medium 5, such as an OHP sheet, which has an extremely flat surface and high airtightness so that a toner image hardly penetrates the sheet medium 5, pressure higher than that for fusing step is applied to the toner at the final step where the sheet medium 5 passes the nip, thereby making the surface of fused toner flat and facilitating the penetration of the toner into the sheet medium 5. Therefore, the fixed toner image can be further stabilized.

Figure 25A:
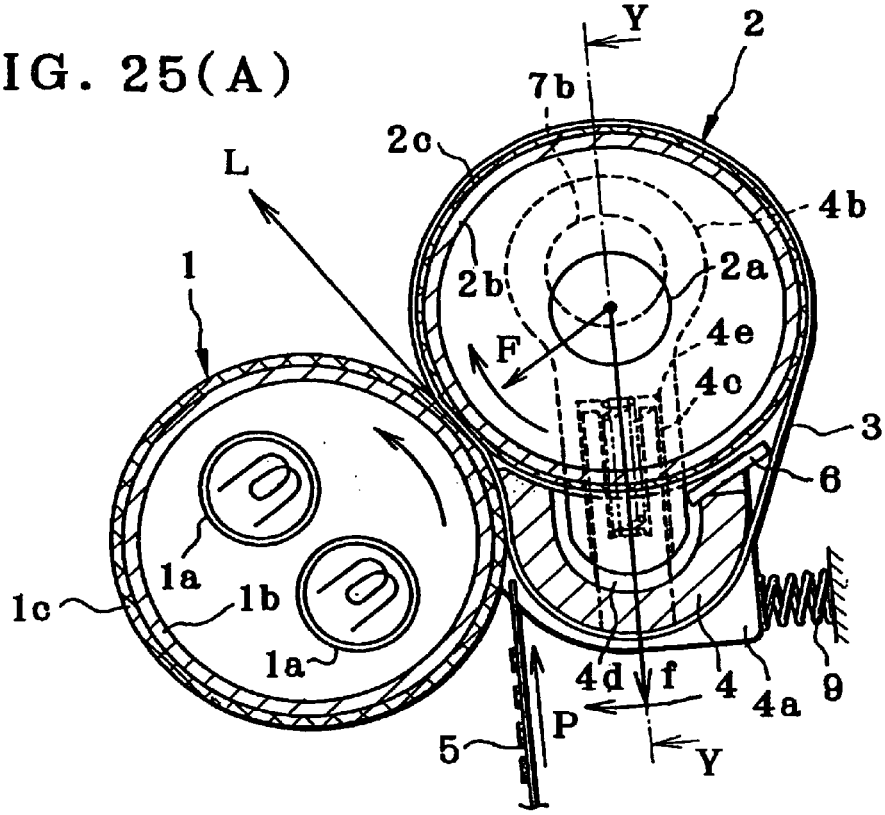
Figure 25B:
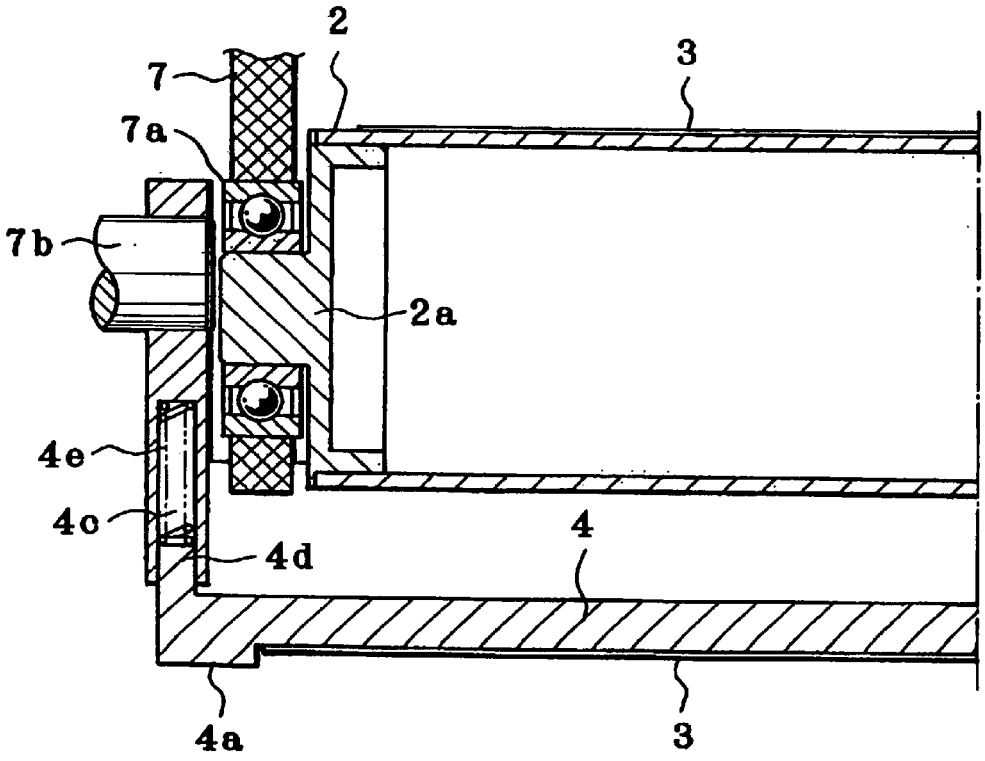

FIGS. 25(A), 25(B) show a variation example of the fixing device as shown in FIGS. 19(A), 19(B), wherein FIG. 25(A) is a sectional view and FIG. 25(B) is a sectional view taken along a line Y—Y and seen in a direction of arrows of FIG. 25(A). In the following description, the same elements as used in the aforementioned embodiments are identified with the same reference numerals and the description of such elements will be omitted.

A different point of this embodiment from the embodiment of FIGS. 19(A), 19(B) will be explained. Though the belt tensioning member 4 is designed to be able to swing for a predetermined angle about a shaft (not shown) which is common to the rotary shaft 2*a* of the pressure roller 2 in the embodiment of FIGS. 19(A), 19(B), the belt tensioning member 4 is designed to be able to swing for a predetermined angle about shaft 7*b* of which axis is different from the axis of the rotary shaft 2*a* of the pressure roller 2 in this example.

That is, swing arms 4*b* are rotatably fitted around the shaft 7*b* of which axis is disposed at a position different from the axis of the rotary shaft 2*a*. Each swing arm 4*b* is provided at the belt tensioning member side with a guide groove 4*c*. On the other hand, the belt tensioning member 4 is provided at both ends with guide portions 4*d* extending toward the pressure roller 2. The guide portions 4*d* are inserted into the guide grooves 4*c* of the swing arms 4*b* via springs 4*e*, respectively. Therefore, the belt tensioning member 4 is biased by the springs 4*e* in a direction getting away from the pressure roller 2 so that the tension "f" is applied to the heat-resistant belt 3.

By this arrangement, the torque acting on the belt tensioning member 4 can be changed (the torque is increased in an example shown in FIG. 25(A), 25(B)) so that the pressing force between the heat-resistant belt 3 and the fuser roller 1 can be controlled. Also in this example, a gap (step) G which is larger than the thickness of the heat-resistant belt 3 is formed between the sliding surface 4*g* of the belt tensioning member 4 and a pressing surface 4*h* pressing the heat-resistant belt 3 to press the sheet medium 5 to the fuser roller 1.

Figure 26:
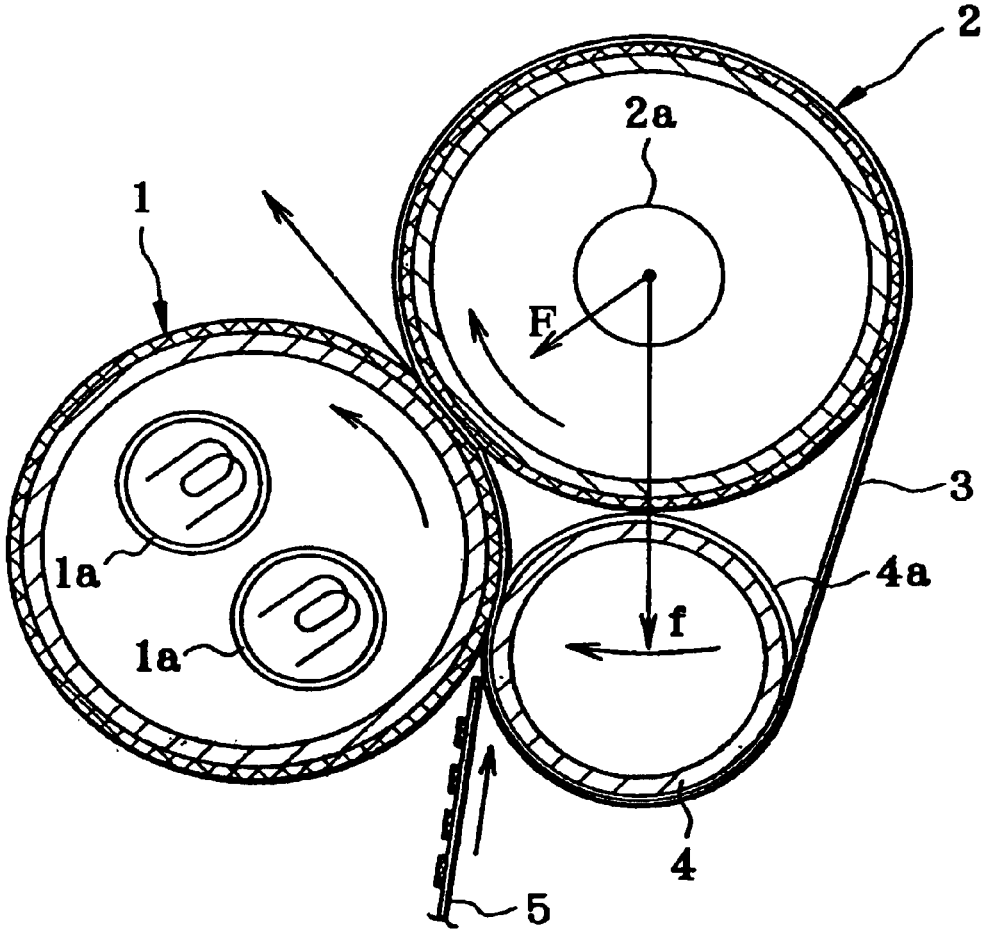
FIG. 26 is a sectional view showing a variation example of the fixing device as shown in FIGS. 19(A), 19(B)

FIG. 26 is a sectional view showing a variation example of the fixing device as shown in FIGS. 19(A), 19(B). In this example, the belt tensioning member 4 is composed of a non-rotatable member which is formed into a roller. Also in this example, a gap (step) G which is larger than the thickness of the heat-resistant belt 3 is formed between the sliding surface 4*g* of the belt tensioning member 4 and a pressing surface 4*h* pressing the heat-resistant belt 3 to press the sheet medium 5 to the fuser roller 1.

Figure 27A:
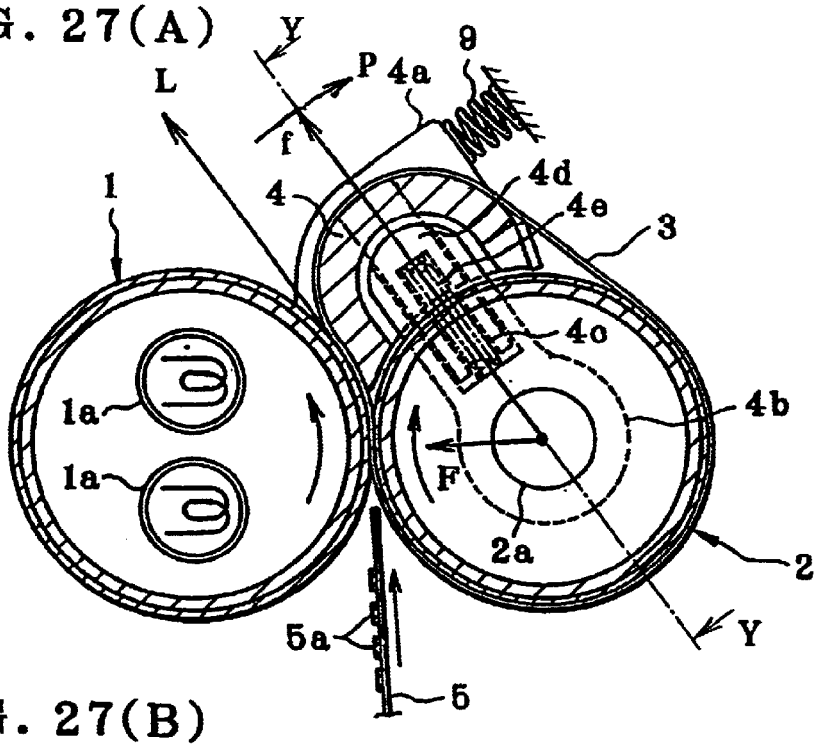
Figure 27B:
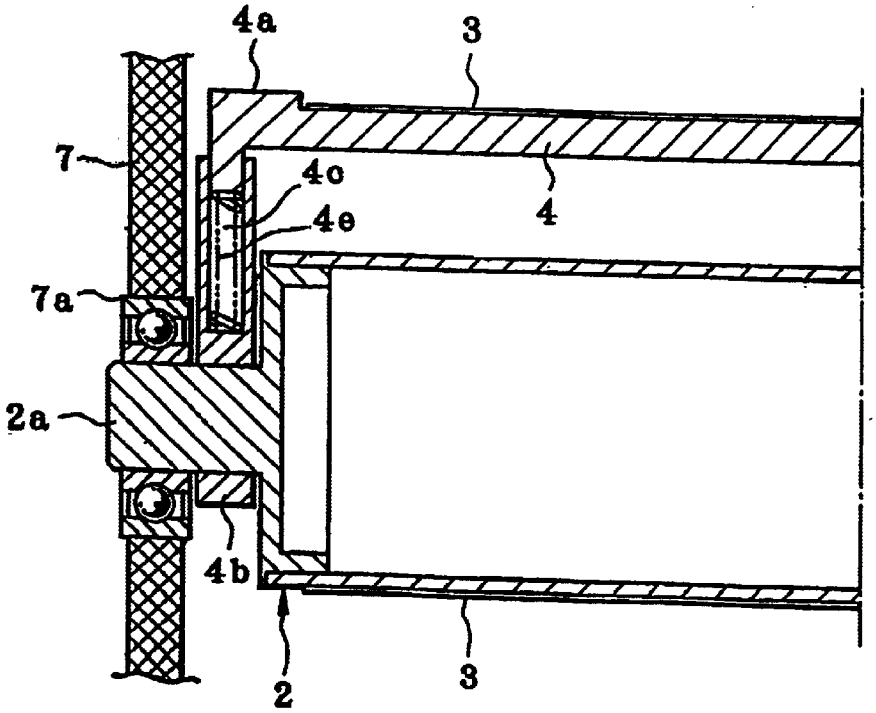

FIGS. 27(A)–29(B) show another embodiment of the fixing device according to the present invention, wherein FIG. 27(A) is a sectional view, FIG. 27(B) is a sectional view taken along a line Y—Y and seen in a direction of arrows of FIG. 27(A). FIGS. 28(A), 28(B) show the fixing device in a state that no sheet medium 5 passes, wherein FIG. 28(A) is a partially enlarged sectional view of FIG. 27(A), FIG. 28(B) is a sectional view taken along a line X—X and seen in a direction of arrows of FIG. 28(A). FIGS. 29(A), 29(B) show the fixing device in a state that a sheet medium 5 passes, wherein FIG. 29(A) is a partially enlarged sectional view of FIG. 27(A) and FIG. 29(B) is a sectional view taken along a line X—X and seen in a direction of arrows of FIG. 29(A). In the following description, the same elements as used in the aforementioned embodiments are identified with the same reference numerals and the description of such elements will be omitted.

Though the belt tensioning member 4 is arranged on the upstream side in the traveling direction of the heat-resistant belt 3 relative to the pressed portion between the fuser roller 1 and the pressure roller 2 in the aforementioned embodiments, the belt tensioning member 4 is arranged on the downstream side in the traveling direction of the heat-resistant belt 3 relative to the pressed portion between the fuser roller 1 and the pressure roller 2 so that the belt tensioning member 4 can swing about the rotary shaft 2*a* of the pressure roller 2 in a direction of arrow P in this embodiment The belt tensioning member 4 is a semilunar belt sliding member which is arranged inside the heat-resistant belt 3 to cooperate with the pressure roller 2 to apply tension "f" to the heat-resistant belt 3 and is arranged at such a position as to wrap the heat-resistant belt 3 around the fuser roller 1 partially for forming a nip. The belt tensioning member 4 is disposed at such a position as to border on the tangent L of the fuser roller 1 at the end position of the nip where the heat-resistant belt 3 is wrapped around the fuser roller 1.

The sheet medium 5 passes between the heat-resistant belt 3 and the fuser roller 1, wherein a portion at which the belt tensioning member 4 is pressed on the fuser roller 1 is the end position of the nip, whereby an unfixed toner image 5*a* on the sheet medium 5 is fixed. After that, the sheet medium 5 is ejected in the tangential direction L at the end position of the nip.

As shown in FIGS. 28(A), 28(B), a projecting wall 4*a* of the belt tensioning member 4 is positioned such that the projecting wall 4*a* is slidably in contact with the fuser roller 1 at a sliding surface 4*g*. Between the sliding surface 4*g* of the belt tensioning member 4 and a pressing surface 4*h* pressing the heat-resistant belt 3 to press the sheet medium 5 to the fuser roller 1, a gap (step) G which is larger than the thickness of the heat-resistant belt 3 is formed. The pressing surface 4*h* is formed concentrically with the fuser roller 1. Specifically, the gap G is a step of the order of 110 $\mu$m and the heat-resistant belt 3 has a thickness of the order of 80 $\mu$m, thereby ensuring a space of the order of 30 $\mu$m and thus enabling the stable fixing even with a sheet medium 5 having a thickness of the order of 60 $\mu$m.

The heat-resistant belt 3 is pressed at the nip portion between the fuser roller 1 and the pressure roller 2 and, on the downstream side from the nip portion, is wrapped around the fuser roller 1 so that the heat-resistant belt 3 is pressed against the fuser roller 1 at the end position of the nip.

In this embodiment, there is the gap G between the heat-resistant belt 3 and the belt tensioning member 4 in the state that no sheet medium 5 passes. Therefore, during the warm-up time, the space of the gap G functions as a heat insulating layer to reduce the heat energy drawn from the fuser roller 1 via the heat-resistant belt 3, thereby reducing heat loss and thus shortening the warm-up time.

On the other hand, when the sheet medium 5 passes the fixing nip, as shown in FIGS. 29(A), 29(B), the projecting wall 4*a* of the belt tensioning member 4 is spaced apart from the fuser roller 1 and the gap G between the heat-resistant belt 3 and the belt tensioning member 4 disappears. The sheet medium 5 is pressed by the heat-resistant belt 3 at the fixing nip and pressed against the fuser roller 1. Accordingly, by adjusting the pressing force to a desired value by the spring 9 (FIG. 19(A)), suitable fixing can be achieved.

In addition, since the heat energy stored by the belt tensioning member 4, heated by the fuser roller 1 is small because of the gap G, the surface of the sheet medium 5 opposite to the surface on which the unfixed toner image 5*a* is formed cools the heat-resistant belt 3 having a small heat capacity when the sheet medium 5 enters into the fixing nip, while the heat energy heated by the belt tensioning member 4 is small. In case of double-sided fixing in which, after an unfixed toner image 5*a* on the first surface of the sheet medium 5 is fixed, another unfixed toner image 5*a* on the second surface opposite to the first surface is also fixed, there is therefore no risk of excessively heating the image on the first surface previously fixed and thus no risk of unsetting the image during the fixing for the second surface.

As one of the fuser roller 1 and the pressure roller 2 is driven, the heat-resistant belt 3 is driven to travel. By the force of driving the heat-resistant belt 3 and the frictional force between the heat-resistant belt 3 and the belt tensioning member 4, the belt tensioning member 4 tends to swing in a direction getting away from the fuser roller 1. However, the belt tensioning member 4 is biased toward the fuser roller 1 with a predetermined biasing force of overcoming the swinging force of the belt tensioning member 4 and is preferably set to have a desired fixing pressure, thereby achieving extremely stable fixing of the unfixed toner image 5*a*.

In this embodiment, the spring 9 which functions as a swing assisting means is disposed on the downstream side in the traveling direction of the heat-resistant belt 3 relative to the pressed portion between the fuser roller 1 and the pressure roller 2 apart from the pivot of the belt tensioning member 4.

Figure 30A:
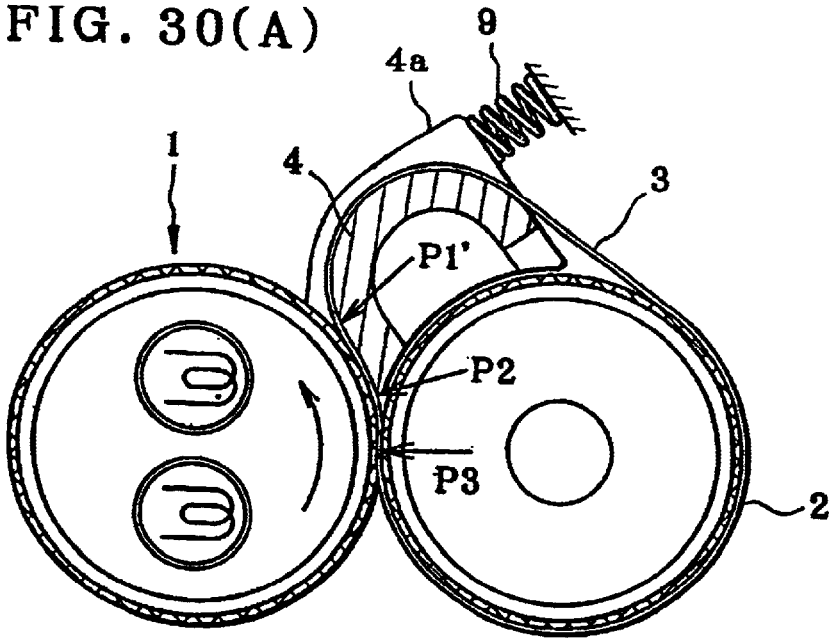
Figure 30B:
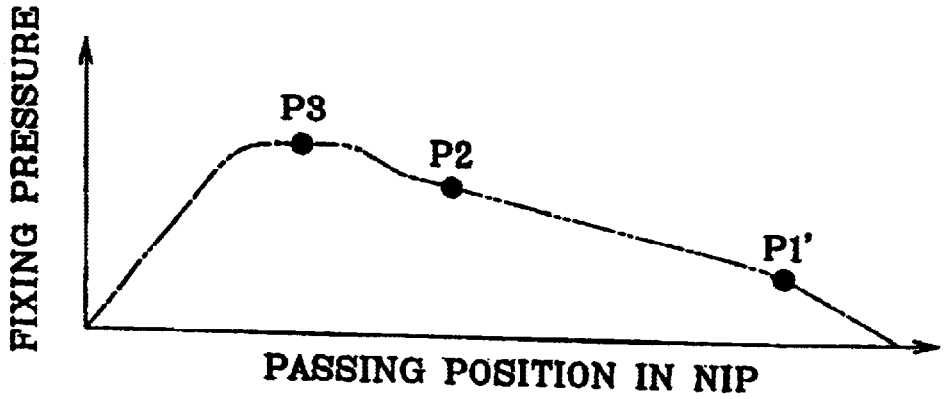
Figure 30C:
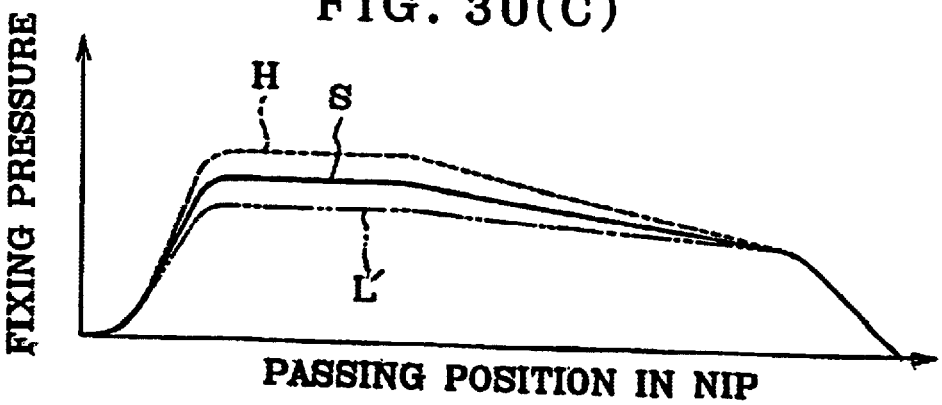

FIG. 30(A) is a sectional view, FIG. 30(B) is a graph showing variations in fixing pressure relative to passing position in the nip in a case that the swinging force of the belt tensioning member 4 is assisted, and FIG. 30(C) is a graph showing fixing pressures by a sheet medium 5 in a case that the swinging force of the belt tensioning member 4 is assisted. In the graphs, H indicates a case of a thick sheet medium having larger heat capacity, a multi-layer sheet medium such as an envelope, or a transparent sheet medium (OHP sheet), S indicates a case of a standard sheet medium, and L indicates a case of a thin sheet medium or a sheet medium having poor heat resistance.

In this embodiment, since the spring 9 is disposed on the downstream side in the traveling direction of the heat-resistant belt 3 relative to the pressed portion between the fuser roller 1 and the pressure roller 2 apart from the pivot of the belt tensioning member 4, the pressing force can be set to be reduced successively from the pressed portion between the fuser roller 1 and the pressure roller 2, because of the principle of leverage, so that there is no inflection point where different stress is applied to the sheet medium 5, thereby preventing the occurrence of unevenness of fixing to the fixed image. Therefore, the structure of this embodiment not only enables the extremely stable fixing of the unfixed toner image 5*a* but also prevents the deformation, such as curl and wrinkles, of the sheet medium 5 ejected after the unfixed toner image 5*a* is fixed.

Assuming that the pressing force at the end position of the nip is P1', the pressing force at the pressed portion where the pressure roller 2 presses the fuser roller 1 is P3, and the pressing force at a position between the end position of the nip and the pressed portion is P2, the relation P1'<P2<P3 is satisfied so that the pressing force P3 at the pressed portion where the pressure roller 2 presses the fuser roller 1 is the largest force.

Figure 31A:
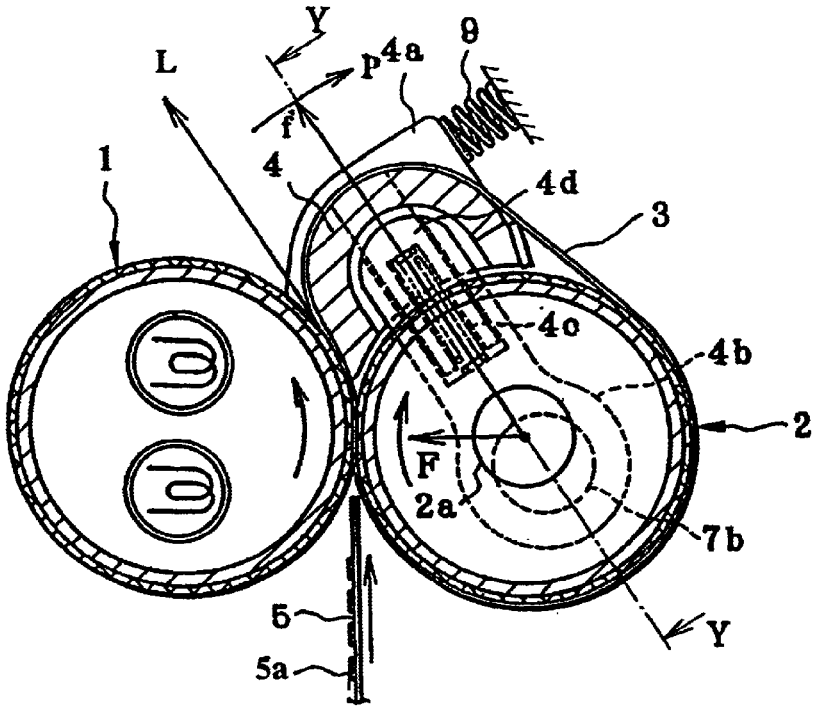
Figure 31B:
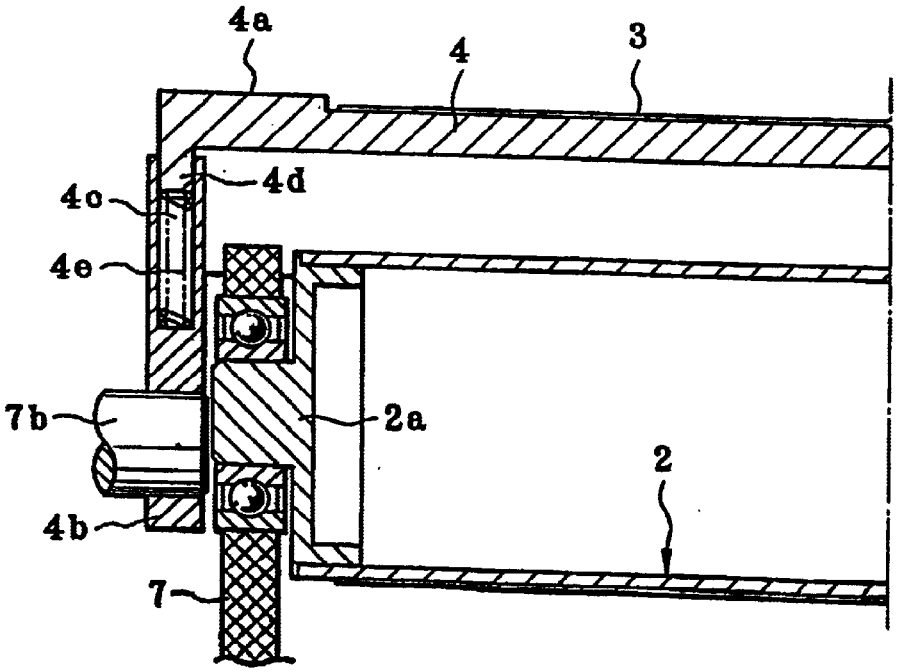

FIGS. 31(A), 31(B) show a variation example of the embodiment shown in FIGS. 27(A), 27(B), wherein FIG. 31(A) is a sectional view and FIG. 31(B) is a sectional view taken along a line Y—Y and seen in a direction of arrows of FIG. 31(A).

A different point of this embodiment from the embodiment of FIGS. 27(A), 27(B) will be explained. Though the belt tensioning member 4 is designed to be able to swing for a predetermined angle about a shaft (not shown) which is common to the rotary shaft 2*a* of the pressure roller 2 in the embodiment of FIGS. 27(A), 27(B), the belt tensioning member 4 is designed to be able to swing for a predetermined angle about shafts 7*b* of which axis is different from the axis of the rotary shaft 2*a* of the pressure roller 2 in this embodiment That is, swing arms 4*b* are rotatably fitted around the shafts 7*b* of which axis is disposed at a position different from the axis of the rotary shaft 2*a*. Each swing arm 4*b* is provided at the belt tensioning member 4 side with a guide groove 4*c*. On the other hand, the belt tensioning member 4 is provided at both ends with guide portions 4*d* extending toward the pressure roller 2. The guide portions 4*d* are inserted into the guide grooves 4*c* of the swing arms 4*b* via springs 4*e*, respectively. Therefore, the belt tensioning member 4 is biased by the springs 4*e* in a direction getting away from the pressure roller 2 so that the tension "f" is applied to the heat-resistant belt 3.

By this arrangement, the torque acting on the belt tensioning member 4 can be changed (the torque is increased in an example shown in FIG. 31(A), 31(B)) so that the pressing force between the heat-resistant belt 3 and the fuser roller 1 can be controlled.

In the present invention, either one of the fuser roller 1 and the pressure roller 2 is the driving roller. In this case, to realize the stable driving, it is preferable that the harder roller is used as the driving roller and softer roller is used as the driven roller. The pressure roller 2 around which the heat-resistant belt 3 is wound presses the heat-resistant belt 3 to the elastic member 1*c* layered on the outer surface of the fuser roller 1 and drives the heat-resistant belt 3 so that the fuser roller 1 is driven. Since the pressure roller 2 defines the feeding speed of the heat-resistant belt 3, that is, the sheet medium 5 having an unfixed toner image 5*a* thereon, the pressure roller 2 should be structured to have rigid surface at least harder than the elastic member 1*c* layered on the outer surface of the fuser roller 1. Accordingly, the driving with stable feeding speed can be achieved without deformation.

In the present invention, a combination of selection of the rotational speeds can be realized. Description will now be made as regard to the control for the driving speed. The driving means should provide two rotational speeds for driving the fuser roller 1 and the pressure roller 2. The fuser roller 1 and the pressure roller 2 are driven at a rotational speed selected from the first rotational speed and the second rotational speed, which is slower than the first rotational speed. A detecting means for detecting the sheet medium characteristics is provided and a setting means for setting selection information such as the rotational speed depending on the sheet medium characteristics is provided. As the sheet medium characteristics of a sheet medium 5 having an unfixed toner image 5*a* thereon is detected on the way of proceeding of the sheet medium 5, the setting depending on the sheet medium characteristics is made during the process of making a fixing command for the sheet medium 5 with the unfixed toner image 5*a* thereon. On the basis of the setting, the rotational speed is selected to drive the fuser roller 1 and the pressure roller 2. As the setting means, parts coupled to the fixing device of fuser roller type may be manually operated or the fixing device may be operated by remote control by means of electric signals, prior to the fixing command.

The sheet medium 5 having the unfixed toner image 5*a* thereon may be media for various uses including a normal sheet medium such as paper, a thick sheet medium having larger heat capacity, and a transparent sheet medium (OHP sheet). Especially, for the thick sheet medium having a larger heat capacity, a multi-layer sheet medium such as an envelope, and a transparent sheet medium (OHP sheet), a predetermined fusing time is required for sufficiently fusing and fixing the unfixed toner image 5*a* as compared to normal sheet media. For this, by selecting the first rotational speed or the second rotational speed which is slower than the first rotational speed for driving the fuser roller 1 and the pressure roller 2 depending on the sheet medium characteristics, the unfixed toner image 5*a* is suitably fused, thereby achieving desired fixing.

Even though the driving with selecting the first rotational speed or the second rotational speed is conducted, the stress on a sheet medium 5 having an unfixed toner image 5*a* thereon while passing between the fuser roller 1 and the heat-resistant belt 3 does not vary and is small, thereby preventing the deformation, such as wrinkles, of the sheet medium 5 ejected after the unfixed toner image 5*a* is fixed. Therefore, it is not required to increase the mechanical rigidity of the fixing device of fuser roller type. In addition, the thickness of the fuser roller 1 can be reduced, thereby improving the speed for heating up the heat-resistant belt 3 by the heat source. The thickness of the pressure roller 2 can also be reduced so as to allow smaller heat capacity. Accordingly, the heat energy absorbed from the heat-resistant belt 3 is small, thereby shortening the warm-up time from a time point at which the power is ON to a time point at which the fixing is enabled. As a means for driving with selectively changing the rotational speed, for example, a means for selectively changing the revolution speed of a driving motor is preferable.

Figure 32:
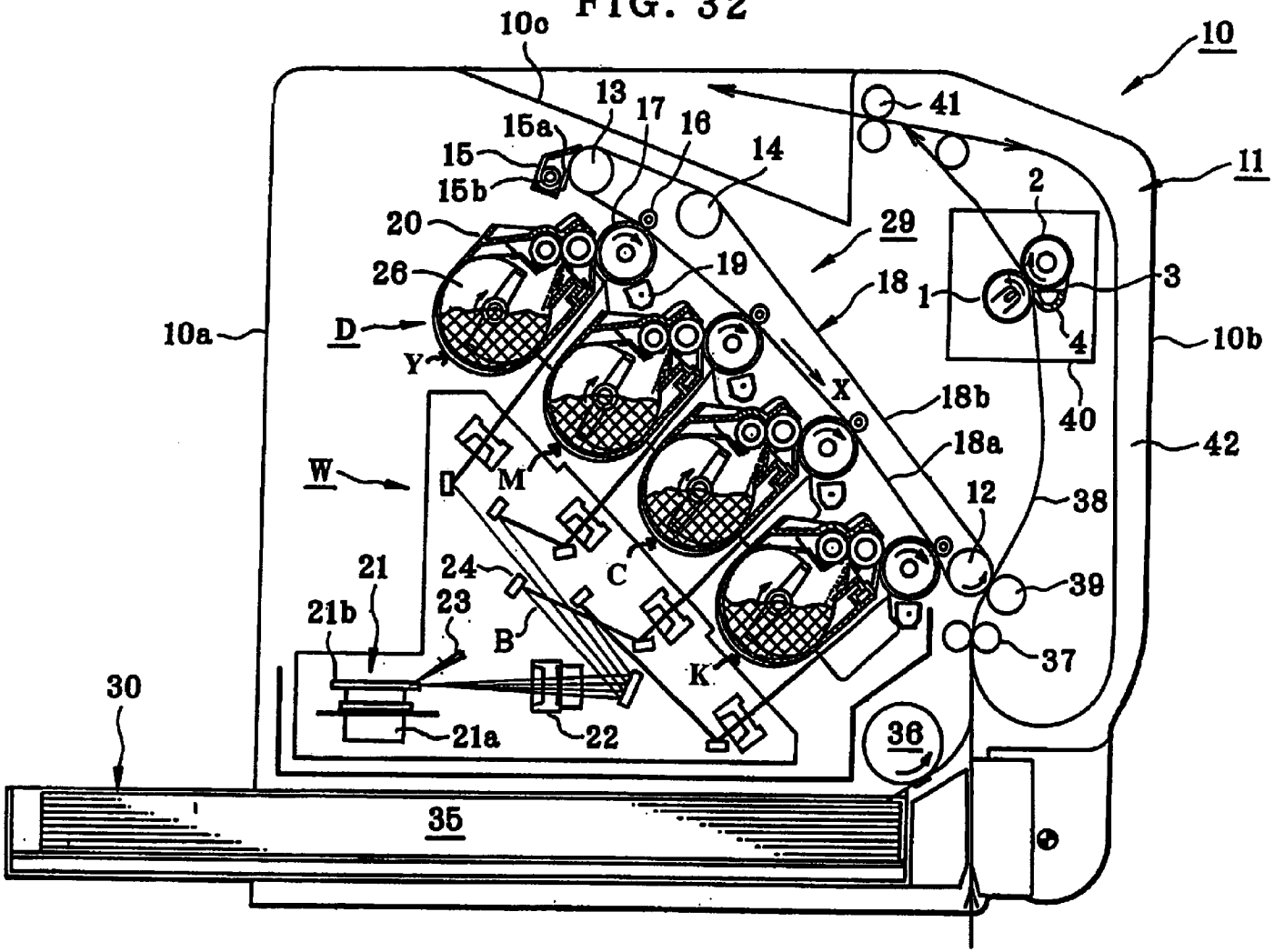
FIG. 32 is a schematic sectional view showing the entire structure of an embodiment of an image forming apparatus according to the present invention.
Figure 32:
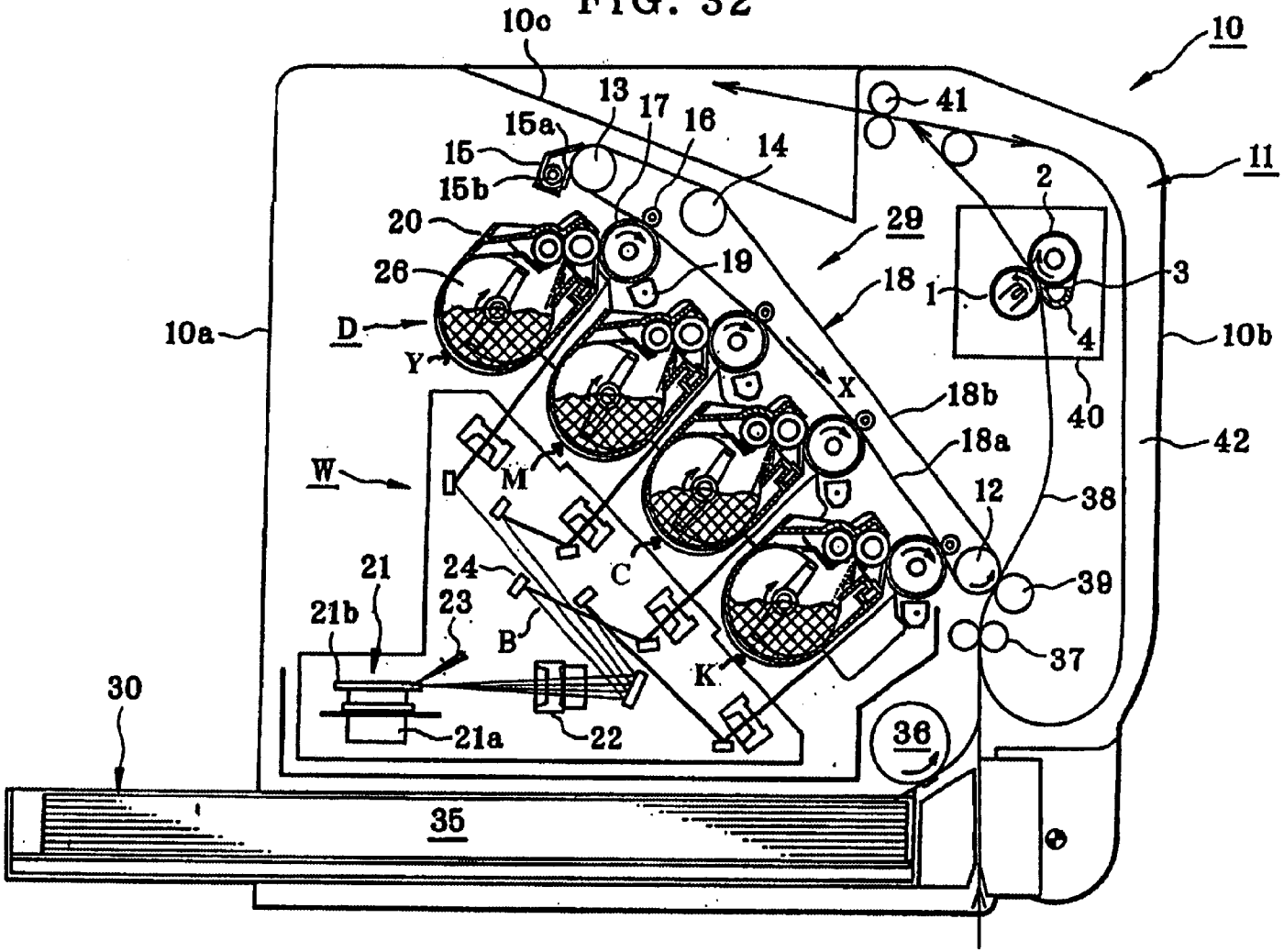

FIG. 32 is a schematic sectional view showing the entire structure of an embodiment of an image forming apparatus 10 according to the present invention. In FIG. 32, 10*a* designates a housing, 10*b* designates a door body, 11 designates a sheet handling unit, 15 designates a cleaning means, 17 designates image carriers, 18 designates an image transfer carrying belt, 20 designates a developing means, 21 designates a scanning means, 21*b* designates a polygon mirror, 29 designates a transfer belt unit, 30 designates a sheet supply unit, 40 designates a fixing means, W designates an exposure unit, and D designates an image forming unit.

In FIG. 32, the image forming apparatus 1 of this embodiment comprises the housing 10*a*, an outfeed tray 10*c* which is formed in the top of the housing 10*a*, a door body 10*b* which is attached to the front of the housing 10*a* in such a manner that the door body 10*b* is able to open or close freely. Arranged within the housing 10*a* are the exposure unit (exposure means) W, the image forming unit D, the transfer belt unit 29, and the sheet supply unit 30. Arranged inside the door body 10*b* is the sheet handling unit 11. The respective units are designed to be detachable relative to the apparatus 10. In this case, each unit can be detached from the apparatus 10 for the purpose of repair or replacement.

The image forming unit D comprises the image forming stations Y (for yellow), M (for magenta), C (for cyan), and K (for black) for forming multi-color images (in this embodiment, four-color images). Each image forming station Y, M, C, K has an image carrier 17 composed of a photosensitive drum, a charging means 19 composed of a corona charging means, and a developing means 20 which are arranged around the image carrier 17. The image forming stations Y, M, C, K are arranged along an arcuate oblique line below the transfer belt unit 29 such that the image carriers 17 are positioned at the upper side. It should be understood that the image forming stations Y, M, C, K may be arranged in any order.

The transfer belt unit 29 comprises a driving roller 12 which is disposed in a lower portion of the housing 10*a* and is driven by a driving means (not shown) to rotate, a driven roller 13 which is disposed diagonally above the driving roller 12, a backup roller (tension roller) 14, the image transfer carrying belt or means 18 which is laid around the three rollers with certain tension and is driven to circulate in a direction indicated by an arrow X (the counterclockwise direction), and the cleaning means 15 which abuts on the surface of the image transfer carrying means 18. The driven roller 13, the backup roller 14, and the image transfer carrying means 18 are arranged obliquely to the upper left of the driving roller 12. Accordingly, during the operation of the image transfer carrying means 18, a belt face 18*a* of which traveling direction X is downward takes a lower side and a belt face 18*b* of which traveling direction is upward takes an upper side.

Therefore, the image forming stations Y, M, C, K are arranged obliquely to the upper left of the driving roller 12. The respective image carriers 17 are aligned along an arcuate line to be pressed against the belt face 18*a*, of which traveling direction is downward, of the image transfer carrying means 18. Each image carrier 17 is driven to rotate in the traveling direction of the image transfer carrying means 18 as indicated by arrows. Since the image transfer carrying means 18 having an endless sleeve-like shape and having flexibility is disposed over the image carriers 17 such that the image transfer carrying means 18 is pressed against the image carriers 17 from above with the same wrapping angle, the pressure and the nip width between the image carriers 17 and the image transfer carrying means 18 can be adjusted by controlling the tension to be applied to the image transfer carrying means 18 by the tension roller 14, the distance between adjacent image carriers 17, and the wrapping angle (curvature of the arcuate line).

The driving roller 12 also functions as a backup roller for a secondary transfer roller 39. Formed on the peripheral surface of the driving roller 12 is, for example, a rubber layer which is 3 mm in thickness and $10^5\Omega$-cm or less in volume resistivity. The driving roller 12 has a metallic shaft which is grounded so as to function as a conductive path for secondary transfer bias supplied through the secondary transfer roller 39. Since the driving roller 12 is provided with the rubber layer having high friction and shock absorption, impact generated when a receiving medium is fed into a secondary transfer section is hardly transmitted to the image transfer carrying means 18, thereby preventing the deterioration of image quality. In addition, the diameter of the driving roller 12 is set to be smaller than the diameter of the driven roller 13 and also smaller than the diameter of the backup roller 14. This facilitates the separation of a receiving medium after secondary transfer because of the elastic force of the receiving medium itself. The driven roller 13 also functions as a backup roller for the cleaning means 15 described later.

It should be noted that the image transfer carrying means 18 may be arranged in an obliquely rightward direction relative to the driving roller 12 in the drawing. In this case, the respective image forming stations Y, M, C, K are arranged along an arcuate line extending in an obliquely rightward direction relative to the driving roller 12 in drawing. That is, these components may be arranged symmetrically with those in FIG. 32.

Examples of suitable materials of the image transfer carrying means are a PC resin, a PET resin, a polyimide resin, an urethane resin, a silicone resin, a polyester resin, a polyester resin, and the like. It should be understood that some suitable additives may be added in order to obtain desired characteristics such as conductivity, rigidity, surface roughness, friction coefficient, or the like. The rigidity can be set to a desired value also by controlling the thickness of the image transfer carrying means 18.

In this embodiment, the image transfer carrying means 18 is made of an urethane resin and a polyether resin to have relatively small rigidity so that neither permanent deformation nor creep is created, the tension is set to 40N by the biasing force F of the roller 2, and the wrapping angle a relative to the image carriers 17 is set to 4°. Accordingly, the contact pressure "f" acting on the nip portions is set in the order of 2.8N (=40N×sin 4°). In this manner, a stable transfer condition is obtained. In view of the aforementioned materials, it is confirmed that a desired transfer condition can be obtained by satisfying that the tension is set in a range of 10N–10N by the biasing force F of the roller 2 and that the wrapping angle $\alpha$ relative to the image carriers 17 is set in a range of 0.5°–15°.

Primary transfer members 16 are provided as transfer bias applying means for forming an image by sequentially transferring toner images to be superposed on each other and are disposed at positions to abut on the inner surface of the image transfer carrying means 18. There is no need to apply pressure to form transfer nips because the aforementioned contact pressures "f" are already applied. It is enough that the primary transfer members 16 lightly touch the image transfer carrying means 18 because the primary transfer members 16 just serve as means for ensuring energization. Therefore, each primary transfer member 16 may be a conductive roller to be driven by contact with the image transfer carrying means 18 or a rigid contact shoe, alternatively a conductive elastic member such as a plate spring, or a conductive brush made of fibers such as a resin. Accordingly, the sliding resistance between the primary transfer member 16 and the image transfer carrying means 18 should be small, thus not only increasing the lives of them but also reducing the manufacturing cost.

In the image forming apparatus 10 of this embodiment as mentioned above, the image carriers 17 are arranged in a line, and the endless sleeve-like image transfer carrying means 18 having flexibility is laid around at least two rollers 12, 13 and is arranged to be in contact with the image carriers 17 and to have substantially equal wrapping angles relative to the respective image carriers 17. A tension is applied to the image transfer carrying means 18 by either of the rollers 12, 13. Toner images on the image carriers 17 are transferred to the image transfer carrying means 18 and are sequentially superposed on each other. Accordingly, the substantially equal nips are easily formed at contact portions between the image carriers 17 and the image transfer carrying means 18 according to the substantially equal wrapping angles and the contact pressures at the contact portions are set substantially equal to each other according to the substantially equal wrapping angles.

As for the image carrier 17 and the image transfer carrying means 18 which is driven in the state abutting on the image carriers 17, the peripheral velocities at the contact portions are preferably the same. However, it is unrealistic that the peripheral velocities are completely set to the sane, because the peripheral velocities depend on variation in outer diameter and concentricity of image carriers 17 and/or concentricity of driving means, and variation in diameter of the driving roller 12 or variation of driving means for the image transfer carrying means 18 in mass production.

If the moving velocity of the image transfer carrying means 18 and the moving velocity of the image carriers 17 are set to be equal, these moving velocities may be faster or slower relative to the other because of the aforementioned variations in mass production. This is undesirable in setting the transfer conditions. The velocity difference is preferably set to be shifted to only one side relative to the image carriers 17. With excessive velocity difference, the position of a toner image may be shifted when the toner image carried by the image carrier 17 is transferred to the image transfer carrying means 18, thus making the image out of registration. Therefore, it is preferable to set as small velocity difference as possible.

For setting the image transfer carrying means 18 to have velocity difference to be shifted to one side relative to the plurality of image carriers 17, the abilities and the allowance limits of image registration error in mass production should be taken into consideration. Accordingly, it is preferable to set the velocity of the image transfer carrying means 18 to be in the order of ±(direction) 3±(variation) 2% relative to the moving velocity of the image carriers 17.

When the moving velocity of the image carriers 17 and the moving velocity of the image transfer carrying means 18 are equal to each other, toner images are transferred because of electric energy of the transfer biases. When the velocity difference as mentioned above is set, mechanical scrapping action is added to the electric energy, thereby improving the transfer efficiency. The process of cleaning residual toner remaining on the image carriers 17 after the transfer can be eliminated or simplified.

As a velocity difference is set between the moving velocity of the image carriers 17 and the moving velocity of the image transfer carrying means 18, looseness may be undesirably created between the image transfer carrying means 18 and the driving roller 12 or between the nip portions of the image transfer carrying means 18 relative to the image carriers 17. To avoid this problem, when the velocity of the image transfer carrying means 18 is shifted to be faster than that of the image carriers 17, the driving roller 12 for the image transfer carrying means 18 is located at the downstream side and, when the velocity of the image transfer carrying means 19 is shifted to be slower than that of the image carriers 17, the driving roller 12 for the image transfer carrying means 18 is located at the upstream side. This arrangement can prevent the creation of looseness and enables the setting of preferable transfer condition.

The cleaning means 15 is located at the belt face 18*a* side, of which traveling direction is downward. The cleaning means 15 comprises a cleaning blade 15*a* for removing toner remaining on the surface of the image transfer carrying means 18 after the secondary transfer, and a toner carrying member 15*b* for carrying collected toner. The cleaning blade 15*a* is in contact with the image transfer carrying means 18 at a position where the image transfer carrying means 18 is wrapped around the driven roller 13. On the back of the image transfer carrying means 18, the primary transfer members 16 are disposed and brought into contact with the back of the image transfer carrying means 18 at locations corresponding to image carriers 17 of respective image forming stations Y, M, C, and K, described later. A transfer bias is applied to each primary transfer member 16.

The exposure unit W is disposed in a space formed obliquely below the image forming unit D which is arranged obliquely. The sheet supply unit 30 is disposed below the exposure unit W and at the bottom of the housing 10*a*. The exposure unit W has a casing for accommodating the entire exposure unit W which is arranged in a space formed obliquely below the belt face of which traveling direction is downward. At the bottom of the casing, a single scanning means 21, composed of a polygon mirror motor 21*a* and the polygon mirror 21*b*, is disposed horizontally. In an optical system B, laser beams from a plurality of laser beam sources 23 are directed to the image carriers 17 after being reflected at the polygon mirror 21*b*. In the optical system B, a single f-θ lens 22 and reflective mirrors 24 are disposed to make scanning lines for respective colors which are not parallel to each other toward the image carriers 17.

In the exposure unit W having the aforementioned structure, image signals corresponding to the respective colors are formed and modulated according to the common data clock frequency and are then radiated as laser beams from the polygon mirror 21*b*. The radiated image signals are aimed to the image carriers 17 of the image forming stations Y, M, C, K via the f-θ lens 22 and the reflective mirrors 24, thereby forming latent images. By providing the reflective mirrors 24, the scanning lines y, m, c, k are bent, thereby lowering the height of the casing and thus making the apparatus 10 compact. The reflective mirrors 24 are arranged in such a manner as to make the respective lengths of the scanning lines to the image carriers 17 of the image forming stations Y, M, C, K equal to each other. Since the respective lengths of the scanning lines (optical paths) from the polygon mirror 21*b* of the exposure unit W to the image carriers 17 are designed equal to each other, the scanning widths of light beams are also substantially equal to each other. Therefore, no special structure for forming the image signals is required. Though the laser beam sources 23 must be modulated to correspond to images of different colors according to different image signals, respectively, the laser beam sources 23 can be modulated based on a common data clock frequency. Since a common reflection facet is used, the occurrence of color registration error caused by relative shifts in the sub scanning direction can be prevented. Therefore, this achieves the production of a cheaper multicolor image forming apparatus with simple structure.

In this embodiment, the scanning optical system B is arranged at a lower side of the apparatus 10, thereby minimizing the vibration of the scanning optical system B due to vibration of the driving system of the image forming unit D which affects the frame supporting the apparatus 10 and thus preventing the deterioration of image quality. In particular, by arranging the scanning means 21 at the bottom of the casing, vibration of the polygon motor 21*a* affecting the casing can be minimized, thereby preventing the deterioration of image quality. Since only a single polygon motor 21*a* is provided which is a source of vibration, vibration affecting the casing can be minimized.

In this embodiment, the respective image forming stations Y, M, C, K are arranged obliquely and the image carriers 17 are arranged along an arcuate oblique line at the upper side. Since the image carriers 17 are in contact with the belt face 18*a*, of which traveling direction is downward, of the image transfer carrying means 18, toner containers 26 are arranged obliquely downward to the lower left of the image carriers 17.

The sheet supply unit 30 comprises a sheet cassette 35 in which a pile of receiving media are held, and a pick-up roller 36 for feeding the receiving media from the sheet cassette 35 one by one. The sheet handling unit 11 comprises a pair of gate rollers 37 (one of which is positioned on the housing side) for regulating the feeding of a receiving medium to the secondary transfer portion at the right time, the secondary transfer roller 39 as a secondary transfer means abutting and pressed against the driving roller 12 and the image transfer carrying means 18, a sheet feeding passage 38, the fixing means 40, a pair of outfeed rollers 41, and a dual-side printing passage 42.

A secondary image secondarily transferred to the receiving medium is fixed to the receiving medium at the nip portion formed by the fixing means 40 at a predetermined temperature. In this embodiment, the fixing means 40 can be arranged in a space formed obliquely above the belt face 18*b*, of which traveling direction is upward, of the image transfer carrying means 18, that is, a space formed on the opposite side of the image forming stations relative to the transfer belt (the image transfer carrying means 18). This arrangement enables the reduction in heat transfer to the exposure unit W, the image transfer carrying means 18, and the image forming unit D and lessens the frequency of taking the action for correcting color registration error. In particular, the exposure unit W is positioned farthest from the fixing means 40, thereby minimizing the deformation of the scanning optical components due to heat and thus preventing the occurrence of color registration error.

In this embodiment, since the image transfer carrying means 18 is disposed to be inclined relative to the driving roller 12, a large space is created on the right side of the image transfer carrying means 18 in the drawing. The fixing means 40 can be disposed in the space, thereby achieving the reduction in size of the apparatus 10. This arrangement also prevents the heat generated by the fixing means 40 from being transferred to the exposure unit W, the image transfer carrying means 18, and the respective image forming stations Y, M, C, K which are located in the left side portion of the apparatus 10. Since the exposure unit W can be located in a space on the lower left side of the image forming unit D, the vibration of the scanning optical system of the exposure unit W due to vibration of the driving system of the image forming unit D can be minimized and the deterioration of image quality can be prevented.

Further, in this embodiment, by employing spheroidized toner, the primary transfer efficiency is increased (approximately 100%). Therefore, no cleaning means for collecting residual toner after the primary transfer is used for the respective image carriers 17. Accordingly, the image carriers 17 composed of a photosensitive drum of which diameter is 30 mm or less can be arranged closely to each other, thereby reducing the size of the apparatus 10.

Because no cleaning device is used, the corona charging means 19 is employed as a charging means. When the charging means is a roller, residual toner after the primary transfer on the image carrier 17 (the amount of which should be small) is deposited on the roller, leading to insufficient charging. On the other hand, since the corona charging means 19 is a non-contact charging means, toner hardly adheres to the image carriers 17, thereby preventing the occurrence of insufficient charging.

Though the image transfer carrying means 18 is structured as an intermediate transfer belt to be in contact with the image carriers 17 in the aforementioned embodiments, the image transfer carrying means 18 may be structured as a sheet carrying belt to be in contact with the image carriers 17 in which the sheet carrying belt carries a sheet thereon and toner images are transferred and superposed on the sheet one by one, thereby forming an image. In this case, the different point from the aforementioned embodiments is the traveling direction of the sheet carrying belt as the image transfer carrying means 18. The traveling direction of the lower surface of the sheet carrying belt, where the image carriers 17 are in contact with, is upward, which is opposite to the direction of the aforementioned embodiments.

The actions of the image forming apparatus 10 as a whole will be summarized as follows:

(1) As a printing command (image forming signal) is inputted into the control unit of the image forming apparatus 10 from a host computer (personal computer) (not shown) or the like, the image carriers 17 and the respective rollers of the developing means 20 of the respective image forming stations Y, M, C, K, and the image transfer carrying means 18 are driven to rotate.

(2) The outer surfaces of the image carriers 17 are uniformly charged by the charging means 19.

(3) In the respective image forming stations Y, M, C, K, the outer surfaces of the image carriers 17 are exposed to selective light corresponding to image information for respective colors by the exposure unit W, thereby forming electrostatic latent images for the respective colors.

(4) The electrostatic latent images formed on the image carriers 17 are developed by the developing means 20 to form toner images.

(5) The primary transfer voltage of the polarity opposite to the polarity of the toner is applied to the primary transfer members 16 of the image transfer carrying means 18, thereby transferring the toner images formed on the image carriers 17 onto the image transfer carrying means 18 one by one. According to the movement of the image transfer carrying means 18, the toner images are superposed on the image transfer carrying means 18.

(6) In synchronization with the movement of the image transfer carrying means 18 on which primary images are transferred, a receiving medium accommodated in the sheet cassette 35 is fed to the secondary transfer roller 39 through the pair of resist rollers 37.

(7) The primary-transferred image meets with the receiving medium at the secondary transfer portion. A bias of the polarity opposite to the polarity of the primary transfer image is applied by the secondary transfer roller 39 which is pressed against the driving roller 12 for the image transfer carrying means 18 by a pressing mechanism (not shown), whereby the primary-transferred image is secondarily transferred to the receiving medium fed in the synchronization manner.

(8) Residual toner after the secondary transfer is carried toward the driven roller 13 and is scraped by the cleaning means 15 disposed opposite to the driven roller 13 so as to refresh the image transfer carrying means 18 to allow the above cycle to be repeated.

(9) The receiving medium passes through the fixing means 40, whereby the toner image on the receiving medium is fixed. After that, the receiving medium is carried toward a predetermined position (toward the outfeed tray 10*c* in case of single-side printing, or toward the dual-side printing passage 42 in case of dual-side printing).

Figure 33:
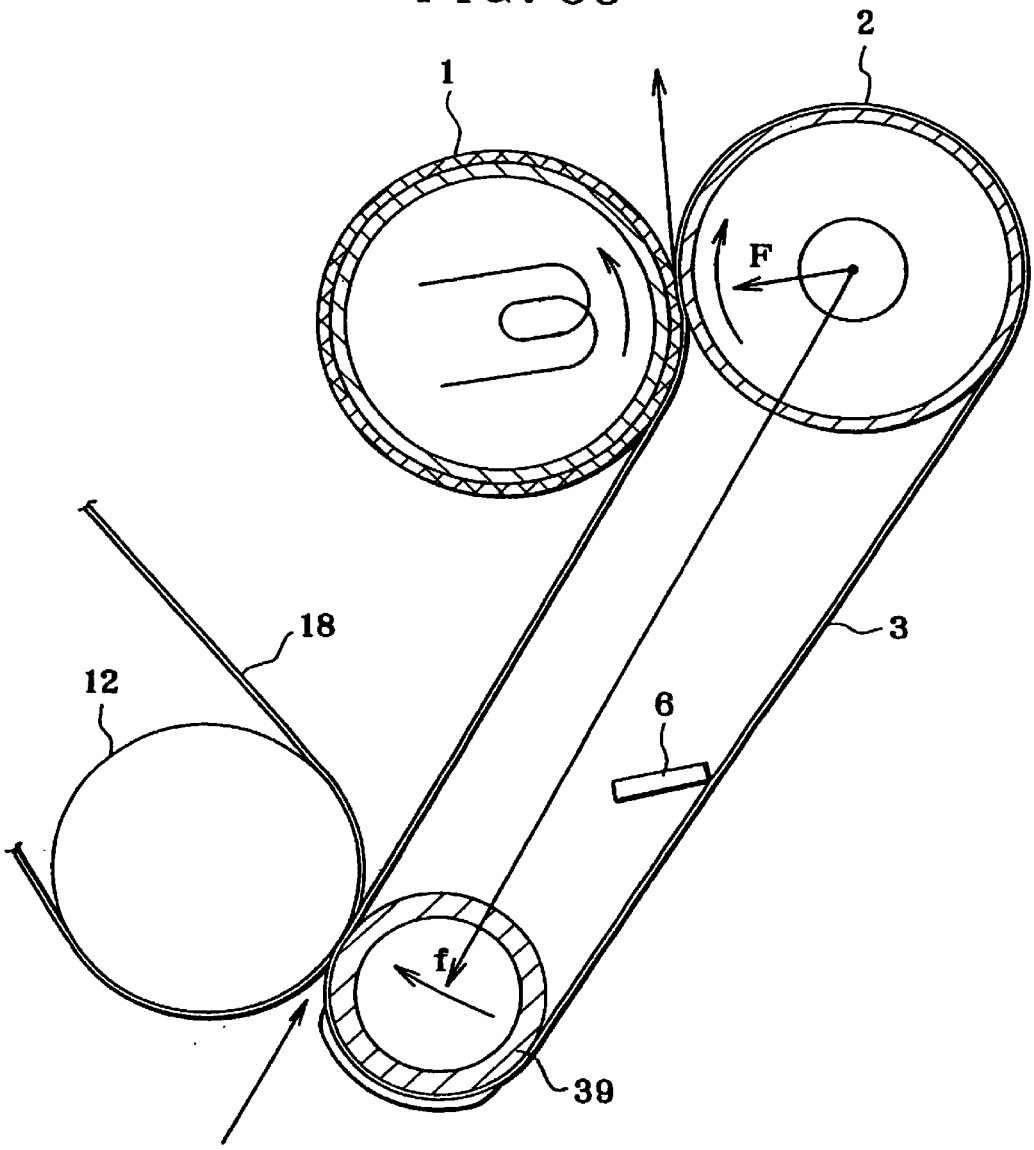
FIG. 33 is an illustration showing another embodiment of the fixing device according to the present invention, in which a secondary transfer roller is used to function as the belt tensioning member.
Figure 34:
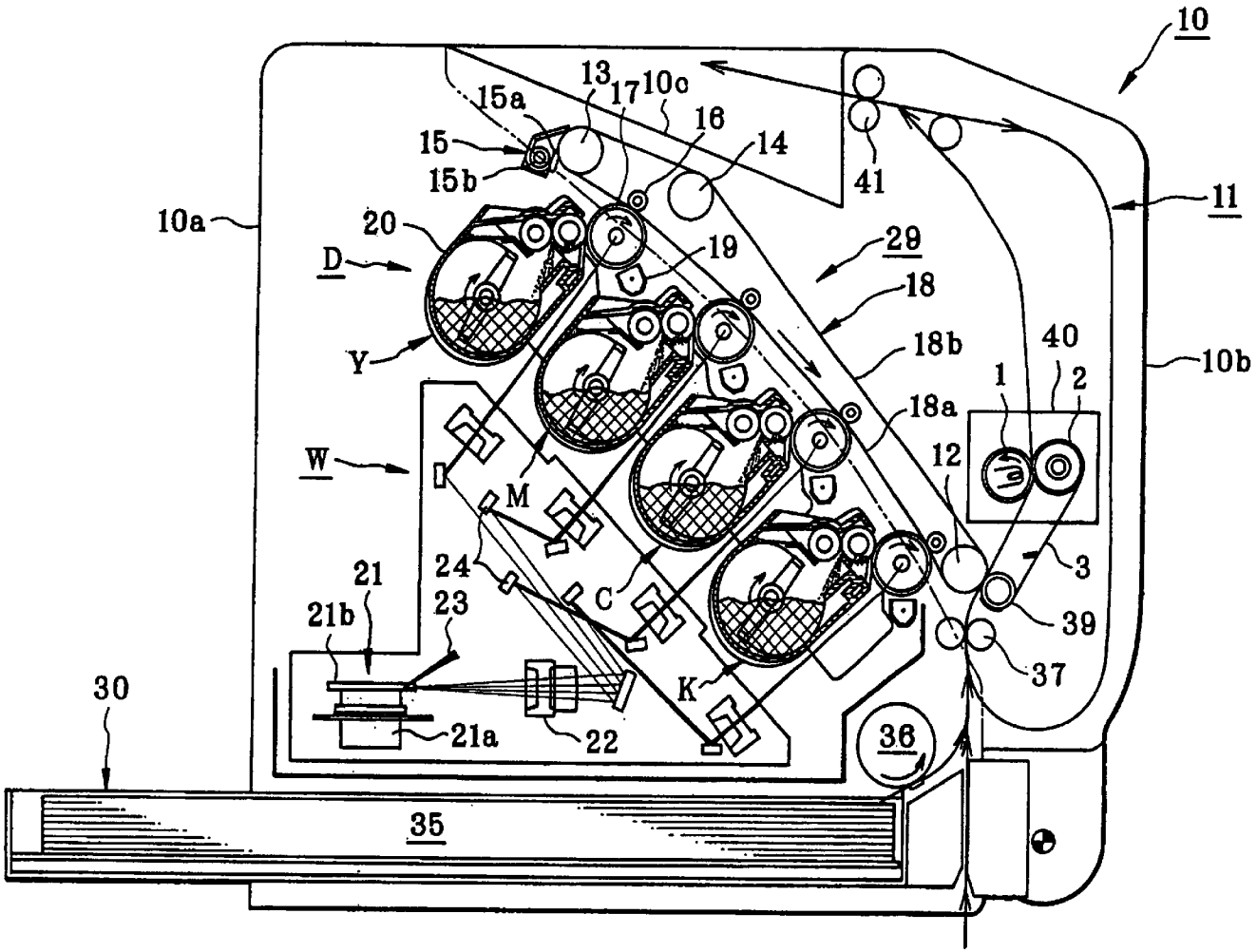
FIG. 34 is an illustration showing another embodiment of the image forming apparatus according to the present invention employing a fixing device in which a secondary transfer roller is used to function as the belt tensioning member.

FIG.33 is an illustration showing another embodiment of the fixing device according to the present invention, in which a secondary transfer roller 39 is used to function as the belt tensioning member too, and FIG. 34 is an illustration showing another embodiment of the image forming apparatus 10 according to the present invention employing a fixing device in which a secondary transfer roller 39 is used to function as the belt tensioning member too.

In FIG. 33 and FIG. 34, a secondary transfer roller 39 is designed to also function as a belt tensioning member and is arranged to face the image transfer carrying means 18, as a toner image carrying member for carrying a toner image thereon, via a heat-resistant belt 3. The heat-resistant belt 3 has electrical conductivity. A transfer bias applying means is provided for applying a transfer bias to the secondary transfer roller 39 also functions as the belt tensioning member in order to transfer an unfixed toner image from the image transfer carrying means 18 to a sheet medium. The heat-resistant belt 3 and the secondary transfer roller 39 move in a direction of getting away from the image transfer carrying means 18 when the driving of the heat-resistant belt 3 is stopped. For this, the secondary transfer roller 39 is arranged at a position that the secondary transfer roller 39 moves in the direction of getting away from the fuser roller 1 because of own weight, for example.

Because of the residual heat of the heat-resistant belt 3 heated by the fuser roller 1 at the contact portion between the heat-resistant belt 3 and the image transfer carrying means 18, the image transfer carrying means 18 should be affected by the heat more than a little. However, as the heat-resistant belt 3 is structured to have a thickness of the order of 0.08 mm and thus have extremely small heat capacity, the heat-resistant belt 3 is subjected to natural heat release and is thus cooled while the heat-resistant belt 3 is driven by the pressure roller 2 and reaches the image transfer carrying means 18. Therefore, the heat balance without practical problem can be set. In this case, the secondary transfer roller 39 as the belt tensioning member 4 is structured such that the belt tensioning member can swing for a predetermined angle about a shaft which is common to the rotary shaft 2*a* of the pressure roller 2, the heat-resistant belt 3 and the belt tensioning member pivotally move the shaft, which is common to the rotary shaft 2*a* of the pressure roller 2, by frictional force between the heat-resistant belt 3 driven by the rotation of the pressure roller 2 and the belt tensioning member so that the belt tensioning member stops in the state that rotational force caused by the aforementioned frictional force and pressing force of the image transfer carrying means 18 balanced.

That is, regardless of when a sheet medium with an unfixed toner image passes between the image transfer carrying means 18 and the heat-resistant belt 3 and when no sheet medium passes between the image transfer carrying means 18 and the heat-resistant belt 3 and regardless of thickness of the sheet medium, the pressing force between the heat-resistant belt 3 and the image transfer carrying means 18 is constant so that the stress on the passing sheet medium 5 can be constant. Accordingly, the sheet medium ejected after the unfixed toner image is fixed is prevented from being deformed such as having wrinkles.

The pressing force between the heat-resistant belt 3 and the fuser roller 1 can be suitably set by setting the rotational frictional force between the beat-resistant belt 3 and the secondary transfer roller 39 as the belt tensioning member. If the pressing force becomes insufficient when a toner image is transferred from the image transfer carrying means 18 to the sheet medium, an assisting force is applied in a direction of increasing the pressing force.

Because the heat-resistant belt 3 and the secondary transfer roller 39 have transfer function and a sheet medium passing the image transfer carrying means 18 adheres to the heat-resistant belt 3 because of electrostatic attraction, the carrying and the entrance into the nip relative to the fuser roller 1 are stable and there is no jamming trouble of sheet medium during the process from the transferring portion to the fixing portion.

The secondary transfer roller 39 is arranged inside the heat-resistant belt 3 to cooperate with the pressure roller 2 to apply tension to the heat-resistant belt 3 and is arranged at such a position as to wrap the heat-resistant belt 3 around the fuser roller 1 partially for forming a nip. Relative to this arrangement, the secondary transfer roller 39 is arranged to face the image transfer carrying means 18 and the pressure roller 2 is located at a position relative to the secondary transfer roller 39 such that the heat-resistant belt 3 is wrapped around the fuser roller 1 to form a nip at the upstream side in the traveling direction of the sheet medium, that is, a position apart from the gravitational position of the secondary transfer roller 39, whereby, when the driving of the heat-resistant belt 3 is stopped, the secondary transfer roller 39 and the heat-resistant belt 3 move in a direction of getting away from the image transfer carrying means 18 because of the tensioning action of the heat-resistant belt 3 and the own weight of the secondary transfer roller 39. Therefore, when carrying trouble of sheet media such as jamming occurs, the process for clearing the jamming can be easily conducted.

While the present invention has been described with reference to particular embodiments, the present invention is not limited thereto and conventionally known techniques and publicly known techniques may be replaced or added to the embodiments.

As apparent from the above description, according to the present invention, the heat-resistant belt 3 is tensioned by the cooperation between the pressure roller 2 and the belt tensioning member 4 and is wrapped around the fuser roller 1 to form the nip, thereby easily achieving the structure having longer nip length, simplifying the structure, and reducing the size and the cost. In addition, by employing a heat-resistant belt sliding member as the belt tensioning member 4, bearings are not required and the supporting structure can be simple. By forming the belt tensioning member 4 into a semilunar shape, the belt tensioning member 4 is disposed such that the subtense of the semilunar shape faces the pressure roller 2, thereby enabling such an arrangement that the belt tensioning member 4 is positioned close to the pressure roller 2 to the utmost limit. This also enables the shortening of peripheral length of the heat-resistant belt 3. Therefore, the fixing device of fuser roller type can be manufactured to have simple structure and small size at low cost. Further, since the heat-resistant belt 3 travels the minimum path, the heat-resistant belt 3 is heated at the nip by the rotatable fuser roller 1 having the built-in heat source and the heat energy drawn during the traveling along a predetermined path can be minimized. In addition, since the peripheral length is short, the temperature drop due to natural beat release can be reduced thereby shortening the required warm-up time from a time point at which the power is ON to a time point at which the fixing is enabled.

Furthermore, for stably fixing an unfixed toner image formed on a sheet medium, it is necessary to sufficiently fuse and fix the unfixed toner image so that predetermined temperature and fixing period of time are required. According to the structure of the present invention, it is not required to provide a means for largely deforming the elastic member 1*c* on the surface of the fuser roller 1 to lengthen the nip length, thus enabling the design of elastic member 1*c* having a smaller thickness. In addition, it is not required to set the pressing force of the pressure roller 2 to be so large as to deform the elastic member 1*c*. Therefore, the stress on the sheet medium when the sheet medium having an unfixed toner image thereon passes between the fuser roller 1 and the heat-resistant belt 3 is small, thereby preventing the deformation, such as curl and wrinkles, of the sheet medium ejected after the unfixed toner image is fixed.

That is, it is not required to increase the mechanical rigidity of the fixing device of fuser roller type. In addition, the thickness of the fuser roller 1 can be reduced, thereby improving the speed for heating up the heat-resistant belt 3 by the heat source. The thickness of the pressure roller 2 can also be reduced so as to allow smaller heat capacity. Accordingly, the heat energy absorbed from the heat-resistant belt 3 is small, thereby shortening the warm-up time from a time point at which the power is ON to a time point at which the fixing is enabled.

By setting the wrapping angle between the heat-resistant belt 3 and the belt tensioning member 4 to be smaller than the wrapping angle between the heat-resistant belt 3 and the pressure roller 2 or setting the diameter of the belt tensioning member 4 to be smaller than the diameter of the pressure roller 2, the wrapping length between the heat-resistant belt 3 and the belt tensioning member 4 becomes smaller than the wrapping length between the heat-resistant belt 3 and the pressure roller 2 so that the peripheral length of the heat-resistant belt 3 is shortened and the heat-resistant belt 3 is designed to travel the minimum path. As the peripheral length of the heat-resistant belt 3 is shortened and the heat-resistant belt 3 is designed to travel the minimum path, many effects are expected as follows. The fixing device of fuser roller type can be manufactured to have simple structure and reduced size at low cost. Further, the heat energy drawn from the heat-resistant belt 3, which was heated between the fuser roller 1 and the nip, during the traveling along a predetermined path can be minimized. Furthermore, the temperature drop due to natural heat release can be reduced, thereby shortening the required warm-up time from a time point at which the power is ON to a time point at which the fixing is enabled.

By selecting the first rotational speed or the second rotational speed which is slower than the first rotational speed for driving the fuser roller 1 and the pressure roller 2 depending on the sheet medium characteristics, the unfixed toner image is suitably fused, thereby achieving desired fixing. Even though the driving with selecting the first rotational speed or the second rotational speed is conducted, the stress on a sheet medium having an unfixed toner image thereon while passing between the fuser roller 1 and the heat-resistant belt 3 does not vary and is small, thereby preventing the deformation, such as wrinkles, of the sheet medium ejected after the unfixed toner image is fixed. Therefore, it is not required to increase the mechanical rigidity of the fixing device of fuser roller type. In addition, the thickness of the fuser roller 1 can be reduced, thereby improving the speed for heating up the heat-resistant belt 3 by the heat source. The thickness of the pressure roller 2 can also be reduced so as to allow smaller heat capacity. Accordingly, the heat energy absorbed from the heat-resistant belt 3 is small, thereby shortening the warm-up time from a time point at which the power is ON to a time point at which the fixing is enabled.

What is claimed is:

1. A fixing device, for fixing an unfixed toner image formed on a sheet medium, comprising: a fuser roller having a built-in heat source therein; a pressure roller to be pressed against the fuser roller; a heat-resistant belt which is wound around the outer periphery of said pressure roller and is sandwiched between said pressure roller and said fuser roller so as to travel; and a slidable belt tensioning member for tensioning said heat-resistant belt, wherein said belt tensioning member is arranged on the upstream side in the traveling direction of said heat-resistant belt relative to the pressed portion between said fuser roller and said pressure roller and is disposed at such a position that said heat-resistant belt is wrapped around said fuser roller beyond the tangent to the pressed portion between said fuser roller and said pressure roller to form a nip.

2. A fixing device, for fixing an unfixed toner image formed on a sheet medium, comprising: a fuser roller having a built-in heat source therein; a pressure roller to be pressed against the fuser roller; a heat-resistant belt which is wound around the outer periphery of said pressure roller and is sandwiched between said pressure roller and said fuser roller so as to travel; and a belt tensioning member for tensioning said heat-resistant belt, wherein said belt tensioning member is arranged on the upstream side in the traveling direction of said heat-resistant belt relative to the pressed portion between said fuser roller and said pressure roller and said belt tensioning member is supported to be able to swing toward said fuser roller.

3. A fixing device as claimed in claim 2, wherein said belt tensioning member is supported to be able to swing about the rotary shaft of said pressure roller.

4. A fixing device as claimed in claim 2, wherein said belt tensioning member is supported to be able to swing about a shaft different from the rotary shaft of said pressure roller.

5. A fixing device as claimed in claim 1 or 2, wherein said belt tensioning member is disposed to be spaced apart from said fuser roller.

6. A fixing device as claimed in claim 1 or 2, wherein said belt tensioning member is disposed to be pressed against said fuser roller.

7. A fixing device as claimed in claim 6, wherein the pressing force of said belt tensioning member against said fuser roller is set to be smaller than the pressing force of said pressure roller against said fuser roller.

8. A fixing device as claimed in claim 1 or 2, wherein, in the contact pressure distribution between said fuser roller and said heat-resistant belt, the highest pressure is supplied at the pressed portion between said fuser roller and said pressure roller.

9. A fixing device as claimed in claim 1 or 2, wherein said belt tensioning member is a sliding member.

10. A fixing device as claimed in claim 1 or 2, wherein said belt tensioning member is a semilunar member.

11. A fixing device as claimed in claim 1 or 2, wherein said belt tensioning member is a roller member.

12. A fixing device as claimed in claim 1 or 2, wherein said belt tensioning member is a secondary transfer roller.

13. A fixing device as claimed in claim 1 or 2, wherein said belt tensioning member has a convexity(-ies) which is disposed at one end or both ends of said belt tensioning member to limit the lateral shift of said heat-resistant belt by that said heat-resistant belt collides with said convexity.

14. A fixing device as claimed in claim 1 or 2, wherein said fuser roller is driven via said heat-resistant belt by driving said pressure roller.

15. A fixing device as claimed in claim 1 or 2, wherein said pressure roller has a surface harder than an elastic member layered on the outer surface of said fuser roller.

16. A fixing device as claimed in claim 1 or 2, wherein the coefficient of friction between said pressure roller and said heat-resistant belt is set to be larger than the coefficient of friction between said belt tensioning member and said heat-resistant belt.

17. A fixing device as claimed in claim 1 or 2, wherein the wrapping angle between said pressure roller and said heat-resistant belt is set to be larger than the wrapping angle between said belt tensioning member and said heat-resistant belt.

18. A fixing device as claimed in claim 1 or 2, wherein the diameter of said pressure roller is set to be larger than the diameter of said belt tensioning member.

19. A fixing device as claimed in claim 1 or 2, wherein a means for driving said fuser roller and said pressure roller is designed to provide a plurality of rotational speeds and to select the driving speed from the rotational speeds, depending on sheet medium characteristics.

20. A fixing device as claimed in claim 19, wherein the means for driving said fuser roller and said pressure roller is designed to provide a first rotational speed and a second rotational speed slower than said first rotational speed and to select the driving speed from said rotational speeds, depending on the sheet medium characteristics.

21. A fixing device as claimed in claim 19, further comprising a detecting means for detecting said sheet medium characteristics, wherein the sheet medium characteristics of said sheet medium having the unfixed toner image thereon is detected on the way of proceeding of the sheet medium, and said driving speed is selected from said rotational speeds depending on said sheet medium characteristics.

22. A fixing device as claimed in claim 19, further comprising a setting means for setting the selection information depending on said sheet medium characteristics, wherein the setting depending on the sheet medium characteristics is made during the process of making a fixing command for said sheet medium having the unfixed toner image thereon, and said driving speed is selected from said rotational speeds on the basis of the setting.

23. A fixing device as claimed in claim 1 or 2, further comprising a cleaning member which is arranged between said pressure roller and said belt tensioning member and slides along the inner periphery of said heat-resistant belt.

24. A fixing device as claimed in claim 1 or 2, wherein said fuser roller is formed by using a pipe having an outer diameter of 60 mm less and a thickness of 2 mm or less and coating the outer periphery of the pipe with an elastic member of a thickness of 2 mm or less and said pressure roller is formed by using a pipe having an outer diameter of 60 mm or less and a thickness of 2 mm or less.

25. An image forming apparatus employing a fixing device as claimed in claim 1 or 2.

26. A fixing device, for fixing an unfixed toner image formed on a sheet medium, comprising: a fuser roller having a built-in heat source therein; a pressure roller to be pressed against the fuser roller; a heat-resistant belt which is wound around the outer periphery of said pressure roller and is sandwiched between said pressure roller and said fuser roller so as to travel; and a belt tensioning member for tensioning said heat-resistant belt, wherein said belt tensioning member is arranged to be able to swing relative to said fuser roller so as to wrap the heat-resistant belt around said fuser roller to form a fixing nip and wherein a gap is created between said belt tensioning member and said fuser roller when no sheet medium passes and 10 said belt tensioning member is pressed against said fuser roller via a sheet medium when the sheet medium passes.

27. A fixing device as claimed in claim 26, wherein said belt tensioning member is arranged on the upstream side in the traveling direction of said heat-resistant belt relative to the pressed portion between said fuser roller and said pressure roller.

28. A fixing device as claimed in claim 26, wherein said belt tensioning member is arranged on the downstream side in the traveling direction of said heat-resistant belt relative to the pressed portion between said fuser roller and said pressure roller.

29. A fixing device, for fixing an unfixed toner image formed on a sheet medium, comprising: a fuser roller having a built-in heat source therein; a pressure roller to be pressed against the fuser roller; a heat-resistant belt which is wound around the outer periphery of said pressure roller and is sandwiched between said pressure roller and said fuser roller so as to travel; and a belt tensioning member for tensioning said heat-resistant belt, wherein said belt tensioning member is arranged on the upstream side in the traveling direction of said heat-resistant belt relative to the pressed portion said fuser roller and said pressure roller such that said belt tensioning member is able to swing so as to wrap the heat-resistant belt around said fuser roller to form a fixing nip and wherein, assuming that the pressing force at the start position of the nip is P1, the pressing force at the pressed portion between where the pressure roller presses the fuser roller is P3, and the pressing force at a position between the start position of the nip and the pressed portion is P2, the relation P1<P2<P3 is satisfied.

30. A fixing device, for fixing an unfixed toner image formed on a sheet medium, comprising: a fuser roller having a built-in heat source therein; a pressure roller to be pressed against the fuser roller, a heat-resistant belt which is wound around the outer periphery of said pressure roller and is sandwiched between said pressure roller and said fuser roller so as to travel; and a belt tensioning member for tensioning said heat-resistant belt, wherein said belt tensioning member is arranged on the downstream side in the traveling direction of said heat-resistant belt relative to the pressed portion said fuser roller and said pressure roller such that said belt tensioning member is able to swing so as to wrap the heat-resistant belt around said fuser roller to form a fixing nip and wherein, assuming that the pressing force at the end position of the nip is P1', the pressing force at the pressed portion between where the pressure roller presses the fuser roller is P3, and the pressing force at a position between the end position of the nip and the pressed portion is P2, the relation P1'<P2<P3 is satisfied.

31. A fixing device as claimed in claim 29 or 30, wherein a gap is created between said belt tensioning member and said heat-resistant belt when no sheet medium passes and said belt tensioning member is pressed against said fuser roller via a sheet medium when the sheet medium passes.

32. A fixing device as claimed in claim 26, 29, or 30, wherein said belt tensioning member is biased to swing toward said fuser roller by a biasing means.

33. A fixing device as claimed in claim 26, 29, or 30, wherein said belt tensioning member is slid upon said fuser roller at position(s) outside of said heat-resistant belt in the width direction.

34. A fixing device as claimed in claim 26, 29, or 30, wherein said belt tensioning member is supported to be able to swing about the rotary shaft of said pressure roller.

35. A fixing device as claimed in claim 26, 29, or 30, wherein said belt tensioning member is supported to be able to swing about a shaft different from the rotary shaft of said pressure roller.

36. A fixing device as claimed in claim 26, 29, or 30, wherein said belt tensioning member is a semilunar member.

37. A fixing device as claimed in claim 26, 29, or 30, wherein said belt tensioning member is a roller member.

38. A fixing device as claimed in claim 26, 29, or 30, wherein the coefficient of friction between said pressure roller and said heat-resistant belt is set to be larger than the coefficient of friction between said belt tensioning member and said heat-resistant belt.

39. A fixing device as claimed in claim 26, 29, or 30, wherein the wrapping angle between said pressure roller and said heat-resistant belt is set to be larger than the wrapping angle between said belt tensioning member and said heat-resistant belt.

40. A fixing device as claimed in claim 26, 29, or 30, wherein the diameter of said pressure roller is set to be larger than the diameter of said belt tensioning member.

41. A fixing device as claimed in claim 26, 29, or 30, wherein, in the contact pressure distribution between said fuser roller and said heat-resistant belt, the highest pressure is supplied at the pressed portion between said fuser roller and said pressure roller.

42. A fixing device as claimed in claim 26, 29, or 30, wherein said fuser roller and said pressure roller are provided with elastic layers on the outer surfaces thereof, respectively and the respective elastic layers of the fuser roller and said pressure roller are substantially uniformly elastically deformed at the pressed portion therebetween.

43. A fixing device as claimed in claim 26, 29, or 30, wherein said fuser roller is driven via said heat-resistant belt by driving said pressure roller.

44. A fixing device as claimed in claim 26, 29, or 30, wherein a means for driving said fuser roller and said pressure roller is designed to provide a plurality of rotational speeds and to select the driving speed from the rotational speeds, depending on sheet medium characteristics.

45. A fixing device as claimed in claim 44, wherein the means for driving said fuser roller and said pressure roller is designed to provide a first rotational speed and a second rotational speed slower than said first rotational speed and to select the driving speed from said rotational speeds, depending on sheet medium characteristics.

46. A fixing device as claimed in claim 44, further comprising a detecting means for detecting said sheet medium characteristics, wherein the sheet medium characteristics of said sheet medium having the unfixed toner image thereon is detected on the way of proceeding of the sheet medium, and said driving speed is selected from said rotational speeds depending on said sheet medium characteristics.

47. A fixing device as claimed in claim 44, further comprising a setting means for setting the selection information depending on said sheet medium characteristics, wherein the setting depending on the sheet medium characteristics is made during the process of making a fixing command for said sheet medium having the unfixed toner image thereon, and said driving speed is selected from said rotational speeds on the basis of the setting.

48. A fixing device as claimed in claim 26, 29, or 30, wherein said belt tensioning member has a projection wall (s) which is disposed at one end or both ends of said belt tensioning member to limit the lateral shift of said heat-resistant belt by that said heat-resistant belt collides with said projection wall.

49. A fixing device as claimed in claim 26, 29 or 30, further comprising a cleaning member which is arranged between said pressure roller and said belt tensioning member and slides along the inner periphery of said heat-resistant belt.

50. An image forming apparatus employing a fixing device as claimed in claim 26, 29, or 30.

* * * * *